US007681981B2

(12) United States Patent
Hoshi

(10) Patent No.: US 7,681,981 B2
(45) Date of Patent: Mar. 23, 2010

(54) INKJET PRINTER WITH IMPROVED CLEANING AND ADJUSTMENT CAPABILITIES, AND IMAGE PROCESSING APPARATUS

(75) Inventor: Kazunori Hoshi, Machida (JP)

(73) Assignee: Ricoh Company, Limited, Tokyo (JP)

( * ) Notice: Subject to any disclaimer, the term of this patent is extended or adjusted under 35 U.S.C. 154(b) by 696 days.

(21) Appl. No.: 11/500,873

(22) Filed: Aug. 9, 2006

(65) Prior Publication Data

US 2007/0035573 A1 Feb. 15, 2007

(30) Foreign Application Priority Data

Aug. 9, 2005 (JP) ..... 2005-230778

(51) Int. Cl.
*B41J 2/165* (2006.01)

(52) U.S. Cl. ..... 347/22

(58) Field of Classification Search ..... 358/1.2; 361/683; 399/3; 347/14, 19, 43, 115
See application file for complete search history.

(56) References Cited

U.S. PATENT DOCUMENTS

| | | | | |
|---|---|---|---|---|
| 5,291,243 | A * | 3/1994 | Heckman et al. | 399/3 |
| 6,359,701 | B1 * | 3/2002 | Yamada et al. | 358/1.2 |
| 2002/0027767 | A1 * | 3/2002 | Ryder | 361/683 |
| 2004/0088066 | A1 * | 5/2004 | Yamazaki et al. | 700/95 |

FOREIGN PATENT DOCUMENTS

| | | |
|---|---|---|
| JP | 10-202917 | 8/1998 |
| JP | 2000-200240 | 7/2000 |
| JP | 2001-205816 | 7/2001 |
| JP | 2003-263287 | 9/2003 |
| JP | 2004-001492 | 1/2004 |

* cited by examiner

*Primary Examiner*—Stephen D Meier
*Assistant Examiner*—Alexander C Witkowski
(74) *Attorney, Agent, or Firm*—Oblon, Spivak, McClelland, Maier & Neustadt, L.L.P.

(57) ABSTRACT

In an inkjet printer including at least a printhead of inkjet type configured to eject ink according to print data and a cleaning unit configured to perform a cleaning of the printhead by ejecting ink to produce suitable conditions for an inkjet recording, the inkjet printer further includes a user information input unit configured to input user information, a cleaning direction unit configured to issue for a user a cleaning direction, and a control unit configured to instruct the cleaning unit to clean the printhead in response to the cleaning direction issued by the cleaning direction unit on condition that the user information inputted by the user information input unit is permissible to perform the cleaning. Also disclosed is an image processing apparatus, incorporating the inkjet printer and further including a document scanner configured to read an image of a document and to generate first image data corresponding to the image, and an image data processing unit configured to convert the first image data into second image data suitable for image recording by the inkjet printer and to output to the inkjet printer.

21 Claims, 24 Drawing Sheets

| |
|---|
| FIG. 14A |
| FIG. 14B |
| FIG. 14C |

INKJET PRINTER WITH IMPROVED CLEANING AND ADJUSTMENT CAPABILITIES, AND IMAGE PROCESSING APPARATUS

This application claims priority to Japanese Patent Application No. 2005-230778, filed with the Japanese Patent Office on Aug. 9, 2005, the entire contents of which are hereby incorporated by reference.

FIELD OF INVENTION

This invention relates generally to inkjet printheads configured to form printed images by ejecting droplets of ink, and more particularly to an inkjet printhead with improved cleaning and adjustment capabilities and to a printer and an image processing apparatus incorporating the inkjet printhead.

BACKGROUND OF INVENTION

The use of inkjet printers has grown dramatically in recent years. The inkjet printers now offer acceptable print quality for many office and household applications. This trend may be attributed to substantial improvements in print resolution and overall print quality coupled with appreciable reduction in cost. Despite of such recent accomplishment, intensive development efforts continue toward further improvement in inkjet print quality.

Conventionally, inkjet printers and copying apparatuses with inkjet printer are provided with maintenance functions such as head cleaning and capabilities for adjusting the position of printhead and recording sheet, which may be accessible to a user.

Nakamura (Japanese Laid-Open Patent Application No. 2001-205816 assigned to Ricoh) discloses a wiping mechanism for wiping off ink and dirt from the nozzle face (ink ejecting face) of printhead.

Okamoto et al. (Japanese Laid-Open Patent Application No. 2000-1492 assigned to Brother) discloses a cleaning device including a wiping unit and a cap unit for covering the face of ink ejection, with a simple structure capable of improving the efficiency of ink absorption to an adhering blade.

Endo et al. (Japanese Laid-Open Patent Application No. 2000-200240 assigned to Canon) discloses a user authentication system for a multifunctional peripheral device and system, which is accessible by only certified users according to a user authentication table and an access control table.

Men (Japanese Laid-Open Patent Application No. 2003-263287 assigned to Canon) discloses an inkjet printer capable of setting conditions for each user, which is easy to operate for different users preventing operational errors.

Sasai et al. (Japanese Laid-Open Patent Application No. 10-202917 assigned to Seiko Epson) discloses an inkjet printer which is provided with a capping means and a pump for drawing ink by suction through a printhead after closing airtight once and is capable of implementing a flushing action by ejecting ink from nozzles. In the case when the period in suspend mode exceeds a predetermined time when a source power switched on, an automatic cleaning is performed. If a cleaning instruction switch CS is operated, a printhead is driven to the location of cleaner unit and its nozzle plate is wiped off. Thereafter, the printhead is driven further to a capping position, and then capped to eject ink from the nozzles through drawing by suction under a negative pressure.

Although the aforementioned maintenance functions and adjustment capabilities of inkjet printer are useful and necessary means, several cautions may be needed concerning (1) an unduly large amount of ink used for the head cleaning, and (2) a degradation in print quality caused by poor head adjustment. It is therefore desirable for the maintenance and adjustment works to be carried out only by a qualified (or authorized) person such as an administrator.

For the inkjet printers operated by a person or by shared by a relatively small number of people through sharing, the abovementioned has not been essential until recently because of the familiarity of these sharing users. In the recent situations, however, where an inkjet printer is accessible by unspecified users and by the person other than the qualified, various problems have been encountered concerning the control and maintenance of the inkjet printer as mentioned above.

SUMMARY OF THE INVENTION

Accordingly, it is an object of this invention to provide an inkjet printhead having most, if not all, of the advantages and features of similarly employed printhead units, while reducing or eliminating many of the aforementioned disadvantages.

It is another object of the invention to provide an inkjet printhead with improved cleaning and adjustment capabilities such that the undue ink consumption caused by unprepared cleaning can be prevented and that the degradation in print quality is obviated.

It is still another object to provide a printer and an image processing apparatus incorporating such inkjet printhead.

The following description is a synopsis of only selected features and attributes of the present disclosure. A more complete description thereof is found below in the section entitled "Description of the Preferred Embodiments."

According to an exemplary embodiment, in an inkjet printer including at least a printhead of inkjet type configured to eject ink according to print data and a cleaning unit configured to perform cleaning of the printhead by ejecting ink to produce suitable conditions for an inkjet recording, the inkjet printer includes a user information input unit configured to input user information, a cleaning direction unit configured to issue for a user a first cleaning direction, and.

a control unit configured to instruct the first cleaning unit to clean the printhead in response to the cleaning direction issued by the cleaning direction unit on condition that the user information inputted by the user information input unit is permissible to perform the cleaning.

The inkjet printer may further include a setting unit configured to set a permission for, or a prohibition of, the cleaning corresponding to user identification information, in which the user identification information is included in the user information, and the control unit instructs the cleaning unit to clean the printhead in response to the first cleaning direction by the cleaning direction unit on condition that the permission for the cleaning is already set corresponding to the user information inputted by the user information input unit.

In addition, the cleaning is performed in one of a plurality of modes each different in an amount of ink consumption, and the setting unit is configured to set the permission or the prohibition for each of the plurality of modes.

According to another aspect, a plurality of printhead elements is included in the printhead, and the inkjet printer may further include a first adjustment information input unit configured to input printhead position information regarding recording positions of the plurality of printhead elements with respect to a recording sheet such that the recording positions are brought to coincide with each other, in which the control unit instructs the printhead position information inputted by the first adjustment information input unit be set to the printhead position information to bring the positions of recording with the plurality of printhead elements in coincidence with each other, on condition that the permission for printhead position adjustment is already set corresponding to the user information inputted by the user information input unit.

In addition, the inkjet printer may further include several units such as a reset instruction unit configured to input an instruction for resetting at least one inkjet recording adjustment value to an initial value thereof;

communication units configured to communicate with a remote terminal; and a user authentication release setting unit configured to set a user authentication release, in which, in case when the user authentication release is already set, the control unit instructs the setting based on the permission corresponding to the user information be disabled.

Moreover, also disclosed is an image processing apparatus incorporating an inkjet printer comprising anyone of the units recited above, and further including a document scanner configured to read an image of a document and to generate first image data corresponding to the image, and an image data processing unit configured to convert the first image data into second image data suitable for image recording by the inkjet printer and to output to the inkjet printer.

These and other features and advantages of the invention will be more clearly seen from the following detailed description of the invention which is provided in connection with the accompanying drawings.

DETAILED DESCRIPTION OF PREFERRED EMBODIMENTS

In the detailed description which follows, specific embodiments of inkjet printers and image forming apparatuses incorporating such printers are described.

It is understood, however, that the present disclosure is not limited to these embodiments. For example, it is appreciated that the inkjet printers and image forming apparatuses described herein may also be adaptable to a variety of imaging systems. Other embodiments will be apparent to those skilled in the art upon reading the following description.

According to an exemplary embodiment, in an inkjet printer including at least a printhead of inkjet type for ejecting ink according to print data and a cleaning unit for cleaning the printhead by ejecting ink to produce suitable conditions for an inkjet recording, the inkjet printer includes a user information input unit, a cleaning direction unit, and a control unit.

The user information input unit is configured to input user information, the cleaning direction unit is configured to issue for a user a first cleaning direction, and the control unit is configured to instruct the cleaning unit to clean the printhead in response to the first cleaning direction issued by the cleaning direction unit on condition that the user information inputted by the user information input unit is permissible to perform the cleaning.

With the present configuration of the inkjet printer, it becomes feasible to perform a printhead cleaning under the control by a user, in that, while the inkjet printer is in use for a number of people, an undue ink consumption caused by unprepared cleaning can be prevented by performing maintenance and adjustment works by a qualified person such as an administrator.

The inkjet printer may further include a setting unit (for example, 12*r* of FIG. 13) configured to set a permission for, or a prohibition of, the cleaning corresponding to user identification information, in which the user identification information (such as user's name and ID) is included in the user information, and the control unit instructs the cleaning unit to clean the printhead in response to the first cleaning direction by the cleaning direction unit on condition that the permission for the cleaning is already set corresponding to the user information inputted by the user information input unit.

The cleaning is performed in one of a plurality of modes (including cleaning and refreshing) each different in an amount of ink consumption, and the setting unit is configured to set the permission or the prohibition for each of the plurality of modes.

Since a larger amount of ink is consumed in the refreshing mode, which is more extensive than usual cleaning, unnecessary ink consumption can be prevented by performing the maintenance work by an administrator.

Figure 4:
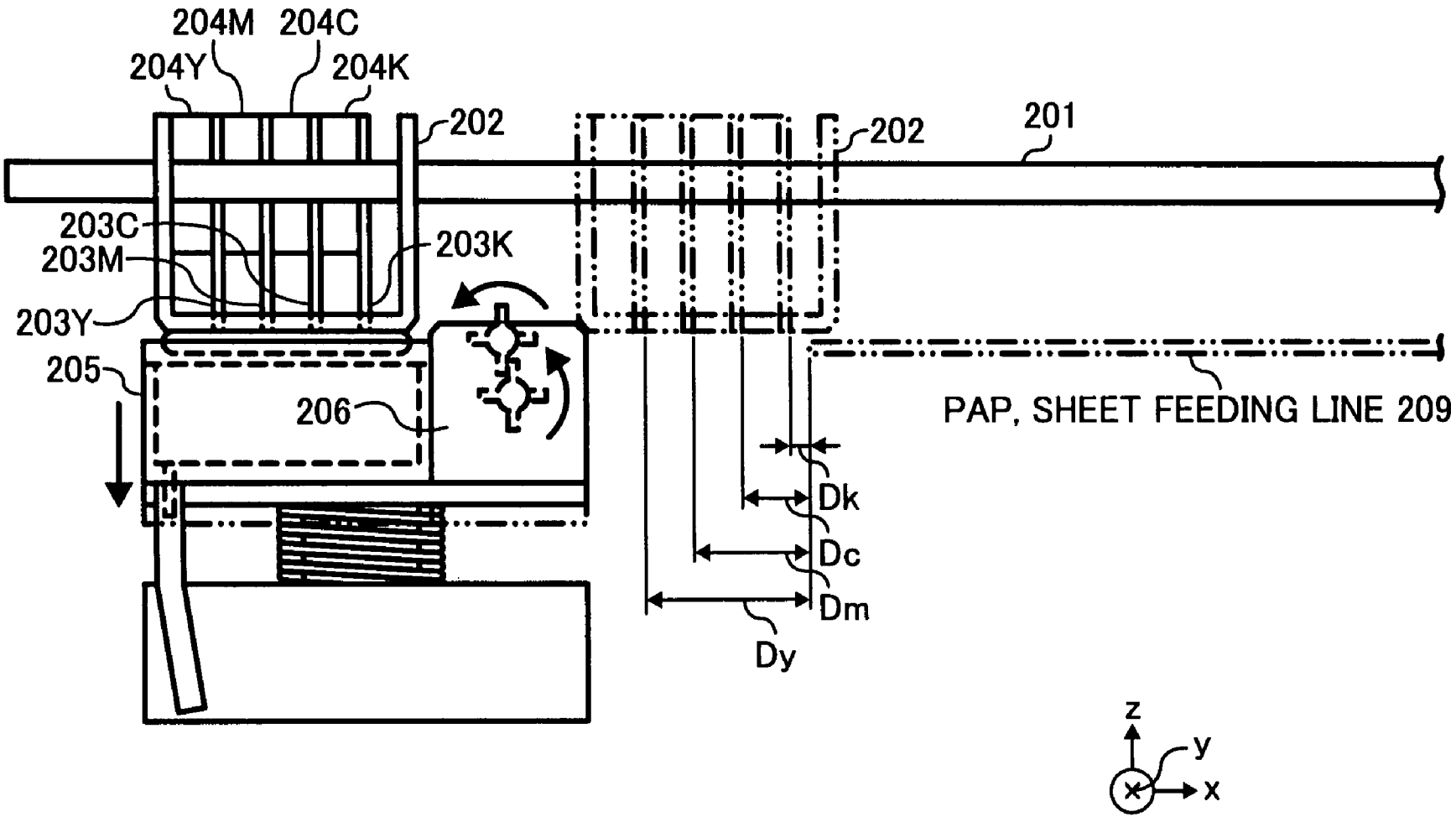
FIG. 4 is a schematic side view illustrating a printing unit 210 included in the color printer 200 provided with a printhead carriage 202 loaded with color inkjet heads 203K, 203C, 203M, and 203Y.

In another aspect, a plurality of printhead elements is included in the printhead (for example, 203K, 203C, 203M, and 203Y of FIG. 4).

In addition, the inkjet printer may include a first adjustment information input unit (12*a* of FIG. 15) configured to input printhead position information (Dk, Dc, Dm, and Dy) regarding recording positions by the plurality of printhead elements with respect to a recording sheet such that the recording positions are brought to coincide with each other, and the control unit instructs the printhead position information inputted by the first adjustment information input unit be set to the printhead position information to bring positions of recording with the plurality of printhead elements in coincidence with each other, on condition that the permission for printhead position adjustment is already set corresponding to the user information inputted by the user information input unit.

Therefore, probable errors in setting the head element position caused by unprepared adjustment works can be prevented by assigning the works to a qualified person.

Still in addition, the inkjet printer may include a second adjustment information input unit configured to input recording start position information regarding inkjet recording start positions with respect to a recording sheet, in which the control unit instructs the recording start position information inputted by the second adjustment information input unit be set to the inkjet recording start positions on condition that the permission for recording start position adjustment is already set corresponding to the user information inputted by the user information input unit.

In addition, the inkjet printer may include a third adjustment information input unit configured to input sheet feed rate information specifying inkjet recording start positions with respect to the leading edge of a recording sheet, in which the control unit instructs the sheet feed rate information inputted by the third adjustment information input unit be set to inkjet recording start positions with respect to the leading edge of the recording sheet on condition that the permission for sheet feed rate adjustment is already set corresponding to the user information inputted by the user information input unit.

By means of the second and third adjustment information input units mentioned above, adjustment works, which may have an influence on the quality of printed image, are performed under the control of a qualified person.

Therefore, positional errors in setting head elements can be obviated and undue degradation in the quality of printed image is prevented by assigning the works to a qualified person, which are otherwise caused by unprepared adjustment works and may adversely affect print qualities.

In addition, the inkjet printer may include a reset instruction unit configured to input an instruction or resetting at least one inkjet recording adjustment value to an initial value thereof, in which the control unit instructs at least one of inkjet recording adjustment values be reset in response to the instruction for resetting issued by the reset instruction unit on condition that the permission for resetting is already set corresponding to the user information inputted by the user information input unit by way of the first communication unit.

By the abovementioned reset instruction unit and the control unit, the adjustment work of initializing by resetting some of recording adjustment values, which may have an influence on the quality of printed image, is performed under the control of a qualified person.

Therefore, possible errors in setting the adjustment parameters can be obviated and undue degradation in the quality of printed image is prevented.

In still another aspect, the inkjet printer may include a first communication unit configured to communicate with a remote terminal, in which the control unit instructs the cleaning unit to clean the printhead in response to the second cleaning direction by the remote terminal by way of the first communication unit on condition that the user information transmitted from the remote terminal is permissible to perform the cleaning.

In addition, the inkjet printer may include a second communication unit configured to communicate with a remote terminal, in which, in response to a transmission of a variety of adjustment information, by way of the second communication unit, including at least one of (1) the printhead position information, (2) the inkjet recording start positions with respect to a recording sheet, and (3) the sheet feed rate information related to the inkjet recording start positions with respect to the leading edge of the recording sheet, the control unit instructs adjustment information be set to the variety of adjustment information transmitted from the remote terminal on condition that the user information transmitted from the remote terminal by way of the second communication unit is permissible to be set to the adjustment information.

By means of the first and second communication units provided as above, the printhead cleaning can be performed, if necessary, by way of the communication units and the remote terminal by a qualified person.

As a result, the cleaning and maintenance of the printer can be properly performed by the person, who is familiar with the present printer conditions, even from remote sites. Therefore, the suitable conditions of the printer can be maintained without erroneous steps of the cleaning and maintenance of the printer, thereby preventing the consumption of undue amount of ink, or impairment of print quality.

Still in addition, the inkjet printer may further include a user authentication release setting unit configured to set a user authentication release, in which, in case when the user authentication release is already set, the control means instructs the setting based on the permission corresponding to the user information be disabled.

Since, in the case when the number of user is relatively small, the requirement of setting a user authentication at each occasion of a series of printing process may be cumbersome from the point of efficient use of the printer. It is advantageous, therefore, to provide the inkjet printer with this release setting unit capable of releasing the user authentication, if necessary and permissible.

In another aspect, the present invention also discloses an image processing apparatus.

In the image processing apparatus including at least an inkjet printer, a document scanner configured to read an image of a document and to generate first image data corresponding to the image, and an image data processing unit configured to convert the first image data into second image data suitable for image recording by the inkjet printer and to output to the inkjet printer, the inkjet printer includes a user information input unit for inputting user information;

a first cleaning direction unit for issuing a cleaning direction for a user;

a control unit for instructing the first cleaning unit to clean the printhead in response to the first cleaning direction issued by the first cleaning direction means on condition that the user information inputted by the user information input means is permissible to perform the cleaning;

a setting unit for setting a permission for, or a prohibition of, the cleaning corresponding to user identification information;

a first adjustment information input unit for inputting printhead position information regarding recording positions by a plurality of printhead elements with respect to a recording sheet such that the recording positions are brought to coincide with each other;

a second adjustment information input unit for inputting recording start position information regarding inkjet recording start positions with respect to a recording sheet;

a third adjustment information input unit for inputting sheet feed rate information specifying inkjet recording start positions with respect to a leading edge of a recording sheet;

a reset instruction unit for inputting an instruction for resetting at least one inkjet recording adjustment value to an initial value thereof;

a first communication unit for communicating with a remote terminal, in which the control unit instructs the cleaning unit to clean the printhead in response to a second cleaning direction by the remote terminal by way of the first communication unit on condition that the user information transmitted from the remote terminal is permissible to perform the cleaning;

a second communication unit for communicating with a remote terminal, in which, in response to a transmission of a variety of adjustment information, by way of the second communication unit, including at least one of (1) the printhead position information, (2) the inkjet recording start positions with respect to a recording sheet, and (3) the sheet feed rate information related to the inkjet recording start positions with respect to the leading edge of the recording sheet, the control unit instructs adjustment information be set to the variety of adjustment information transmitted from the remote terminal on condition that the user information transmitted from the remote terminal by way of the second communication unit is permissible to be set to the adjustment information; and a user authentication release setting unit for setting a user authentication release, in which, in case when the user authentication release is already set, the control unit instructs the setting based on the permission corresponding to the user information be disabled.

It may be added that the inkjet printer in the invention is provided with additional features or units such as (1) a power supply circuit 80 configured to output operation voltages (+24V and +5V) to each part of the inkjet printer in the standby mode and to discontinue the supply thereof in the suspend mode, in which the control unit instructs to switch the power supply circuit from the suspend mode to the standby mode, in response to a user's operation during the suspend mode for returning the standby mode, and, in the case when an elapsed time from the preceding cleaning is a preset time (Tr1) or longer, to perform a cleaning with the cleaning unit;

(2) a wiping unit for wiping an ink ejection face of the printhead, in which the control unit instructs, when an elapsed time from the preceding cleaning is less than the preset time (Tr1), to perform a cleaning with the cleaning unit;

(3) the power supply circuit 80, a cap for covering the ink ejection face of the printhead, and a cap driving unit for driving the cap between the aforementioned working position for covering the ink ejection face and a retracted position for removing the cap away from the face, in which the control unit instructs, when the suspend mode continues for the time Td1 without user's operation, the cap driving unit to drive the cap to the working position, cover the ink ejection face, and to switch the power supply circuit to the suspend mode from the standby mode;

(4) a setting unit for setting Td1 in a memory as a time for shifting from the standby mode to the suspend mode;

(5) the wiping unit for wiping an ink ejection face of the printhead, and the control unit for instructing the wiping unit to wipe an ink ejection face of the printhead before driving the cap to the working position;

(6) the power supply circuit 80 configured to output operation voltages (+24V and +5V) to each part of the inkjet printer in standby mode and to discontinue the supply thereof in the suspend mode, the cap for covering the ink ejection face of the printhead, and the cap driving unit for driving the cap between the working position for covering the ink ejection face and the retracted position for removing the cap away from the face, in which the control unit instructs, (a) when the suspend mode continues for the time Td1 without user's operation, the cap driving unit to drive the cap to the working position, cover the ink ejection face, and switch the power supply circuit to the suspend mode from the standby mode, (b) when a user's operation for returning the standby mode is made during the suspend mode, to switch the power supply circuit from the suspend mode to the standby mode, and (c) when an elapsed time from the preceding cleaning is a preset time (Tr1) or longer, to perform a cleaning with the cleaning unit and to drive the cap to the retracted position by the cap driving unit;

(7) the control unit also configured, (a) when the elapsed time from the preceding cleaning is shorter than a second reference time Tr2, longer than a first reference time Tr1, or simultaneously, shorter than the second reference time Tr2, to instruct to perform cleaning of the printhead with the ejection of relatively small amount of ink, and (b) when the elapsed time is Tr2 or longer, to perform cleaning with the ejection of relatively large amount of ink;

(8) the wiping unit for wiping an ink ejection face of the printhead, in which the control unit instructs, in the case when the cleaning of the printhead is performed by the cleaning unit, the cleaning to include wiping the ink ejection face of the printhead by the wiping unit; and (9) the wiping unit for wiping an ink ejection face of the printhead, in which the control unit instructs, when an elapsed time from the preceding cleaning is less than the preset time (Tr1), to drive the cap to the retracted position by the cap driving unit and to wipe the ink ejection face of the printhead by the wiping unit.

Having described the present disclosure in general, the features of the inkjet printers and image forming apparatuses will be detailed herein below according to several embodiments of the present invention.

Figure 1:
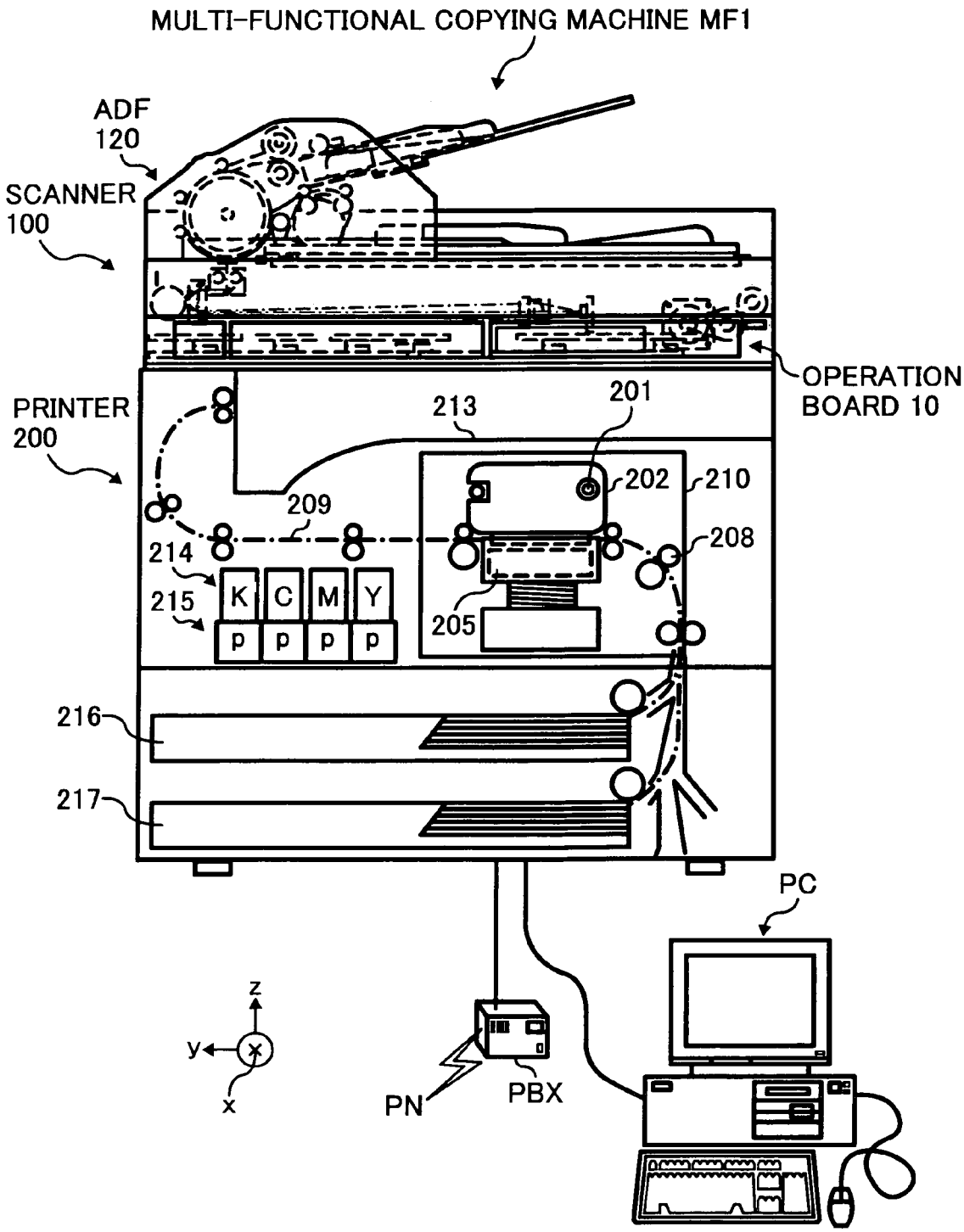
FIG. 1 is a schematic side view illustrating a full color digital multi-functional copying machine MF1 according to a general example in the present disclosure.

FIG. 1 is a schematic side view illustrating a full color digital multi-functional copying machine MF1 according to a general example in the present disclosure.

Referring to FIG. 1, the full color copying machine MF1 disclosed herein includes at least an automatic document feeding unit (ADF) 120, an operation board 10, a color scanner 100, and a color printer 200.

In addition, the operation board 10 and the color scanner 100 with ADF 120 are provided detachably from the color printer 200.

The color scanner 100 is in turn provided with a control board which includes a driver unit for driving several mechanical units, sensor inputs, and a controller. The color scanner 100 is configured to communicate either directly or indirectly with an engine controller (CPU 301 of FIG. 5) and to perform reading operations of document images under proper control of timing.

Including an engine (the unit 300 of FIG. 5) incorporating at least the color scanner 100, color printer 200, and an image input/output unit (302 of FIG. 5), a controller board (400 of FIG. 5) is connected to a LAN (Local Area Network) which is in turn connected to a personal computer PC.

In addition, there connected to a facsimile control unit (FCU 417 of FIG. 5) is an exchange unit PBX (private branch exchange) which is connected to a public network PN (facsimile communication network).

Figure 2:
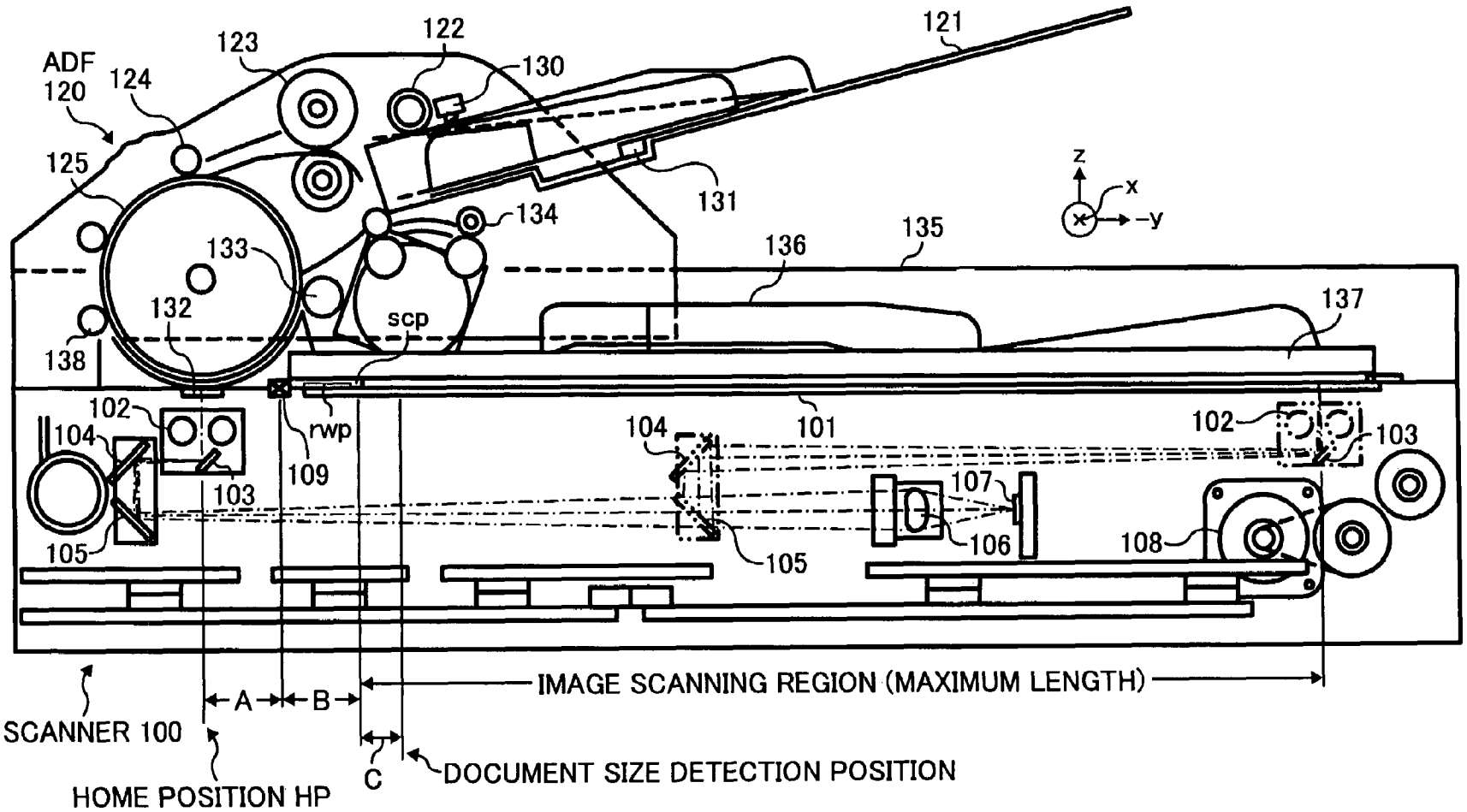
FIG. 2 is a schematic side view illustrating the color scanner 100 and ADF 120 mounted thereto, which serve as a document image reading mechanism of the multi-functional copying machine MF1.

FIG. 2 is a schematic side view illustrating the color scanner 100 and the automatic document feeding unit (ADF) 120 mounted thereto, which serve as a document image reading mechanism of the multi-functional copying machine MF1.

During the document reading a document original is placed on a contact glass plate 101 of the color scanner 100. The original is illuminated with a lamp 102 and scanned with a multiple mirror scanning optics system as follows.

Namely, light reflected from the original (light image) is further reflected by a first mirror 103 to the direction parallel to the secondary (vertical) scanning direction (¯y as designated in the drawing). The lamp 102 and first mirror 103 are supported on a first carriage (not shown) for a constant rate movement along the (−y) vertical scanning direction. Second and third mirrors 104, 105 are supported on a second carriage (not shown) for another constant movement with a half rate along the same scanning direction as the first carriage. The multiple mirror scanning system is of a type well known in the art.

The light image reflected by the first mirror 103 is subsequently reflected by the second mirror 104 vertically downward (z), further reflected by the third mirror 105 to the vertical scanning direction (y), focused by a lens 106, irradiated onto a CCD 107, converted into electric signals, that is, into image signals in respective RGB colors.

The first and second carriages are driven by a driving motor 108 as a driver in the y direction for either an outward document scan or a return movement.

Therefore, scanning the document original, placed on a contact glass plate 101 with the lamp 102 and mirror 103, and projecting the document image onto CCD 107, the color scanner 100 constitutes a document scanner of a type of the flat-bed reading. The color scanner 100 may also be used as a type of fed-through sheet (document) reading by holding the first carriage at a home position (standby point) HP.

In order to implement the sheet-through reading with the scanner 100 mounted on ADF 120, it is configured during the holding period of the first carriage at the home position HP that a glass plate 132 as a sheet-through reading window is positioned within the reading view of the first mirror 103, and that a forwarding drum (platen) 125 is in the position opposing to the glass plate 132.

A document original stacked on a document tray 121 of the ADF 120 is detected by a filler sensor 130. In addition, the size of the document original is determined through ON-OFF operations of a switch group 131 adapted to detect the location of a side plate which is in use for placing the original at one of predetermined tray locations.

In the sheet-through reading mode, the uppermost page of the document stack on the document tray 121 of the ADF 120 is fed forward to a registration roller 125 and up to the glass plate 132 through a pickup roller 122 and sending rollers 123, 124. Then, the light image reflected by the first mirror 103 at the HP position is sent to the second mirror 104, projected onto the CCD 107, and photo-electrically converted into electric signals by the CCD 107 to generate image signals, whereby image signals in respective RGB colors are generated.

In the abovementioned example of the sheet-through reading mode, the home-position HP serves as the position of document reading. In the flat-bed reading mode, however, this home-position HP serves as the starting position for driving the first carriage (which is also the returning point thereof).

In the flat-bed reading mode, the document reading is initiated at the point where the first carriage is driven to the point of start reading with the distance, A+B, from the HP position, which is the position corresponding to the right edge of a scale plate scp. That is, the image signals generated by CCD 107 are enabled starting from the (A+B) position.

There provided between the HP and reading initiation positions are an origin sensor 109 for detecting the first carriage and a reference white plate rwp. The reference white plate rwp is provided in close contact with the left edge surface of the contact glass plate 101.

The reference white plate rwp is configured to implement proper corrections for several errors such as (1) the fluctuation of the light intensity caused either by scanning along the main scanning direction x or by switching from one lamp to another as the lamp 102, and (2) the variation of readout data caused by sensitivity fluctuation of respective pixels in CCD 107 even in the case when a document with a uniform density is scan-read.

Incidentally, the correction for the above term (2) is called as the shading correction. In addition, the reference white plate rwp may also be used as the means for the amplifier gain control (AGC).

The process steps for the first carriage in the flat-bed reading mode are initiated from the HP position concerning driving, and detecting the position thereof, in the vertical scanning direction, as follows.

Namely, (1) if the reference white plate rwp is found within the reading view of the first carriage, image signals output from CCD 107 (i.e., as digitized image data) are read into an image signal processing unit (AFE 111 of FIG. 5), (2) when the first carriage cuts across the origin sensor 109, the startup of the first carriage is completed and the scanning speed thereof converges at a predetermined value, (3) when the first carriage reaches the point of start reading, A+B, or the location corresponding to the right edge of a scale plate scp, enable image signals (frame synchronization signals FGATE) are switched to a significant level, (4) immediately before the point of time when a return drive of the first carriage is initiated after reaching the right edge of the document on the contact glass 101 during the vertical direction scanning and when the first carriage is held on temporarily at the HP position, the origin sensor 109 detects the first carriage and positional data in the vertical scanning direction are initialized at the moment of the detection to be positional data of the origin (predetermined values), and (5) after being held on temporarily at the HP position, the first carriage is driven forward to the position of detecting the document size, A+B+C, and rendered to standby.

Figure 3:
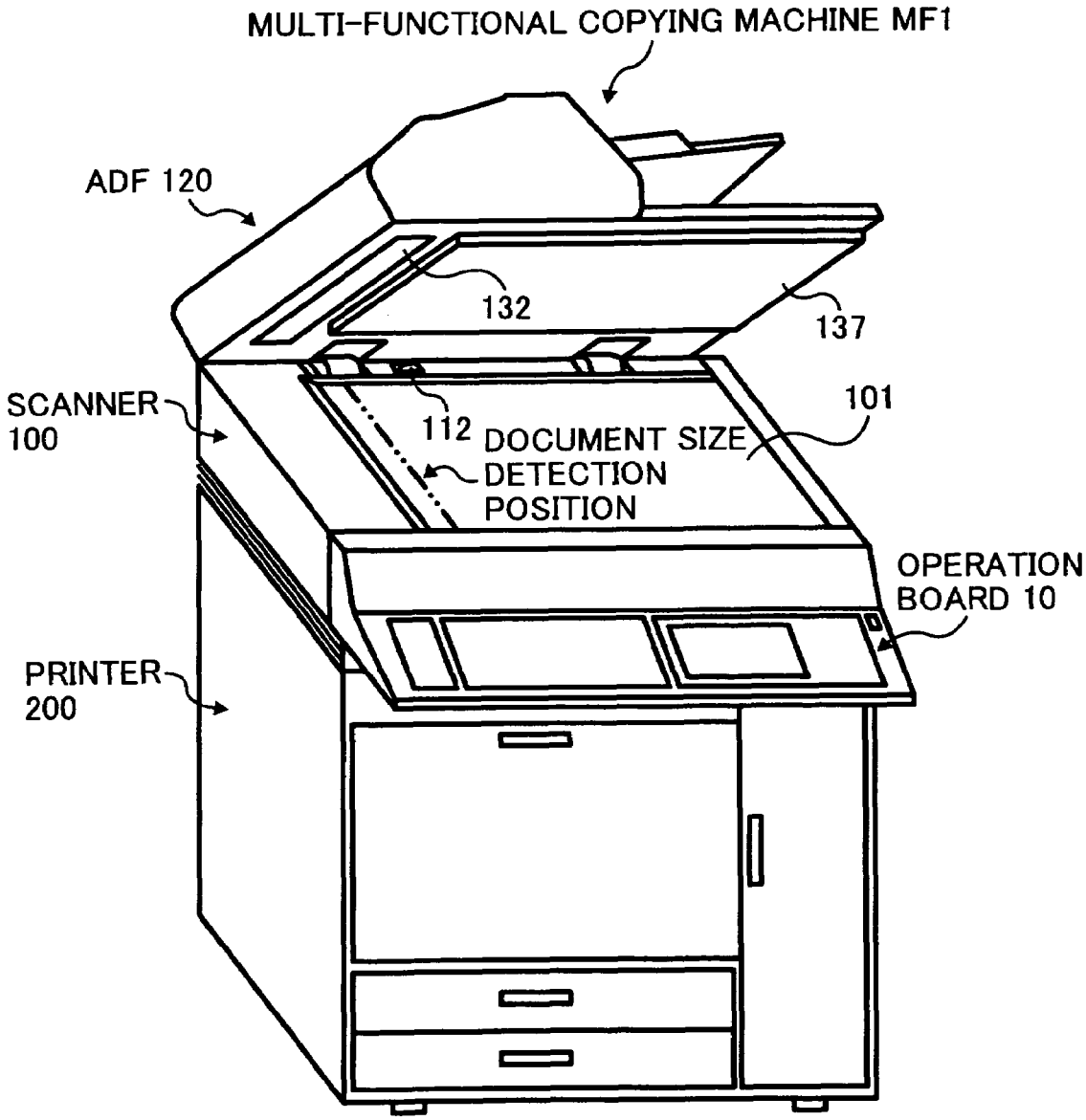
FIG. 3 is a perspective view illustrating the full color digital multi-functional copying machine MF1 of FIG. 1, in which ADF 120 hinge-mounted to a substrate of the scanner 100 at the rear side thereof is raised by lifting.

The base 135 of ADF 120 is hinge-mounted to a substrate of the scanner 100 at the rear side thereof (FIGS. 2 and 3), and can be raised (opened) by lifting with a grip provided on the frontal edge of the base 135 as illustrated in FIG. 3.

A platen switch 112 is provided at the rear side of the base 135, and adapted to perform a switching operation in the present example such that (1) in the course of the above-noted lifting movement (FIG. 3), when ADF 120 is moved from a fall flat position to upstanding and when the angle becomes in excess of a predetermined value of about 30 degree between the lower face of the platen 137 and the contact glass plate as the document loader 101, the platen switch 112 switches from its off-state indicative of closed ADF base to on-state indicative of released base, and (2) in the course of lowering movement when ADF 120 is brought from upstanding position to fall flat, when the angle is less or equal to the predetermined angle, the switch 112 switches from the on-state to off-state indicating the closure of ADF base.

The abovementioned value for the angle indicative of open/close switching has been preset to be rather as wide as about 30 degree so that the position of the boundary of the document and background can be detected (i.e., the document edge as the width of the document in the primary scanning direction). This is carried out by turning on the lamp 102 on the first carriage, which is prefixed at the previously detected document position (FIGS. 2 and 3), to thereby illuminate the document on the contact glass 101, by projecting the document image onto the CCD 107, and determining the document edge based on the CCD image of the document.

It may be added in this context that, in the case when ADF 120 is tilted with the angle of about 10 degree or larger, the light emanated from the lamp 102 is directed to CCD 107 after reflected by the document to be detected as a bright image. While the area outside of the document is found dark by CCD 107 since the light glancing the document is directed to practically outside of the optical field of view of CCD 107. Based on thus observed the difference in the tone of CCD image, the document size is detected by a document size detector (48 of FIG. 6) which will be described later on.

According to the system configuration in the present embodiment mentioned above, the following modes of document image reading are feasible;

(1) Manually-Fed Document Reading

At least one document original is placed on the contact glass 101 by a user after tilting upward the ADF 120 to subsequently press the document by holding down the platen 137, thereafter the document reading process steps are performed according to the flat-bed reading mode mentioned above.

Figure 6:
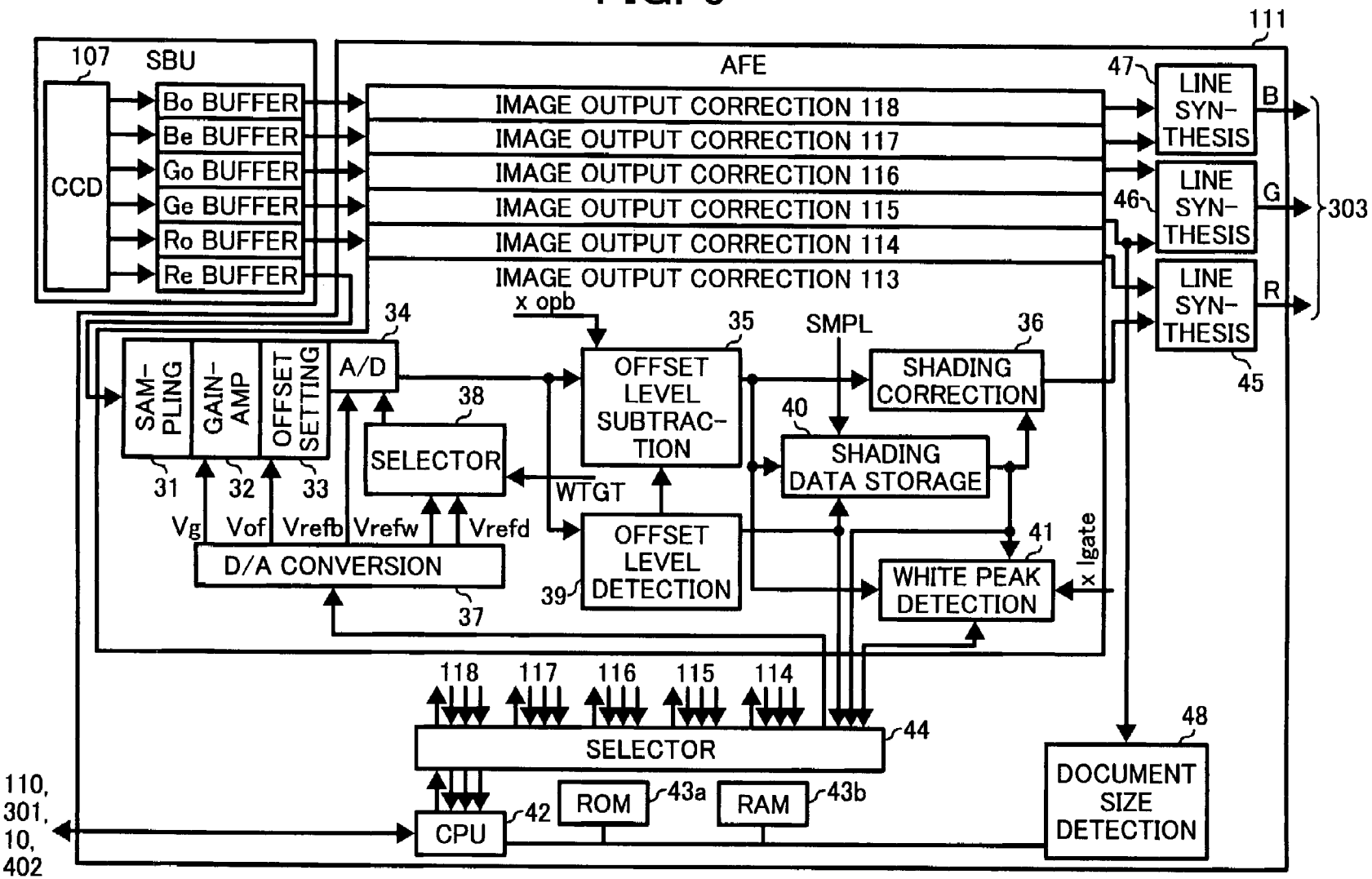
FIG. 6 is a diagrammatical block diagram illustrating the overall feature of image signal processing capability with respect to the sensor board unit SBU and digital processing unit AFE 111.

Namely, when the first carriage goes across right below the reference white plate rwp, the CCD 107 acquires image signals thereof and generates shading correction data based on the image signals, thereby updating the previous correction data. On completing the reading steps, the user removes the document original from the contact glass 101 after lifting with tilting the ADF 120 upward. During placing the document and tilting the ADF 120 downward, the document size is detected by the document size detector 48 (FIG. 6).

(2) Sheet-Through Document Reading

Document originals stacked on the document tray 121 are forwarded one by one to be fed through the ADF 120 and the document reading process steps are performed according to the sheet-through reading mode mentioned above.

When the uppermost page of the document stack on the document tray 121 is fed forward, the first carriage is driven to the point right below the reference white plate rwp. Thereafter, the CCD 107 acquires image signals of the reference white plate rwp and generates shading correction data based on the image signals, thereby updating the shading correction data. This step is repeated for each page of the document stack on the document tray 121.

Referring again to FIG. 1, the system of the color printer 200 will be described herein below. A full-color inkjet printer is adapted herein to serves as the color printer 200.

A printing unit 210 included in the color printer 200 is provided with a printhead carriage 202 to slidably shuttle to and fro in the primary scanning direction x (i.e., perpendicular on the drawing FIG. 2), and the carriage 202 is constructed to load color inkjet heads 203K, 203C, 203M, and 203Y, in which the portion pertinent thereto is shown in FIG. 4 as an enlarged right-side view of the carriage 202 of FIG. 1.

There provided in each of the inkjet heads are a number of ink nozzles assembled in high-density in the vertical scanning direction y (i.e., from left to right on the drawing FIG. 2).

In addition, the inkjet head includes a number of driving elements configured to selectively eject ink droplets of respective colors. Through a first scanning of the carriage 202 in the primary scanning direction x, a color image is formed on a recording sheet by the ink ejection from inkjet heads in respective colors over a predetermined width in the vertical scanning direction, i.e., over one swath of the image.

After advancing (or feeding) the recording sheet by a predetermined distance in the vertical scanning direction, a second scanning of the carriage is carried out as the second swath of the image. By repeating the above scanning steps together with feeding the sheet forward, a full color image is formed over the recording sheet.

These recording steps are repeated for color images be formed on other subsequent sheets as well, which are fed from the sheet cassettes 216, 217 (FIG. 1), forwarded to the registration roller pair 208, and conveyed through the sheet feeding line 209.

On completing the image recording the recording sheets are directed to a paper outlet tray 213.

The unit 214 of FIG. 1 includes ink cartridges each containing ink of colors K, C, M, and Y. The ink is drawn up from the cartridges by pumps 215 and supplied to ink reservoirs of respective colors 204K, 204C, 204M, and 204Y (FIG. 4).

Referring to FIG. 4, a retracted position (depicted with solid lines on the drawing) for the printhead carriage 202 is preset outside the home position (with dotted lines on the drawing) as the starting point of the primary scanning in the horizontal scanning direction.

At the point of carriage retract position a cap 205 is provided vertically displaceable for a double purpose including ink recovery.

Having lower edge faces of respective color nozzles (or nozzles) exposed, the lower face of the printhead carriage 202 is arranged on the same plane with the cap 205. At the carriage retracted position, therefore, the upper opening of the cap 205 is located to oppose directly to the lower edge (recording) faces of respective color nozzles which are exposed as noted above.

An elastic sealing member is provided on the rim of the upper opening of the cap 205 such that the top edge thereof is slightly protruded upward. Therefore, when the cap 205 is raised up to make a close contact by an elevating mechanism provided there under, a close adherence can be achieved between the upper opening of the cap 205 and the lower face of the printhead carriage 202 surrounding the respective color nozzles.

The abovementioned movement is now called "capping," in that the close adherence is achieved between the sealing member of the cap 205 and the lower face of the printhead carriage 202 by raising the cap 205 by the elevating mechanism.

By contrast, there is a movement called "uncapping," in that the cap 205 is lowered, the sealing member is removed from the contact by the elevating mechanism, and displaced to the retracted position so as not to obstruct the to-and-fro movement of the printhead carriage 202.

In addition, an electric-powered wiping mechanism 206 between the retracted position (depicted with solid lines) and the home position (with dotted lines). The wiping mechanism 206 is provided with upper and lower blade rotors each engaged with an electric-powered decelerating mechanism adapted to have the blade rotors rotationally driven in the same direction with the decelerating mechanism.

The blade rotors are each formed of a plurality of elastic, resilient blades each having a length larger than the nozzle separation in the vertical scanning direction.

During the displacement of the printhead carriage 202 from the retracted position to home, the blade rotors are adapted to rotate counterclockwise (on the drawing FIG. 4) so that the bottom face of the carriage 202 is wiped off to remove ink around the nozzle portion. The ink attached to the upper blade rotor is wiped off by the lower blade rotor.

When the printhead carriage 202 is displaced from the home position to the retracted position, the rotor is adapted to rotate clockwise so that the bottom face of the carriage 202 is wiped off. In the either case of the abovementioned displacement of the carriage 202, therefore, the direction of displacement of the blade, which is wiping off the carriage bottom face, is in opposite to that of displacement of the carriage 202.

In addition, although the distances Dk, Dc, Dm, and Dy for each printhead at the home position to the edge of presently fed recording sheet are each fixed value determined by designing, it may be added that these values of the distance are suffered from errors in practice.

After considering the possible errors, the positions, which are each shifted by a minute distance Dx in the primary scanning direction, are first assumed as the starting points for respective printheads. However, possible deviations of actual starting point in the primary scanning direction may be caused by the errors of the designed distances Dk, Dc, Dm, and Dy for respective printheads.

Therefore, the values Dk, Dc, Dm, and Dy (added with Dx, to be more strict) are now taken as the values for determining the record starting timing for respective heads, the adjustment for which is performed in practice through operator's inputs.

This adjustment is called "head position adjustment" in the primary scanning direction x.

In similar manner, although the printheads are each designed to be in the same position in the vertical scanning direction, errors or variations in the position may result in practice. Therefore, the positions, which are each shifted by another minute distance Dy in the vertical scanning direction, are first assumed as the starting points for respective printheads.

However, possible deviations of actual starting point in the vertical scanning direction may be caused by the error with respect to a base position from one printhead to another.

Therefore, the values of distance from the base position added with the value Dy are taken as the values for determining the record starting timing for respective heads in the vertical scanning direction, the adjustment for which is carried out also through operator's inputs.

This adjustment is called "head position adjustment" in the vertical scanning direction y.

Figure 5:
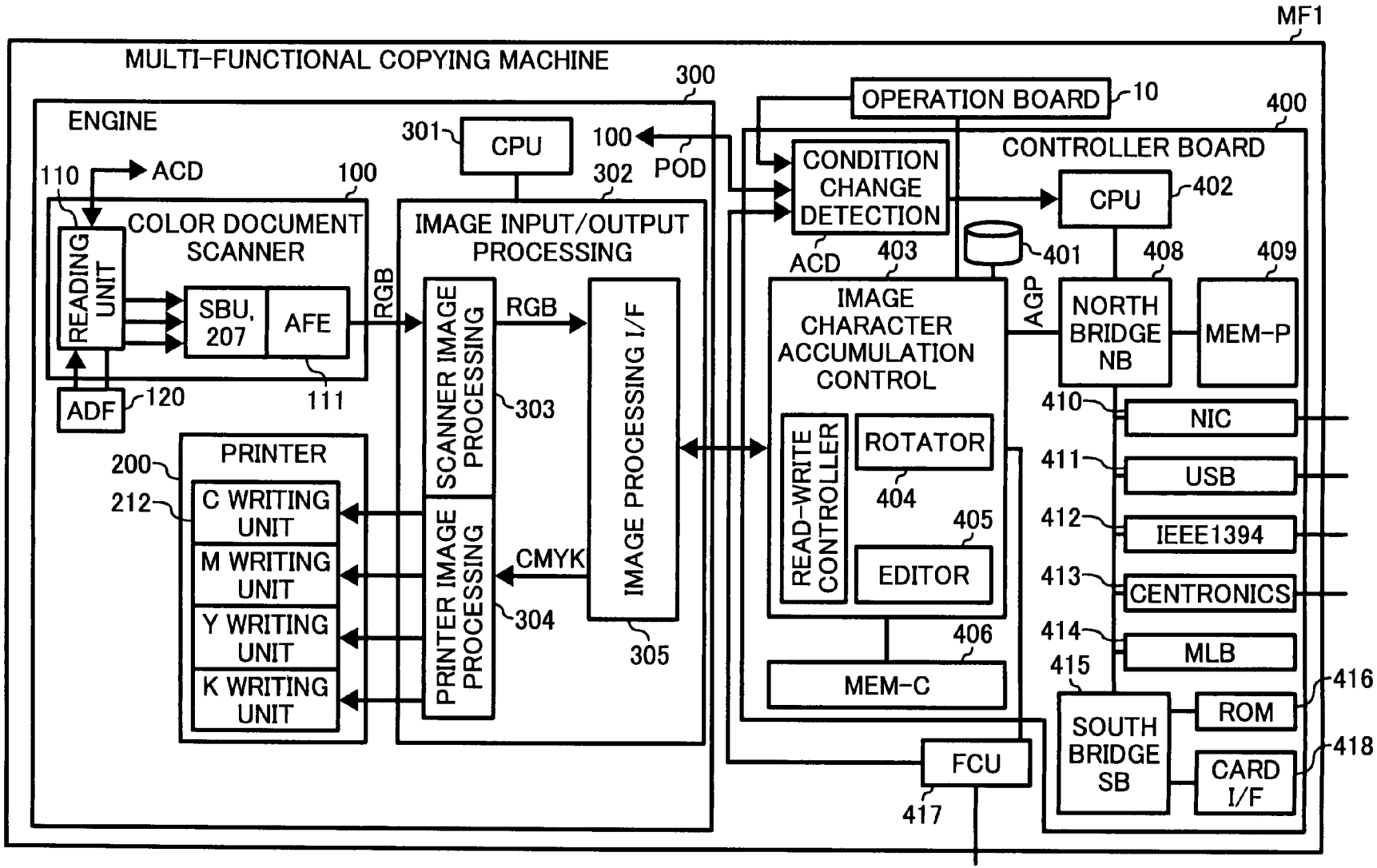
FIG. 5 is a diagrammatical block diagram illustrating the system configuration of the digital multi-functional copying machine MF1 of FIG. 1, illustrating the overall process flow regarding the image data exchange between the color scanner 100, the color printer 200, and the image input/output processor 302.

FIG. 5 is a diagrammatical block diagram illustrating the system configuration of the digital multi-functional copying machine MF1 of FIG. 1.

The digital multi-functional copying machine MF1 includes at least an engine 300 for reading document images and printing color images, a controller board 400, and an operation board 10.

The engine 300 is provided with CPU 301 for controlling the processes of image reading and printing, several aforementioned units such as the color scanner 100 and the printer 200, and an image input/output processor 302 consisting of at least ASIC (Application Specific IC) devices.

A reading unit 110 included in the scanner 100 is provided with CPU, ROM, and RAM, in which the CPU is adapted to assume the overall control of the scanner 100 by writing and executing the programs stored in ROM.

In addition, the abovementioned CPU is connected to CPU 301 by way of a communication line and implements several operations instructed through the transmission/reception of commands and data.

The CPU included in the reading unit 110 is configured to control the detection and on-off switching of a filler sensor (document sensor), a base sensor, the platen sensor, and a cooling fan. Also in the reading unit 110, a scanner motor driver is driven by PWM (pulse width modulated) outputs from CPU, which is adapted to generate the sequence of energizing pulses, and a stepping motor is activated for scanning a document original.

The document original is illuminated with a light emission emanated from a tungsten halogen lamp 102 (FIG. 2) controlled by a lamp regulator.

The light reflected from the original (light image signals) is transmitted through plural mirrors 103~105 and a lens 106, and focused onto CCD 107 incorporating three line sensors each adapted to read R, G, and B images.

The three-line CCD 107 is adapted to output analog image signals, which are outputted from respective RGB pixels, to the digital processing unit (AFE) 111. The unit AFE 111 serves as the image signal processing means for performing the analog-to-digital conversion, and the shading correction, on the image signals.

The control board 400 includes a CPU 402, a character-image/picture storage controller 403 structured with ASICs, a hard disk unit (hereinafter referred to as HDD) 401, a local memory (MEM-C) 406, a system memory (MEM-P) 409, a northbridge unit (as NB) 408, a southbridge unit (as SB) 415, a network interface card (NIC) 410, a USB device 411, an IEEE1394 device 412, a Centronics device 413, etc.

The operation board 10 is connected to the character-image/picture storage controller 403 of the control board 400.

The facsimile control unit (FCU) 417 is also connected to the character-image/picture storage controller 403 by way of PCI bus.

The CPU 402 is configured to perform transmission and reception operations of character-image/picture information with personal computers (PC) connected to LAN by way of NIC 410 and other PCs connected by way of the Internet. In addition, the CPU 402 is also configured to communicate with PCs, digital cameras, and other similar devices.

SB 415, NIC 410, USB device 411, IEEE1394 device 412, the Centronics device 413, and MLB 414 are connected to NB 408 by way of PCI bus.

The MLB 414 is therefore a substrate which connects with the engine 300 by way of the PCI bus. In addition, the MLB 414 is adapted to convert character-image/picture data inputted from outside into image data and output thus converted image data to the engine 300.

The local memory 406 and the HDD 401 are connected to the character-image/picture storage controller 403 of the control board 400. In addition, the CPU 402 and the character-image/picture storage controller 403 are interconnected by way of NB 408 as a CPU chipset. Further, the character-image/picture storage controller 403 and the NB 408 are interconnected by way of AGP (accelerated graphics port).

The CPU 402 is configured to assume the overall control of the multi-functional copying machine MF1.

The NB 408 serves as a bridge for interconnecting CPU 402, the system memory 409, SB 415, and the character-image/picture storage controller 403.

The system memory 409 is a memory used as an imaging memory for the multi-functional copying machine MF1 and others.

The SB 415 is another bridge for connecting the NB 408 to the PCI bus and external devices, and connected to an external ROM 416 and a card IF 418 used for performing reading/writing operation on SD memory card (hereinafter as SD card). The card IF 418 is connected to a card reader, as the unit adapted to the reading/writing operations, which is capable of reading out data from, and writing data into, the SD card.

The local memory 406 is a memory used as a buffer for handling images for forming copies and pertinent codes.

The HDD 401 is adapted to store several contents such as image data, document data, programs, font data, forms, and LUT (look up table).

In addition, the operation board 10 is adapted to accept input operations by, and display to inform to, a user as well.

Referring again to FIG. 5, the overall process flow will be described regarding the image data exchange between the color scanner 100, the color printer 200, and the image input/output processor 302.

The image input/output processor 302 includes several processing units such as (1) a scanner image processing unit 303 configured to perform the readout-gamma correction and the modulation transfer function (MTF) correction to respective R, G, B image data, which are generated after reading out by the color scanner 100, (2) a printer image processing unit 304 configured to convert the R, G, B image data into c, m, y, k recording-color data (printing data) conforming with image representation characteristics of C, M, Y, K color writing (recording), and (3) an image-processing I/F (interface) 305 configured to output the abovementioned generated R, G, B image data to the character-image/picture storage controller 403, and transfer RGB image data outputted from the controller 403 to the printer image processing unit 304.

In the case of monochrome copying operation, G image data are outputted to image-processing I/F 305 from the scanner image processing 303, the printer image processing unit 304 converts the G image data into k recording-color data, the scanner image processing unit 303 performs several operations such as image scaling and/or work, if necessary, and printer gamma and gradation corrections, and outputs the resulting data to a K recording unit in the printer 212.

Based on the k recording-color data outputted from the printer image processing unit 304, the printer 212 is then adapted to either modulate or on/off control the current which is supplied to respective driving elements of the recording head 204K.

In the case of full color copying operation, the RGB image data outputted from the scanner image processing unit 303 are either temporarily stored in the local memory (MEM-C) 406 or HDD 401, or registered in HDD 401, by way of the image-processing I/F 305 and the character-image/picture storage controller 403, and subsequently readout to be in use for printing or sent to exterior.

In the case of printing with the printer 200 the image data registered as above or the image data transmitted from exterior, the image data are sent to the printer image processing unit 304 by way of the character-image/picture storage controller 403 and the image-processing I/F 305.

The printer image processing unit 304 converts the image data into cmyk recording-color data, performs several operations such as image scaling and/or work, if necessary, and printer gamma and gradation corrections, and outputs the resulting data to the recording unit in the printer 212.

There connected to a state-change detection circuit ACD of the control board 400 are several signal lines such as (1) detection signal lines respectively connected to the platen switch 112 of the reading unit 110 and the filler sensor 130 of ADF 120, (2) a key-operation detection signal line connected to the power supply key switch 21 of the operation board 10, and (3) a reception detection signal line connected to the facsimile controller 417.

During the on-period of the main power switch 79 (FIG. 10), an operation voltage +5VE is continuously applied to the state-change detection circuit ACD even the power supply circuit 80 is in the suspend mode.

As long as the +5VE operation voltage is applied and if any signal change is detected in any of the abovementioned signal lines, a state-change signal is outputted to CPU 402, informing the signal change. In concert with the state-change signal the CPU 402 switches the power supply circuit 80 to the standby mode.

There provided in the in the state-change detection circuit ACD are a power-reset-on circuit for outputting a reset pulse when the +5VE operation voltage is applied in the standby mode (when a main power switch 79 is switched to ON from OFF), and a latch circuit (flip-flop with its Q-output serving as power-on mode signal POD) adapted to be reset by the reset pulse and latch the power-on mode signal POD, as the output from the latch circuit, to be the level L ("0").

Figure 11A:
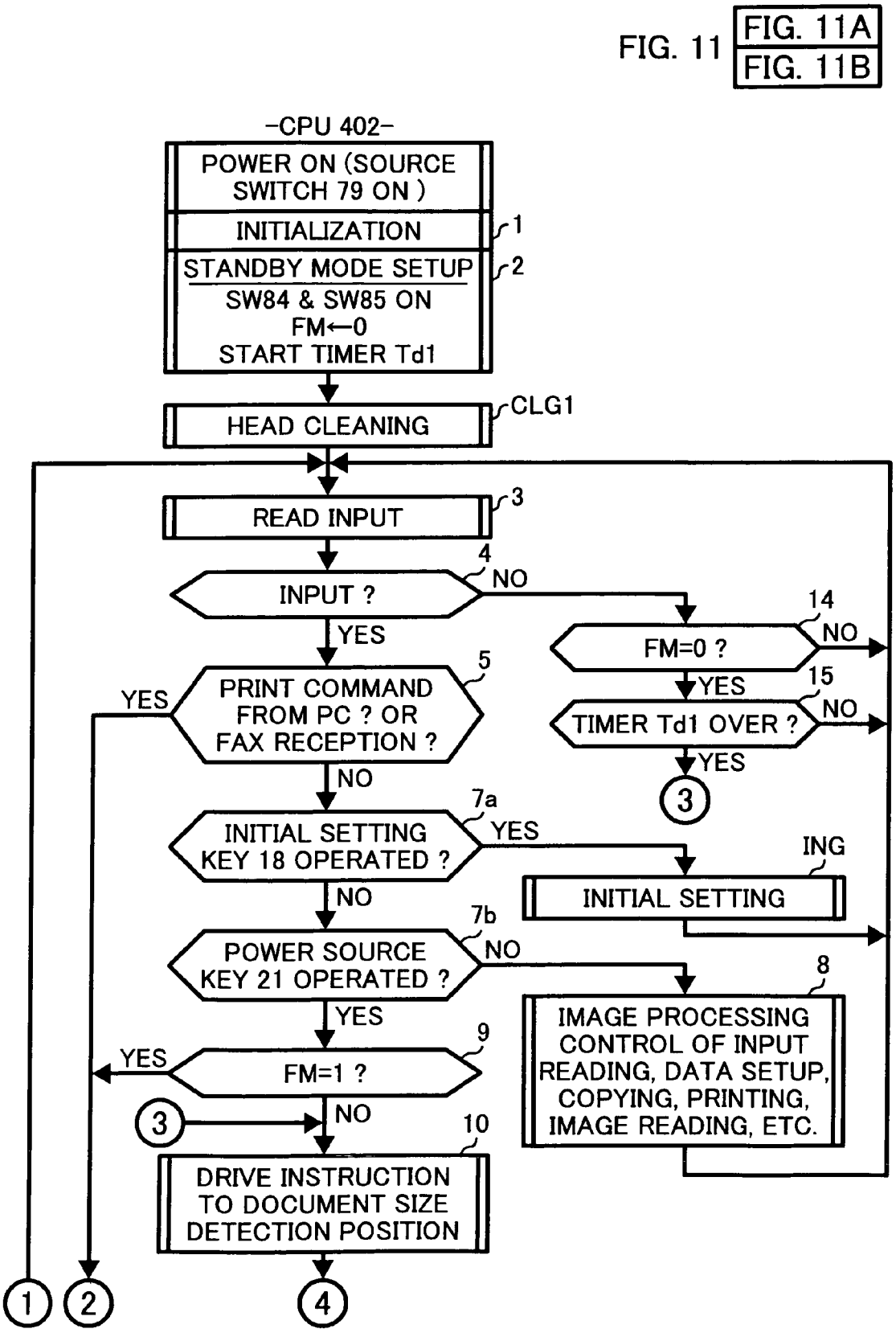
FIG. 11 is a flowchart illustrating the operations of standby/suspend mode changeover control executed by the controller board 400 and of standby/suspend mode changeover control of the ink-jet printer 200.
Figure 11B:
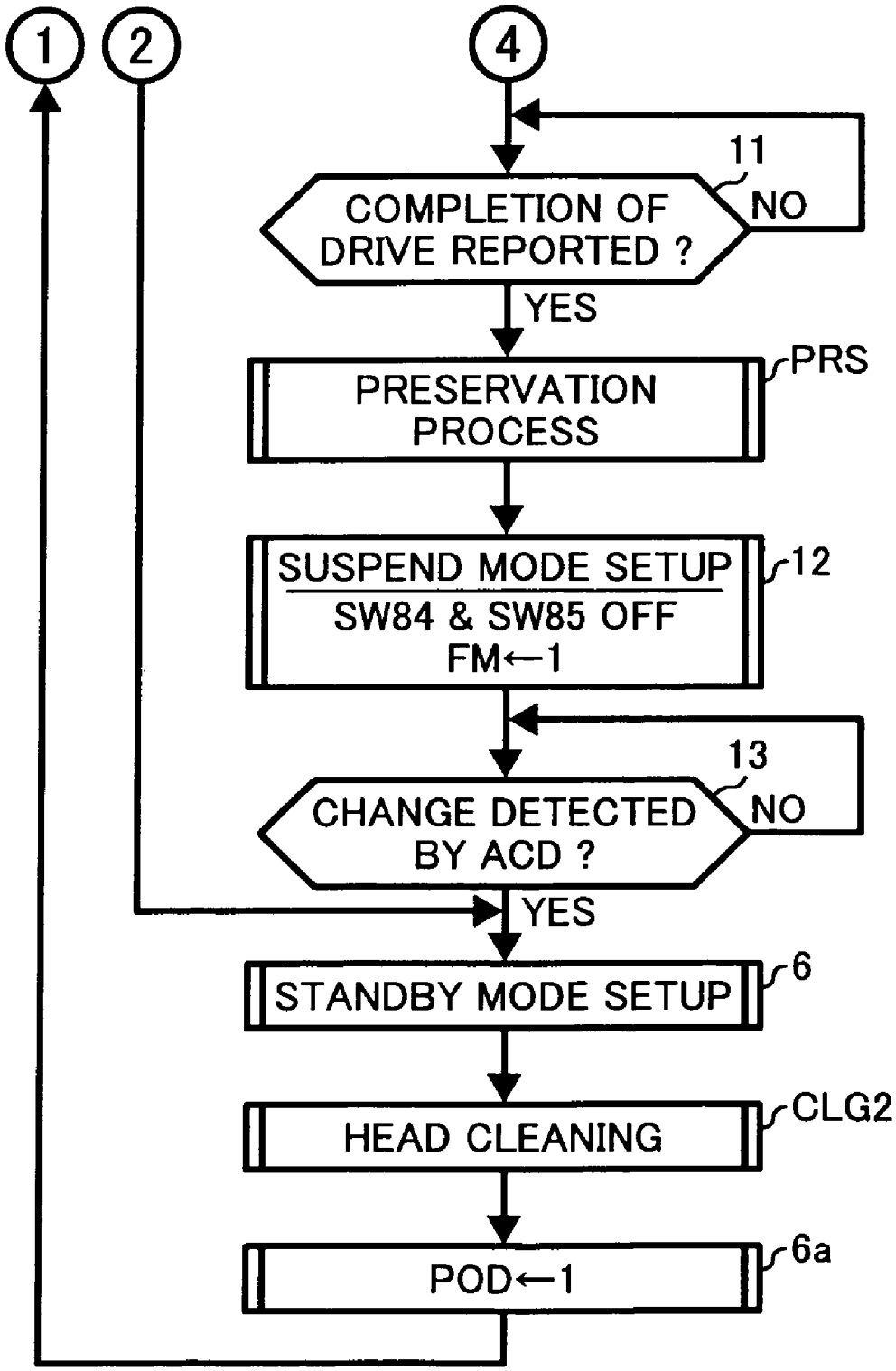

When the power supply circuit 80 is switched from OFF to standby, the CPU 402 instructs the latch circuit to switch the power-on mode signal POD to the level H ("1") (6*a* of FIG. 11).

The notation "0" for the power-on mode signal POD indicates that the power supply circuit 80 is brought to standby by the above-noted switching of the main power switch from OFF to ON, while the notation "1" indicates that the power supply circuit 80 is brought to standby from OFF.

The power-on mode signal POD is therefore utilized to decide the operating voltage currently applied to the document scanner 100 is caused by either switching ON the main power switch 79 or the above switching by CPU 402 from OFF to standby.

Referring now to FIG. 6, the overall feature of image signal processing capabilities will be described with respect to a sensor board unit SBU and AFE 111.

The CCD 107 is adapted to divide R, G, B image signals respectively into two groups of pixels, one being the pixels in even-numbered row and the other being odd-numbered, to be outputted in parallel.

The two groups of image signals in respective colors, even-number-row pixel image signals and odd-number-row pixel image signals, are each amplified by individual buffer-amps Bo, Be, Go, Ge, Ro, and Re (FIG. 6) to subsequently be outputted to image correction units 114 through 118, respectively.

Although the configuration of image output correction 113 is illustrated in FIG. 6 with respect to the process of converting only R image signals in the even-number-row pixels (i.e., Re signals) into digital data, other configurations of image output corrections, 114 through 118, can also be described in a similar manner. Subsequent steps of image output correction 113 will be detailed herein below also with respect to the Re signals.

Being outputted from CCD 107, the R image signals in the even-number-row pixels (i.e., Re signals) are driven by Re buffer amplifier in the SBU unit, sample-held by the sampling circuit 31, and high frequency components therein such as a reset noise are removed.

The variable gain amplifier 32 is adapted to be capable of controlling its gain by a control voltage Vg applied to the control terminal, in which the offset setting circuit 33 is adapted to set offset levels as either positive or negative depending on the control voltage Vof applied to the control terminal.

The voltages, Vg and Vof, are determined by suitably operating the D/A conversion circuit 37 by CPU 42. For example, if the D/A conversion circuit 37 is an 8-bit D/A circuit, the CPU 42 instructs to set one number out of 0 through 255 to the D/A conversion circuit 37, and the D/A conversion circuit 37 outputs a corresponding voltage.

The A/D conversion circuit 34 is adapted to convert an analog image signal into a digital image signal, i.e., image data, at predetermined resolution (for example, 8 bits) based on upper reference value Vrefd/Vrefw and minimum reference value Vrefb.

The image data are inputted to an offset level detection circuit 39 and an offset level subtraction circuit 35.

It is noted in this context that the upper reference value Vrefd/Vrefw and the minimum reference value Vrefb are determined by suitably operating the D/A conversion circuit 37 by CPU 42.

The upper reference outputs Vrefd and Vrefw are inputted to the selector 38. The selector 38 is adapted to set the upper reference value of the A/D conversion circuit 34 to be either Vrefw in the case of reading the standard white board rwp or Vrefd in the case of document reading.

The CCD 107 is also provided with a physically shaded sensor portion called an optical black (OPB) pixel and with a further sensor portion called an effective pixel adapted to output a voltage in proportion to the intensity of incident light.

The data of the OPB and effective pixels are outputted repeatedly every primary scanning period.

The offset level detection circuit 39 has the capability of importing then storing the output of the A/D conversion circuit 34 corresponding to the OPB pixel of CCD 107 during the period when x opb signal is asserted.

The offset level subtraction circuit 35 is adapted to subtract the offset level stored in the offset level detector circuit 39 from the output value of A/D conversion circuit 34 inputted as above.

A white peak detection circuit 41 is adapted to store a peak value of the image data inputted during the period when either x Igate signal representing effective pixel region for document reading or S MPL signal representing the period of reading the standard white board is asserted.

CPU 42 is able to acquire updated offset level value and peak value by accessing the offset level detector circuit 39 and the white peak detector circuit 41.

A shading data storage unit 40 is adapted to perform an averaging operation of the value readout from the standard white board rwp and store the resulting values one by one for respective pixels.

A shading compensation circuit 36 is adapted to convert the image data obtained by reading picture images into image data, which are shading-corrected utilizing correction data stored in shading data storage 40.

The CPU 42 is capable of instructing image data, which are read from the standard white board, be stored in a line memory for temporarily storing image data to perform an inter-line averaging of the image data, and of subsequently reading image data in a specific pixel (at a certain location in the primary scanning direction on the standard white board rwp).

The output of the A/D conversion circuit 34 causes a predetermined delay during the A/D conversion.

The signal xopb denotes an offset-level data range specification signal (i.e., a signal for specifying the data range of offset level), which is timing-designed to be asserted for a predetermined period at the timing in coincidence with the A/D conversion output corresponding to the readout analog signal.

Since it is empirically known that the latter half portion of the readout analog signals of OPB pixels is usually less susceptible to noises, the setting is carried out accordingly in the present embodiment as well.

The signal xlgate denotes a signal asserted in the range where the document is read within the effective pixel portions, and used for specifying the reading range during white peak detection.

WTGT is a signal asserted to the timing for reading the standard white board rwp with CCD 107 and is used as a selector switching signal.

A selector 38 is adapted to select either Vrefw, when WTGT is asserted, or Vrefd, when negated, to be outputted to the A/D conversion circuit 34.

SMPL is asserted for a portion of the period within the timing for reading the standard white board rwp with CCD 107, and used for specifying the timing (WTGT) for importing standard white board data to shading data FIFO.

Adjustment of Gain etc (AGC)

According to operational programs, which are read from ROM 43*a* and written in RAM 43*b*, the CPU 42 instructs first to input the upper reference voltage Vrefw to the A/D conversion circuit 34 after displacing the first carriage to the position of the standard white board rwp, and to read the peak data Dwp of standard white board reading.

In the next place, the peak data Dwp are examined regarding whether the data are in the predetermined range Dp±B.

Dp is an adjustment target value which is determined such that the peak value of analog image signals inputted to the A/D conversion circuit 34 does not exceed the upper reference voltage Vrefw (i.e., about 80 percent of the upper reference voltage Vrefw, when the margin is considered).

This setting is made to fully utilize the capabilities of the A/D conversion circuit and acquire high-precision digital signals. In addition, B is the adjustment tolerance.

When the peak data Dwp are within the predetermined range Dp±B, several values currently set such as the control voltage Vg, the lower reference voltage Vrefb, and the upper reference voltages Vrefw and Vrefd, are stored in RAM 43*b*.

By contrast, when the peak data Dwp are not within the predetermined range Dp±B, a setting value SVg (D/A input) of the D/A conversion circuit 37, which is in use for outputting a control voltage Vg (D/A output) for determining the gain, is computed so as to bring the peak data Dwp within the predetermined range.

Subsequently, it is determined whether thus computed SVg value is within the configurable range (SvgL-SvgH) of the D/A conversion circuit 37. In the case where the D/A conversion circuit 37 is an 8-bit D/A circuit, for example, the configurable range is between 0 through 255.

If the computed SVg value is within the configurable range, the value is set in practice and the peak data Dwp is read again. By contrast, if the computed SVg value is not within the configurable range, a value SvgL or SvgH close to the computed value within the configurable range is set, the peak data Dwp is read, and examined in a similar manner as above.

When the peak data Dwp is not within the predetermined range Dp±B, CPU 42 instructs to calculate the upper reference voltage Vrefw of the A/D conversion circuit 34 for reading the standard white board rwp.

In the case when the relational expression between the set value (input data) and reference voltage Vrefw (output voltage) is as Vrefw=f (Srefw), while the inverse function of f(Srefw) is Srefw=g (Vrefw), the input data Srefw of the D/A conversion circuit 37 corresponding to Vrefw to be changed is expressed as $$Srefw=g(Dwp/Dp/(f(Stp)-f(Stb))-f(Stb)),$$

where Dp is the peak data expected after changing the set value Srefw of the D/A conversion circuit 37 corresponding to Vrefw, Stp is the set value Srefw inputted to the D/A conversion circuit 37 when the peak value Dwp is obtained, and Stb is the set value Srefb of the D/A conversion circuit 37 corresponding to Vrefb.

Thereafter, it is examined whether the resulting Srefw is within the configurable range (SrefL-SrefH) of the D/A conversion circuit 37.

In the case when the D/A conversion circuit 43 is an 8-bit D/A circuit, for example, the configurable range is between 0 through 255.

If the computed Srefw is within the configurable range, the value is set in practice and the peak data Dwp is read again. By contrast, if the computed Srefw is out of the configurable range, it is determined as in error, a value SrefL or SrefH close to the computed value is set, and the process ends.

However, this error result is caused only by the problem of the side of hardware such as wiring pattern disconnection or other similar problems.

Since the reference voltage Vrefw for standard white board reading has been changed, the magnitude of the image data after the shading correction may change considerably without suitable change of the reference voltage Vrefd for document reading.

Accordingly, this change of the reference voltage Vrefd is made such that the relational expression, $$(Vrefwb-Vrefb)/(Vrefwa-Vrefb)=(Vrefdb-Vrefb)/(Vrefda-Vrefb),$$

is satisfied, where the reference voltage Vrefw for reading the standard white board before and after the change as Vrefwb and Vrefwa, respectively; the reference voltage Vrefd for reading the document before and after the change as Vrefdb and Vrefda, respectively; and Vrefb is the lower reference voltage.

That is, the reference voltage Vrefd for document reading of the D/A conversion circuit 37 is set so as satisfy the abovementioned expression.

Thereafter, CPU 42 instructs to set a setting value for outputting the above value Vrefa corresponding to Vrefd and the value Vrefwa corresponding to Vrefw, and to store in RAM 43*b* several values such as the thus set upper reference voltage Vrefw and Vrefd, the control voltage Vg used for this setting, the setting values Srefw, Srefd, and Svg and Srefb used for lower reference voltage Vrefb. On completing the storage the step of the AGC adjustment ends.

The set values obtained through the gain adjustment are sent to the controller board 400, and registered (i.e., written after updated) together with the time the setting was conducted into the setting data table corresponding to AFE 111 in HDD 401 as a nonvolatile memory Incidentally, immediately after the scanner 100 (and ADF 120) is powered on, the CPU 42 of AFE 111 in the scanner 100 instructs the abovementioned setting values to be acquired through the controller board 400 (HDD 401), written into the RAM 43*b*, and then set into respective portions 113 through 118 of FIG. 6 for implementing image output corrections. The process of the setting will be described herein below.

Setting of Gain etc.

During process of shifting from the mode of power OFF or energy-saving (suspend or halt mode, as described later) to the mode of waiting for instruction of document reading (standby mode or low-power mode, as also described later), the CPU 42 instruct various set values set as above such as the adjustment gain and others, which are previously registered in the setting data table in HDD 401 of the controller board 400, be readout and then written into RAM 43*b*, and then stored (set) in the latches (registers) of the D/A conversion circuit 37 for correcting respective image outputs.

That is, the CPU 42 instructs the set value Srefd for obtaining Vrefd, which is registered in HDD 401 as the nonvolatile memory, be output to the D/A conversion circuit 37, and a D/A conversion output voltage Vrefd as upper reference voltage be sent to the A/D conversion circuit 34 by way of the selector 38. In addition, the set values Vg, Vrefb for setting Svg, and Srefb are also sent to the D/A conversion circuit 37.

When an image signal is inputted into the image output correction unit 113 following the abovementioned settings, the A/D conversion circuit 34 is adapted to perform A/D conversion on analog image signals from the document reading into digitized image data, which are represented in a scale according to the division of the range between the lower reference voltage Vrefb and the upper reference voltage Vrefd into the predetermined number of sub-regions.

Setting Shading Correction Data

For setting data used for shading correction when the first carriage is displaced immediately under the reference white plate rwp, the white board rwp is read through image reading processing, which performed the abovementioned setting of various set values to the D/A conversion circuit 37, shading correction data for one line in the primary scanning direction are generated based on the white board image data, and stored in the shading data storage 40.

Detection of Document Size

When the first carriage is at the document detection position and an ON/OFF signal of the platen switch 112 indicates the change from open to closed, CPU in the reading unit 110 (FIG. 5) instructs to turn on the lamp 102 and drive the first carriage to the home position, and the CPU 42 in AFE 111 instructs the document size detection unit 48 to detect the size of document.

The document size detection unit 48 is adapted to count continuous white pixels on each line along the primary scanning direction x from reading start (the side edge portion of the rear side of the contact glass 101 with the pressure plate 137 is open as shown in FIG. 3) to finish, average the numbers obtained from the count for several lines, encode thus obtained average to the document size, and output to CPU 42.

In addition, when the predetermined number of continuous white pixels is not obtained, the document size detection unit 48 outputs a NO-document code to CPU 42.

Image Output Correction

During the period of document reading, image processing according to each set value, which is readout from the set data table in HDD 401 as the nonvolatile memory and set into the D/A conversion circuit 37, is carried out by image output correction units 113 through 118 of AFE 111, a variable gain amplifier 32 amplifies image data with a setting gain Vg, and the A/D conversion circuit 34 performs the A/D conversion on the image signals into digitized image data, which are represented in a scale according to the division of the range between the lower reference voltage Vrefb and the upper reference voltage Vrefd into the predetermined number of sub-regions.

Since the A/D conversion of the analog image signals is carried out using the upper reference voltage values Vrefw and Vrefd which set up by the above-mentioned process of "Adjustment of Gain etc (AGC)" and written in the nonvolatile memory 43, the image data outputted by the A/D conversion circuit 34 are highly accurate and stable, even after an occurrence of overtime change in light intensity.

The shading correction circuit 36 operates to add shading corrections to the image data based on the data in the shading data storage 40.

As a result, image data at each point of the image in the primary scanning direction x are outputted so as to have substantially the same value for the pixels of the same white level.

The image signals in the aforementioned R even-number-row pixels are shading-corrected by the image output correction unit 113 are synthesized by a line synthesis unit 45 with image signals in the R even-number-row pixels shading-corrected by the image output correction unit 114 into one-line data, and outputted to the scanner image processing unit 303.

In a similar manner, G and B image data each synthesized into one-line data are respectively outputted to the scanner image processing unit 303 by way of line synthesis units 46 and 47.

The shading correction steps in the flat bed document reading will be described herein below.

When a user places a document original on the contact glass 101 and closes ADF 120, and the platen plate switch 112 switches from open to close, the first carriage is displaced to the location for detecting the size of the document original, the reading unit 110 turns the lamp 102 on and starts a return drive of the first carriage to the home position HP.

The document size detection unit 48 of AFE 111 detects the size of the document original on contact glass 101 based on G image data which is outputted by the image output correction unit 115.

On detecting the first carriage the reading unit 110 updates sub-scanning position data to those (fixed value data) indicated by the reference point sensor 109.

The function of the reading unit 110 is as follows during the period of driving the first carriage in the sub-scanning direction (i.e., in the vertical scanning direction). Namely, in synchronous with drive pulses supplied to the stepping motor driving the first carriage, the reading unit 110 operates to make increments (or count up) the sub-scanning position data for the flat-bed reading in the sub-scanning direction (outward, or from left to right in FIG. 2), while to make decrements (or count down) the data in the returning scanning direction (from right to left in FIG. 2).

The reading unit 110 operates to register the first carriage at the home position by monitoring the position of the carriage, thereafter turns the lamp 102 off.

On operating the start key 17 by a user, the reading unit 110 turns on the lamp 102 and initiates the vertical direction (sub-scanning) drive for the flat bed document reading with the first carriage.

On moving to the region of the standard white board rwp in the vertical scanning direction, the shading data storage 40 (FIG. 6) initiates reading operations of image data of the standard white board rwp, computes an average for plural lines, obtains a multiplication coefficient necessary for making the average of the image data for each of the pixels on one line to be standard white level image data (for example, 255 or about 80% thereof), and stores the results into the FIFO memory in the data storage 40.

For the position of document reading in the vertical scanning direction between the leading edge, and the tailing edge, of the document, the data storage 40 reads the multiplication coefficient for each of the pixels sequentially from FIFO memory and transfers to the shading correction unit 36.

The shading correction unit 36 transfers both the image data of each pixel of each line obtained from the document reading and the multiplication coefficient for the same pixel simultaneously to the read-out address of ROM in the shading correction unit 36.

Since the image data after the shading correction, as the product of the image data transferred into the address and the multiplication coefficient, are stored in ROM, the image data, which are corrected from the image data transferred into the address, are outputted from the ROM and outputted to the line synthesis unit 45 of the next stage.

The shading correction steps in the sheet-through document reading will be described herein below.

When a user places a document original on the contact glass 101 and presses the start key 17, the reading unit 110 instructs to initiate to feed the document original forward from the document tray 121, turns the lamp 102 on, and initiates the vertical direction (sub-scanning) drive for the flat bed document reading with the first carriage.

On moving to the region of the standard white board rwp in the vertical scanning direction, the shading data storage 40 (FIG. 6) initiates reading operations of image data of the standard white board rwp, computes an average for plural lines, obtains a multiplication coefficient necessary for making the average of the image data for each of the pixels on one line to be standard white level image data (for example, 255 or about 80% thereof), and stores the results into the FIFO memory in the data storage 40.

After completing the storage, the reading unit 110 initiates a return drive of the first carriage to the home position HP, and registers the first carriage at the home position.

These steps are completed by the time when the leading edge of the document, which is fed forward from the document tray 121, reaches the glass plate 132 as sheet-through reading window.

For the document reading period from the entrance of the leading edge into the reading view of the first carriage to the exit of the tailing edge, the data storage 40 reads the multiplication coefficient for each of the pixels sequentially from FIFO memory and transfers to the shading correction unit 36. The shading correction unit 36 outputs the shading-corrected image data to the line synthesis unit 45.

In the case when the tailing edge of the document exits the reading view of the first carriage and a further document is found on the document tray 121 at that time, the reading unit 110 starts feeding the document forward and reading the above-mentioned standard white board rwp.

Subsequent reading control steps are carried out in similar manner to those for the above-mentioned document reading of the first document.

Figure 7:
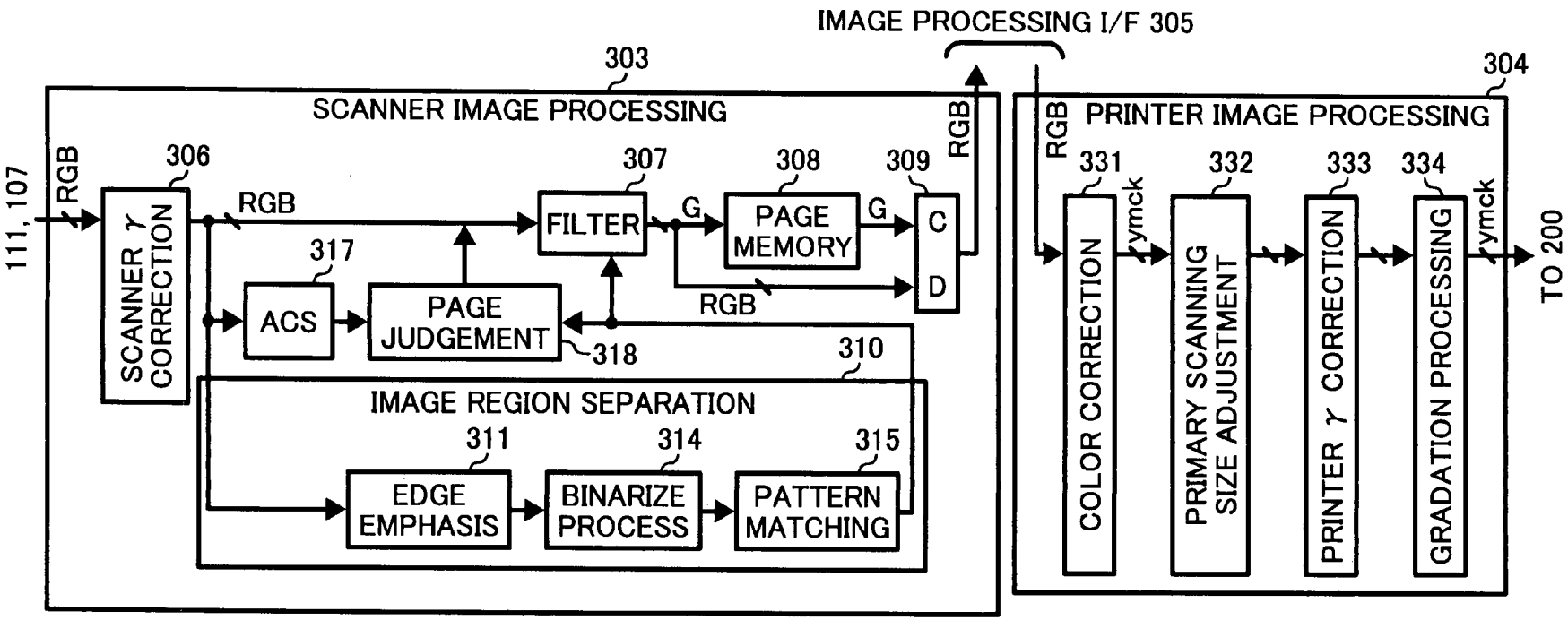
FIG. 7 is a diagrammatical block diagram illustrating the overall feature of image signal processing capability with respect to the scanner image processing unit 303 and printer image processing unit 304.

Referring now to FIG. 7, the overall feature of image signal processing capability will be described with respect to the scanner image processing unit 303 and printer image processing unit 304.

Several processing steps are performed on image data such as (1) the scanner gamma correction 306 onto the RGB image data outputted from AFE 111 of the color document scanner 100, (2) edge emphasis processing onto edge regions of the picture image based the result of image region detection by an image region separation unit 310, and (3) filter processing 307 for providing smoothing effects onto halftone regions showing a gradual change in image density.

In the case when "black (BK)" button (FIG. 8) is pressed (filled in the drawing) selecting the black-and-white reading or copying, only G image data, which are subjected to the edge emphasis processing or smoothing processing by the filter processing 307, are written into a page memory 308.

By contrast, when "full color" button is pressed, RGB image data, which are subjected to the edge emphasis processing or smoothing processing by the filter processing 307, are written into a page memory 406 (FIG. 5).

When "automatic color selection" button is pressed and when the "black (BK)", "full color", "automatic color selection", "blue (C)", "red (R)", and "yellow (Y)" buttons are all non-selected so as not to be able to specify the color of printing, the RGB image data processed by the filter processing 307 are stored in the memory 406 and the G image data are written into the page memory 308.

The data selector 309 is adapted to output, as readout image data, selectively either G image data of the page memory 308 or the RGB image data subjected to the filter processing 307.

Incidentally, the image data outputted to image processing I/F 305 from the page memory 308 of the scanner image processing 303 are thereafter treated as Bk image data readout in the black-and-white mode.

The image region separation unit 310 performs the edge emphasis processing 311 on the G image data after the scanner-gamma correction 306 for correcting reading distortion.

The edge emphasis processing 311 is carried out by marking consecutively each of pixels, to which respective pixel data on the G image data line correspond, and by converting the pixel with the summation of the products, which are obtained as each of image data in (3×3)-pixel matrix centering on the marked pixel, for example, multiplied by the edge emphasis coefficient for each pixel in the matrix. The summation of the products is now taken as the edge detection value for the marked pixel.

The edge detection value is the parameter for representing the definition of edge.

The edge detection value is converted by a binarization unit 314 into binary data (H for candidate for image edge, L for non-edge). Based on thus obtained value it is decided by a pattern matching unit 315 whether the marked pixel is on the edge (edge pixel).

That is, it is decided that the marked pixel is in the region of binary such as of characters or line drawing, or the halftone region of photograph and others.

Therefore, if the distribution of the region centering on the marked pixel (3×3 pixel matrix) is found in agreement with a predetermined edge pattern, the pattern matching unit 315 decides that the currently marked pixel is one in the image edge region (character region).

The results obtained from the decision by the pattern matching unit 315 (image edge indicating character, or non-edge indicating photography possibly including character) are sent to the filter processing unit 307. The filter processing unit 307 then provides the edge emphasis processing on the region decided as "image edge" onto the scanner-gamma corrected image data, and the smoothing processing, which changes concentration smoothly, over the "non-edge" region.

ACS (auto color select) 317 is adapted to detect whether the image data acquired by document reading represent a black-and-white picture, or a color picture.

The black-and-white/color detection signal sent from ACS 317 and the image edge/non-edge detection signal showing the decision result sent from the image region separation unit 310 are both forwarded to the page judging unit 318.

The page judging unit 318 is adapted to integrate, during one-page document reading, the number of pixels (the number of image data) detected as color based on the black-and-white/color detection signals, the other number of pixels detected as image edge based on the image edge/non-edge detection signals.

Subsequently, thus integrated numbers are compared with predetermined numbers. Namely, if the number detected as color is equal to, or larger than a first predetermined number, the document image is found as "color". By contrast, if the number is equal to, or smaller than the first predetermined number, the document image is found as "black-and-white".

In addition, if the number of pixels detected as image edge is equal to, or larger than a second predetermined number, the document image is decided as binary image (simply called "character"), such as a character or a line drawing. Moreover, the number is equal to, or smaller than the second predetermined number, the document image is found as non-edge image picture ("photograph").

The decision results by the page judging unit 318 are referred by CPU 301 on the completion of the one-page document reading.

The color correction unit 331 of the printer image processing unit 304 is adapted to change RGB image data into ymc (recording color) image data, and outputted to a primary scanning size adjustment (scaling) unit 332.

After providing at need the change in scaling, subjecting to the printer gamma correction 333 to fit to the imaging characteristics of the printer 200, and converting into image data for specifying concentration gradation by the gradation processing unit 334, the resulting data are outputted to the printer 200.

For the data sent only as G (Bk or black-and-white) images, the image data are sent not to the color correction unit 331 but to the primary scanning scaling unit 332. That is, the color correction processing is not provided in this case.

Figure 8:
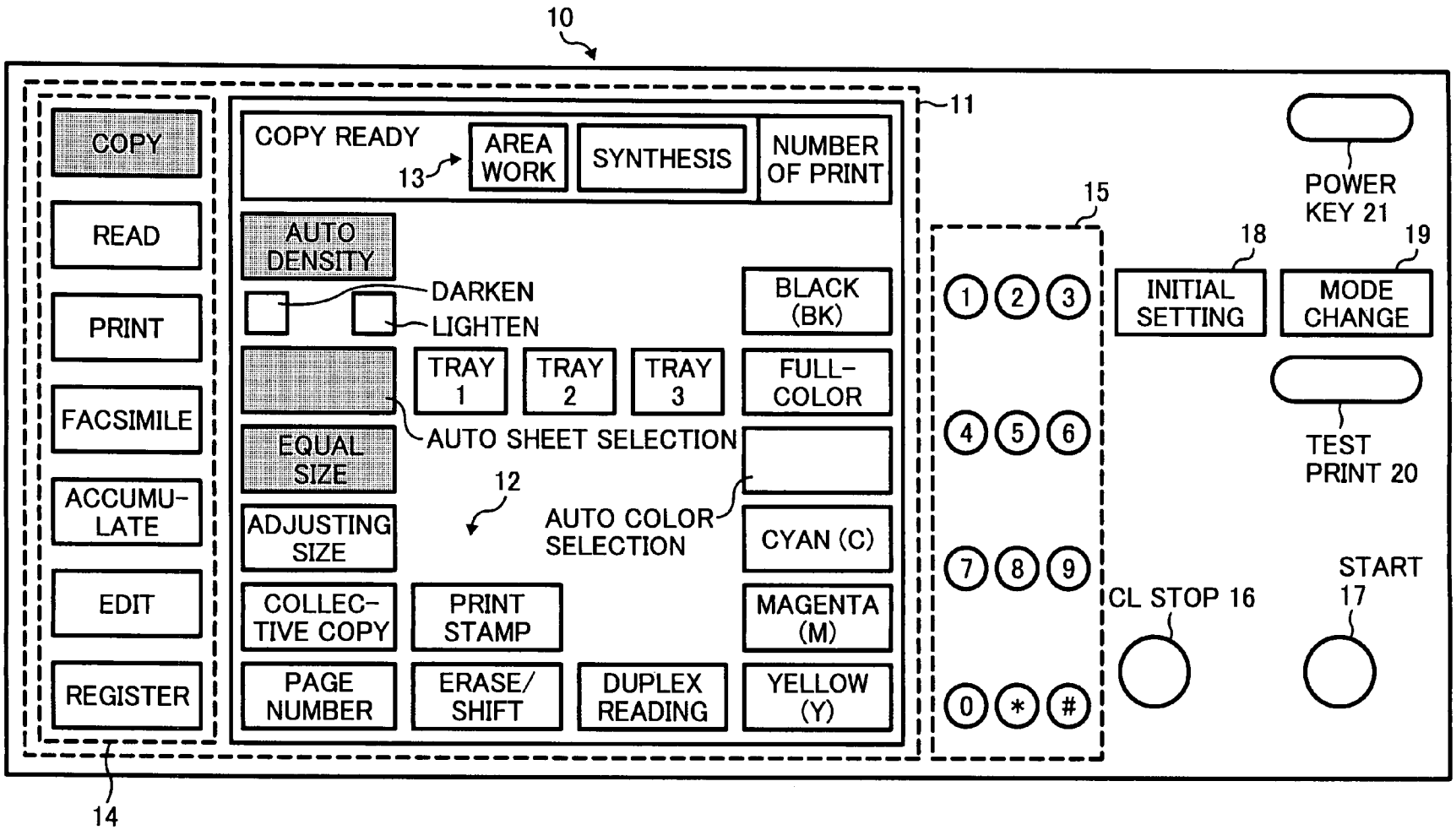
FIG. 8 is an expansion plane view illustrating the upper surface portion of the operation board 10 of the copying machine MF1 of FIG. 1, in which a certain corresponding input/output screen is displayed for the function specified through the function selection key 14.

As illustrated in FIG. 8, there provided on the operation board 10 are a liquid crystal touch panel 11, a numeric keypad 15, a clear/stop key 16, a start key 17, an initial-setting key 18, a mode change key 19, a test printing key 20, and a power source key 21.

Though omitted from the illustration, there provided to the left of the liquid crystal touch panel 11 is an alphabetic keyboard appending hiragana characters for inputting, setting, or making abbreviated registration, of URL, a mail, a file name, a folder name, etc.

The power source key 21 functions as an operation key for switching from the energy-saving mode (suspend or low-power mode) to the standby mode capable of image printing, or vice versa.

If the power source key 21 is pressed once when the energy-saving mode is already set, the mode is switched from the energy-saving to standby mode.

The test printing key 20 is adapted to print only one copy regardless the copy number preset and be able to assure the copy finish.

It is possible to arbitrarily customize the initial state of the copying apparatus by pressing the initial-setting key 18.

There included in the items, which can be set after pressing the reset key in the copy mode, are to set several adjustment values for the ink-jet printer 200, instruct cleaning or refreshing operation also for the ink-jet printer, specify a transition time (Td1) to the energy-saving mode (suspend mode), specify an update interval for implementing image output correction, and set the size of copy sheet loaded in the apparatus.

On pressing the initial-setting key 18 a selection button is displayed to be used for specifying initial values including several functions such as "initial value setting", "user registration", "copyright registration/setting", "track record output", etc.

The "initial value setting" function includes the setting of adjustment values, and the printer adjustment for instructing cleaning or refreshing operation for the ink-jet printer 200. Also included is the setting (alteration) of a transition time Td1 from the standby to the suspend mode and an update interval Td3 for updating conversion characteristics used for converting analog image signals into digital image data.

Various function keys, messages describing operating conditions of engine 300, controller board 400, etc. are shown on the liquid crystal touch panel 11. Namely, there displayed on a function selection key 14 of the touch panel 11 are several functions either for selection or currently operational such as "copy", "scanner", "print", "facsimile", "accumulation", "edit", "registration" and others.

For the function specified through the function selection key 14, a certain corresponding input/output screen is displayed. For example, when the "copy" function is specified, messages 12 and 13 are shown indicating the function key, the number of copies, and the conditions of image forming apparatus, as illustrated in FIG. 8.

When an operator touches a key displayed on the liquid crystal touch panel 11, the operation board 10 is adapted to read the key currently touched as an operator input and switch the color of the key to gray indicating of its "specified" state.

In addition, in order to specify more detailed function such as, for example, the kind of page printing, a pop-up screen is further displayed by touching the key.

Since the liquid crystal touch panel 11 is formed of a dot display apparatus, the panel is able to implement graphically an optimal, up-to-date display.

The function key 12 includes specification keys for color print such as "black (BK)", full color, "full color", "automatic color selection", "cyan (C)", "magenta (M)", and "yellow (Y)".

Figure 9:
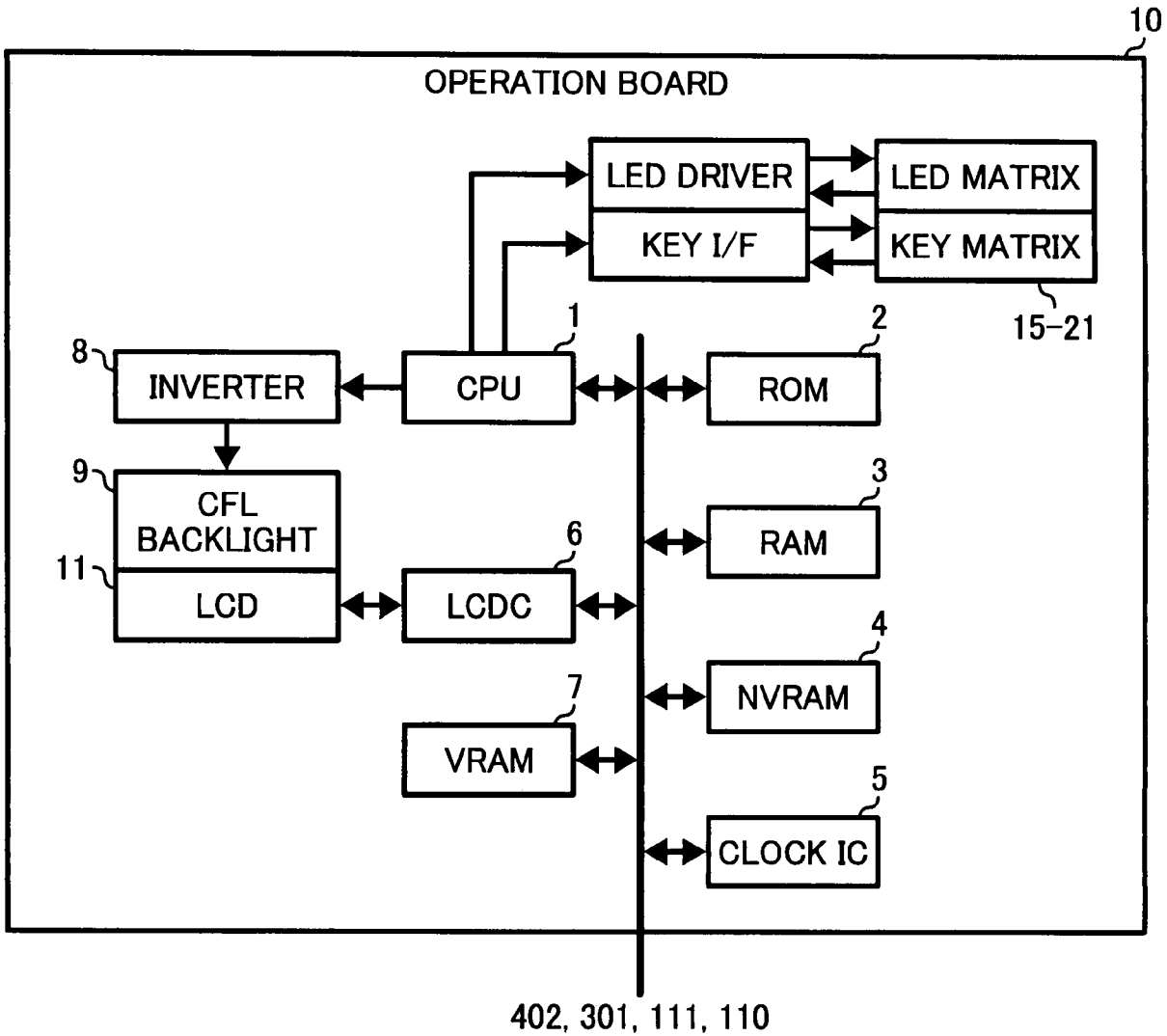
FIG. 9 is a diagrammatical block diagram illustrating the circuit of the operation board 10.

FIG. 9 is a schematic view diagrammatically illustrating the circuit of the operation board 10.

Referring to FIG. 9, the major portion of the electrical control system of the operation board 10 includes at least CPU 1 configured to communicate with CPU 402 of the controller board 400, read the inputs of the operation board 10, and control the display on the board 10; ROM 2 configured to store control programs for controlling the CPU 1; RAM 3 configured to momentarily store data during control; VRAM 7 configured to store drawing data of the liquid crystal touch panel 11; a liquid crystal display controller (LCDC) 6 connected to configured to VRAM 7, configured to implement drawing timing control, touch input detection, and other similar operations; and a clock IC 5 configured to generate time data.

There connected to LCDC 6 is the liquid crystal touch panel 11 provided with a CFL (cathode fluorescent lamp) light source as back lighting 9.

Further connected to the CPU 1 are an inverter 8 for driving the CFL back lighting 9, a key matrix including a group of operation keys 15 through 21, an LED (light emitting diode) matrix as LED display, an LED driver for driving the LED matrix, etc.

Moreover, a data bus, which is connected to CPU 1, is also connected to a non-volatile RAM (NVRAM) 4.

In response to operation by a user onto the operation board 10, the CPU 1 of the operation board 10 is configured to perform several operations for usual copying apparatuses such as reading through pressing a deposit key, generating input numerical data, reading operation through pressing the start key, transferring a start instruction to the controller board 400, and reading an input for changing the sheet size.

Figure 10:
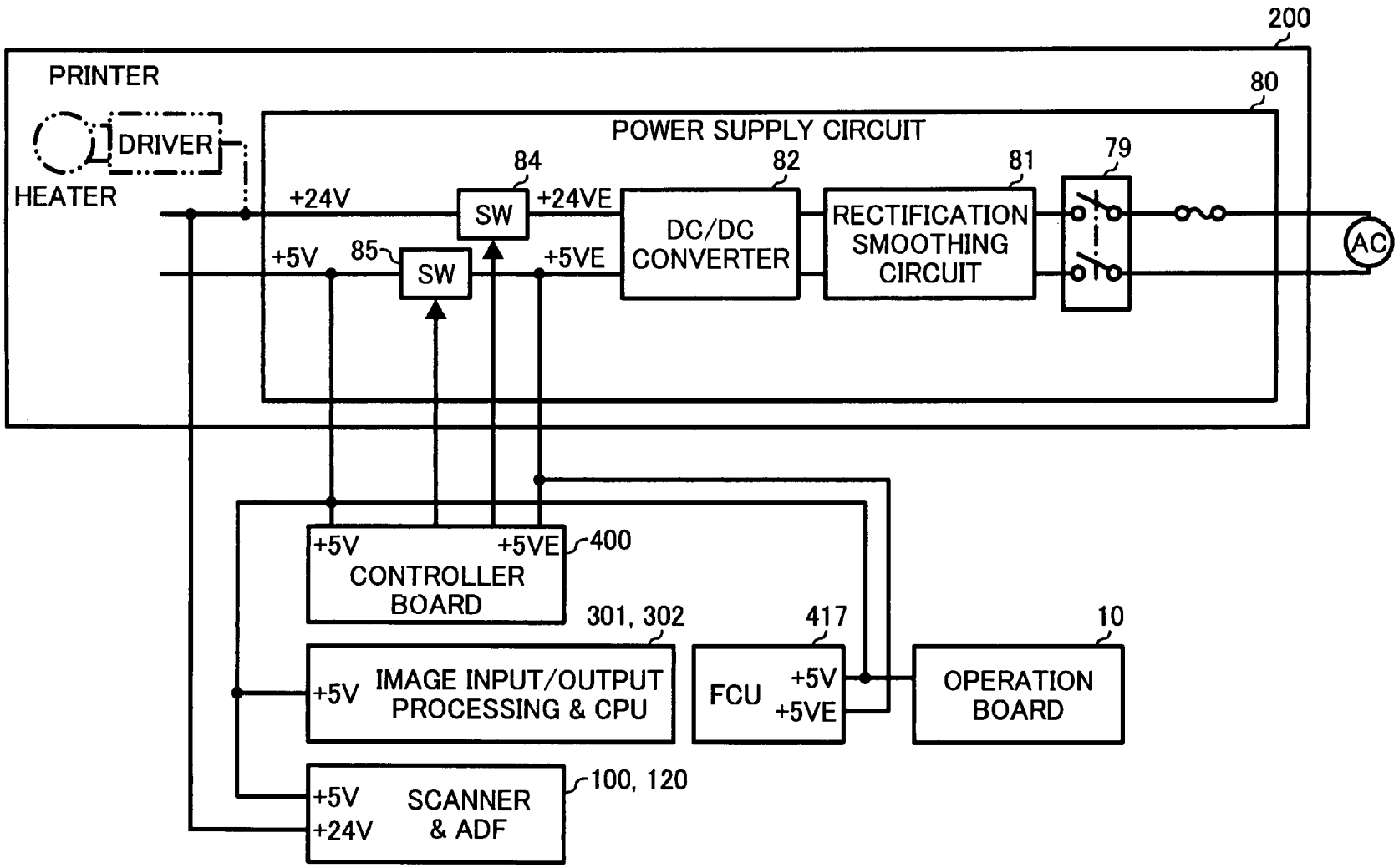
FIG. 10 is a schematic view diagrammatically illustrating the circuit of power system for supplying operational voltages to the portions of the copying apparatus MF1 of FIGS. 1 and 5.

FIG. 10 is a schematic view diagrammatically illustrating the circuit of power system for supplying operational voltages to the portions of the copying apparatus MF1 of FIGS. 1 and 5.

On closing a power switch 79 as the main power switch, the utility AC 100V is applied to a rectification smoothing circuit 81 of power supply circuit 80.

DC output from the rectification smoothing circuit 81 is applied to DC/DC converter 82. In the present embodiment, two lines of DC voltage, +24VE and +5VE, are generated, which are respectively stabilized from +24V and +5V.

There included no fixing unit in the inkjet printer 200, which requires such a high electric power as laser beam printer. Even in the case of providing a heater or fan for hastening the drying of ink ejected onto a recording sheet, high electric power is not required.

In the power supply circuit 80, the switches 84 and 85 are connected to converter outputs +24VE (from +24V) and +5VE (from +5V), respectively.

Control signals for performing ON/OFF control of switches 84 and 85 are provided to switches 84 and 85 from the controller board 400.

In either the copy start or "standby mode" (waiting mode, normal mode) which is capable of initiating copying operation in response to a copy start or print command substantially without time delay, the controller board 400 is adapted to provide the above-noted control signals to have both switches, 84 and 85, on.

In the "suspend mode", the controller board 400 is adapted to turn off the switch 84 for supplying +24V and the switch 85 for supplying +5V. That is, both of the switches 84 and 85 are turned off.

Although switches 84 and 85 are off in this suspend mode, a detection voltage +5VE is applied, by the state-change detection circuit ACD of the control board 400, to plural signal detection lines which lead respectively to the platen switch 112, the filler sensor 130, and the power supply key switch 21 of the pressure plate switch 112.

In addition, the voltage +5VE is applied continuously to the electric circuit for detecting the print command of a personal computer PC, and a facsimile reception detection circuit of the facsimile control unit (FCU).

TABLE 1 summarizes the relation between the abovementioned energy-saving changeover modes and ON/OFF of the power switches 84 and 85, while TABLE 2 illustrates information processing items executable in each of the modes.

It may be added that "TRANSMIT/RECEIVE" in TABLE 2 stands for the facsimile transmission/reception function without printout and "HOLD DATA" is for holding accumulated image data in the memory 406.

TABLE 1

| | | SWITCH SETTING | |
|---|---|---|---|
| | | SW 84 | SW 85 |
| MODE | STANDBY | ON | ON |
| | SUSPEND | OFF | OFF |

TABLE 2

| | | EXECUTABLE FUNCTION: ○ | | | | | |
|---|---|---|---|---|---|---|---|
| | | INPUT DETECTION | IMAGE READING | COPY | PRINT | TRANSMIT/ RECEIVE | HOLD DATA |
| MODE | STANDBY | ○ | ○ | ○ | ○ | ○ | ○ |
| | SUSPEND | ○ | | | | ○ | ○ |

FIG. 11 is a flowchart illustrating the operations of standby/suspend mode changeover control executed by the controller board 400 (CPU 402), and of standby/suspend mode changeover control of the ink-jet printer 200.

On applying an operational voltage by the utility AC 100V by the power supply circuit 80 by closing the power switch 79 between the power supply circuit 80 (FIG. 10) and the plug socket of the utility AC 100V, the CPU 402 of the controller board 400 performs an initialization processing (Step 1) in response to power ON, and sets up the standby mode (Step 2). That is, the switches 84 and 85 are turned on.

In addition, the CPU 402 instructs to set the data of the energy-saving mode register FM to "0" indicative of the standby mode, and get a timer Td1 started with a changeover waiting time Td1 from the standby to suppress mode as the limit target time.

Subsequently, the process of "head cleaning" CLG1 is carried out. The details of the CLG1 process will be described later in reference to FIG. 12.

For purposes of simplicity, in FIG. 11 and on, only the numeral will be shown representing the corresponding step number such as 1 for Step 1, for example.

On setting the standby mode, an operational voltage is applied to the portions of the copying apparatus MF1.

In response to the setting of the standby mode and the application of the operational voltage (2), the CPU 1 of the operation board 10 performs power ON initialization, readouts copy conditions in the standard processing mode stored in the NVRAM 4, and thereafter displays the conditions on the liquid crystal touch panel 11.

In the step of input reading (3), the CPU 1 of the operation board 10 reads the operation of a user onto the operation board 10, and reports to CPU 402 of the controller board 400. Thereafter, CPU 402 of the controller board 400 decodes commands from personal computer PC and FCU.

In response to operation by a user onto the operation board 10, the CPU 1 of the operation board 10 performs several operations for usual copying apparatuses such as reading through pressing a deposit key, generating input numerical data, reading operation through pressing the start key, transferring a start instruction to the controller board 400, and reading an input for changing the sheet size.

The changeover waiting time Td1 from the standby to suppress mode can be inputted through the operation board 10 and the inputted value is stored (registered) in NVRAM 4 shown in FIG. 9.

If CPU 1 reads, in "input reading" (3), the operation by the operator onto the initial-setting key 18 among the group of operation keys 15 through 21 (7*a*), a setting menu screen is displayed on the liquid crystal touch panel 11, and "initial setting" ING is performed.

When the operator specifies the column of user registration on the setting menu screen, the CPU 1 instructs to display an input screen on the liquid crystal touch panel 11 to urge to input an administrator's name and ID.

Figure 13:
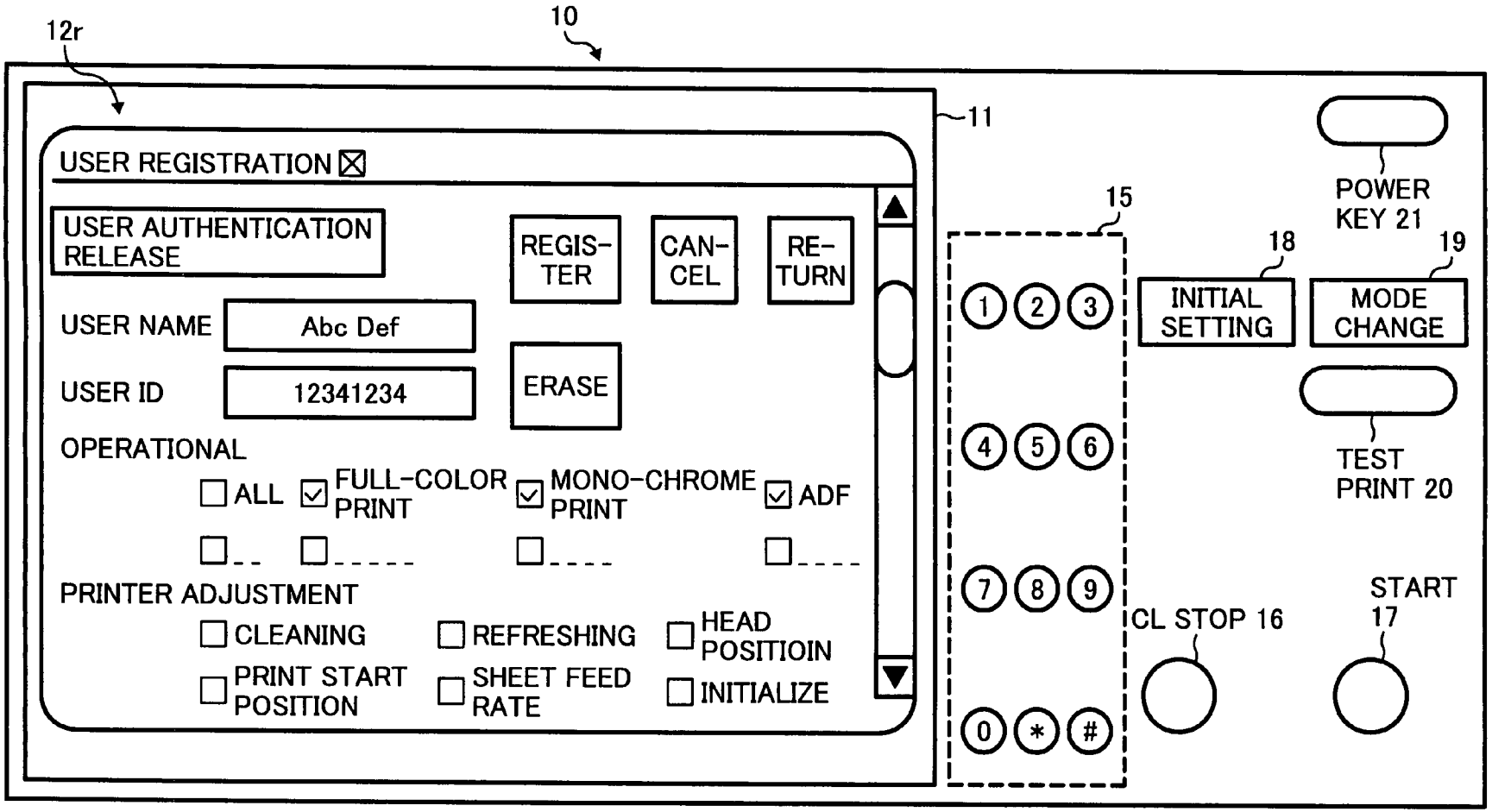
FIG. 13 is another expansion plane view illustrating the upper surface portion of the operation board 10 during user registration process steps.

If the operator inputs proper the name and ID, a user registration screen shown in FIG. 13 is displayed on the display surface of the liquid crystal touch panel 11. That is, only an administrator is able to display the user registration screen of FIG. 13.

By first inputting the name and ID of the person (user) who has the permit of the use of copying machine MF1 onto user registration screen, and displaying check marks through touching functional items for accepted use and printer adjustment items to be accessed, and by subsequently touching the "registration" key, CPU 1 is configured only then to write the currently displayed user information into user registration table of NVRAM 4.

If the user name and ID are inputted and the "erase" key is touched during the registration, correspondence user information is eliminated from the user registration table in the NVRAM 4.

Incidentally, since there is an operation board for inputting facsimile transmission and reception information on the left of the operation board 10 (FIG. 10) including an alphabetical input key, a name and ID can be inputted in alphabet.

In addition, when the operator specified the column of user registration on the setting menu screen, the CPU 1 instructed to display the input screen on the liquid crystal touch panel 11 to urge to input an administrator's name and ID, the operator input proper the name and ID, and CPU 1 instructed to display the user registration screen on the liquid crystal touch panel 11, a "user authentication release" key is displayed. Further in addition, in response to touching the key by the operator, the CPU 1 instructs to display a "general-purpose operational registration" screen is displayed on the display surface of the liquid crystal touch panel Although the "general-purpose operational registration" screen is similar to 12*r* shown in FIG. 13, there are no input column for user name and ID. Instead, there are an all prohibit key, an all permit key, and the column for alternative specification which includes the permitted function items shown in 12*r* of FIG. 13 and printer adjustment items.

When the operator made inputs and touched the "registration" key, CPU 1 instructs to write inputted information into the user registration table of NVRAM 4 not addressing to a user but as the general-use, and to set "user authentication release" information on top of the user registration table.

In the case when the release information is in and the user registration screen is displayed, the "user authentication release" key is shown in the color of gray indicative of its specified state. Moreover, if the operator further touches the "user authentication release" key, the gray color of the key turns to have a white background and the "user authentication release" information on the top of the user registration table is erased.

In the stage where a user authentication has to be made, it is first searched whether the "user authentication release" information is found in the user registration table. If so found, user authentication is not performed and process proceeds directly to that following the user authentication.

Figures 14, 14A:
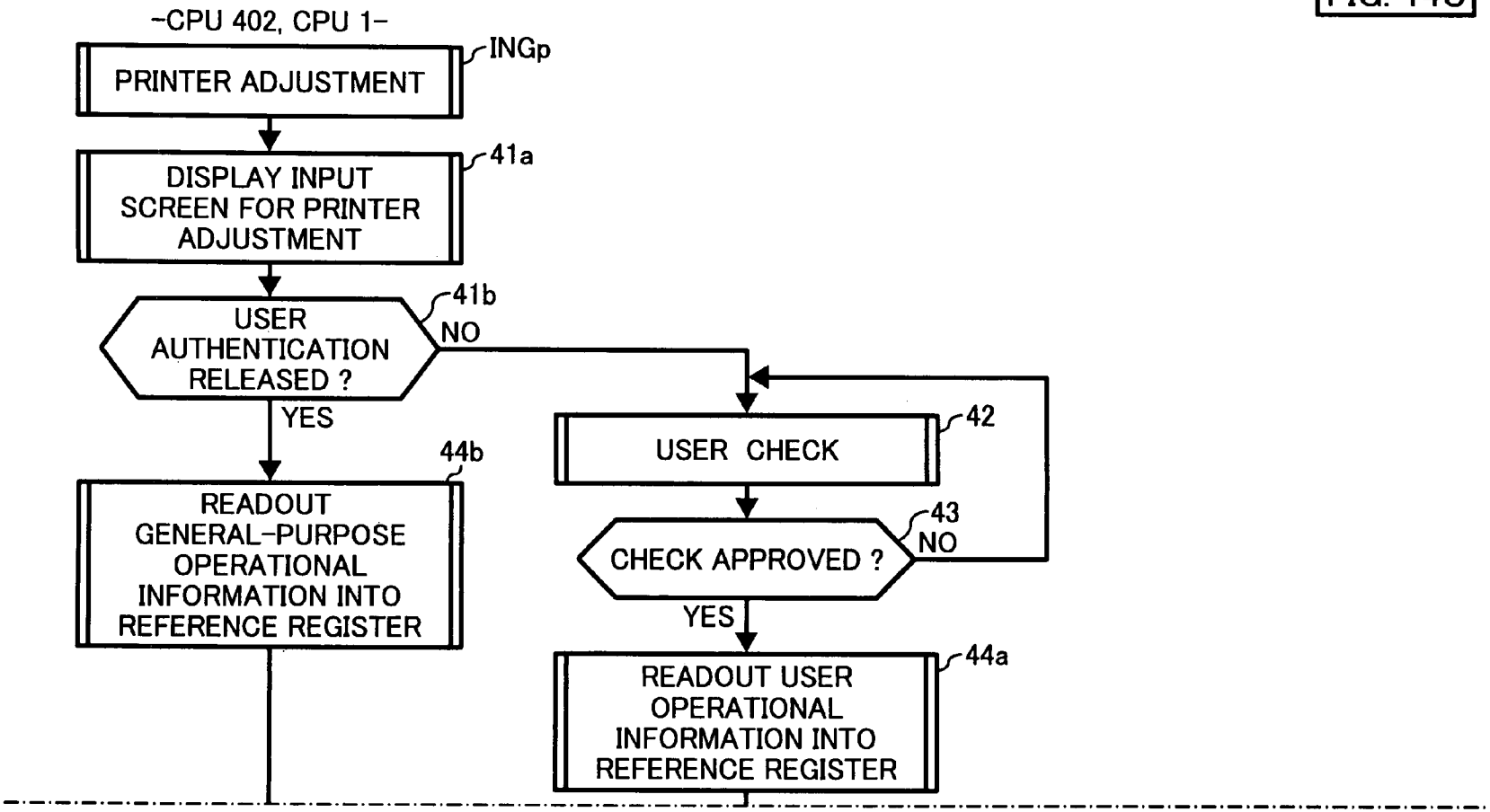
FIG. 14 is a flow diagram illustrating the overall flow for "printer adjustment" INGp in the "initial setting" ING of FIG. 11.
Figure 14B:
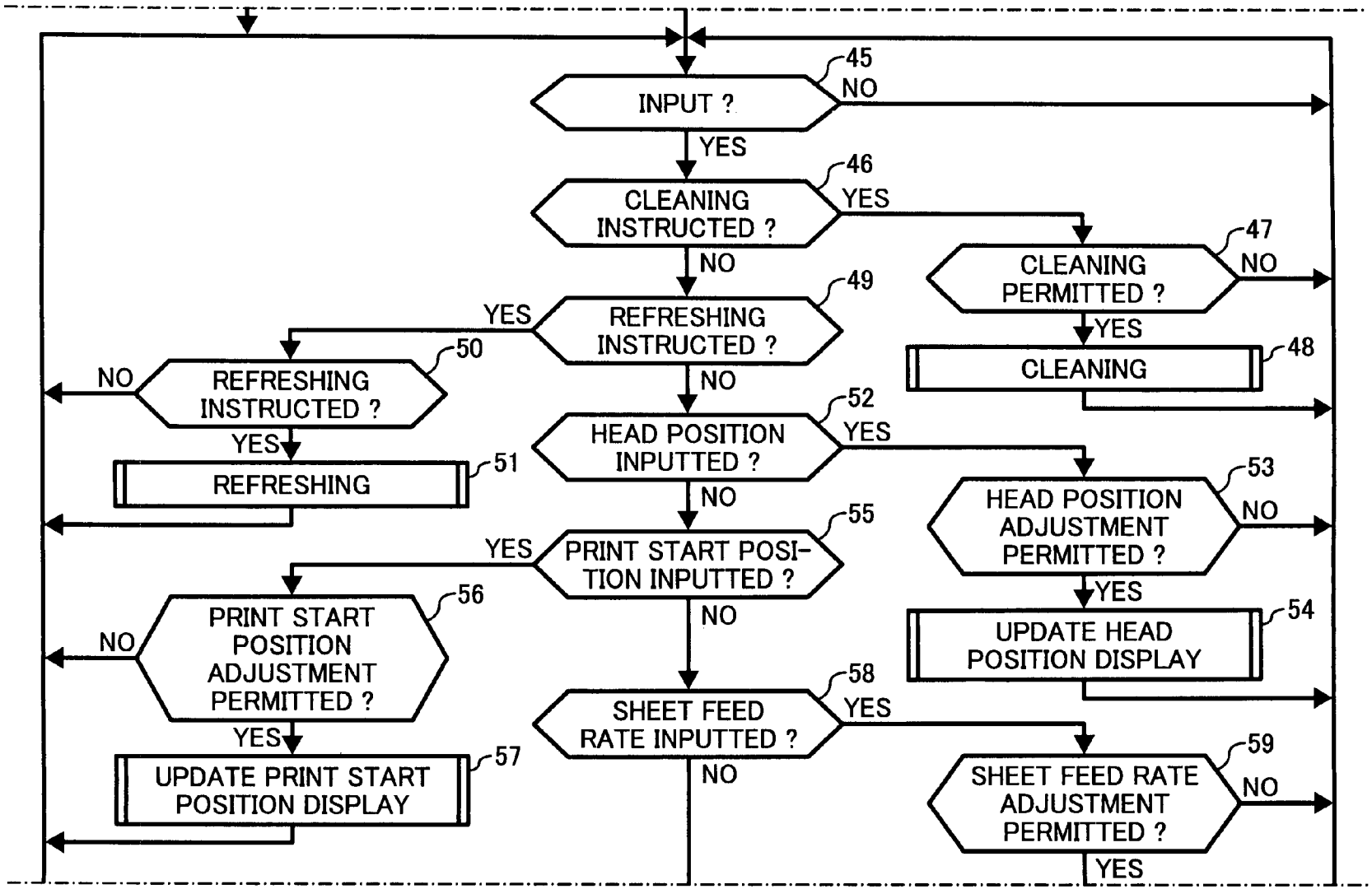
Figure 14C:
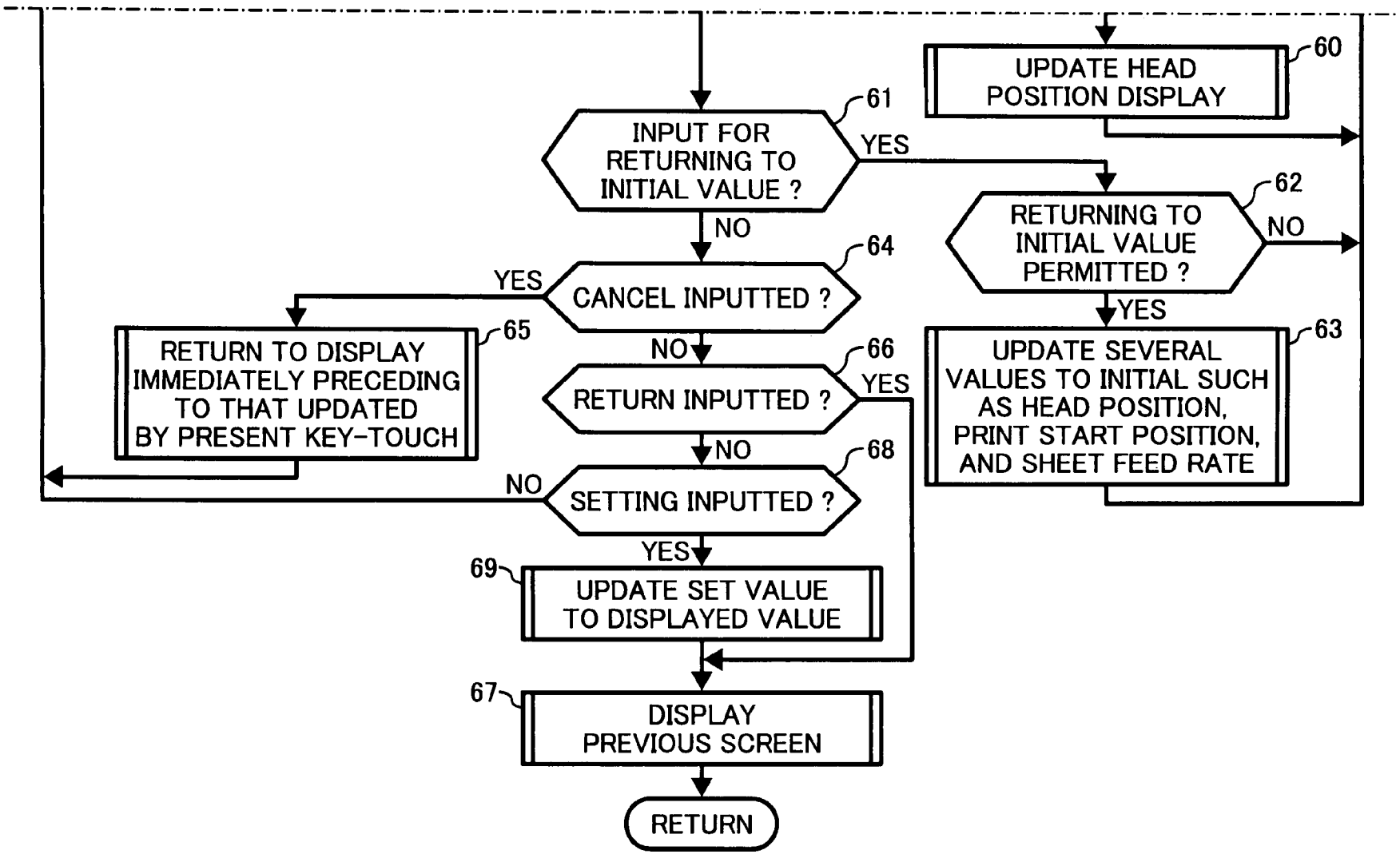
Figure 18A:
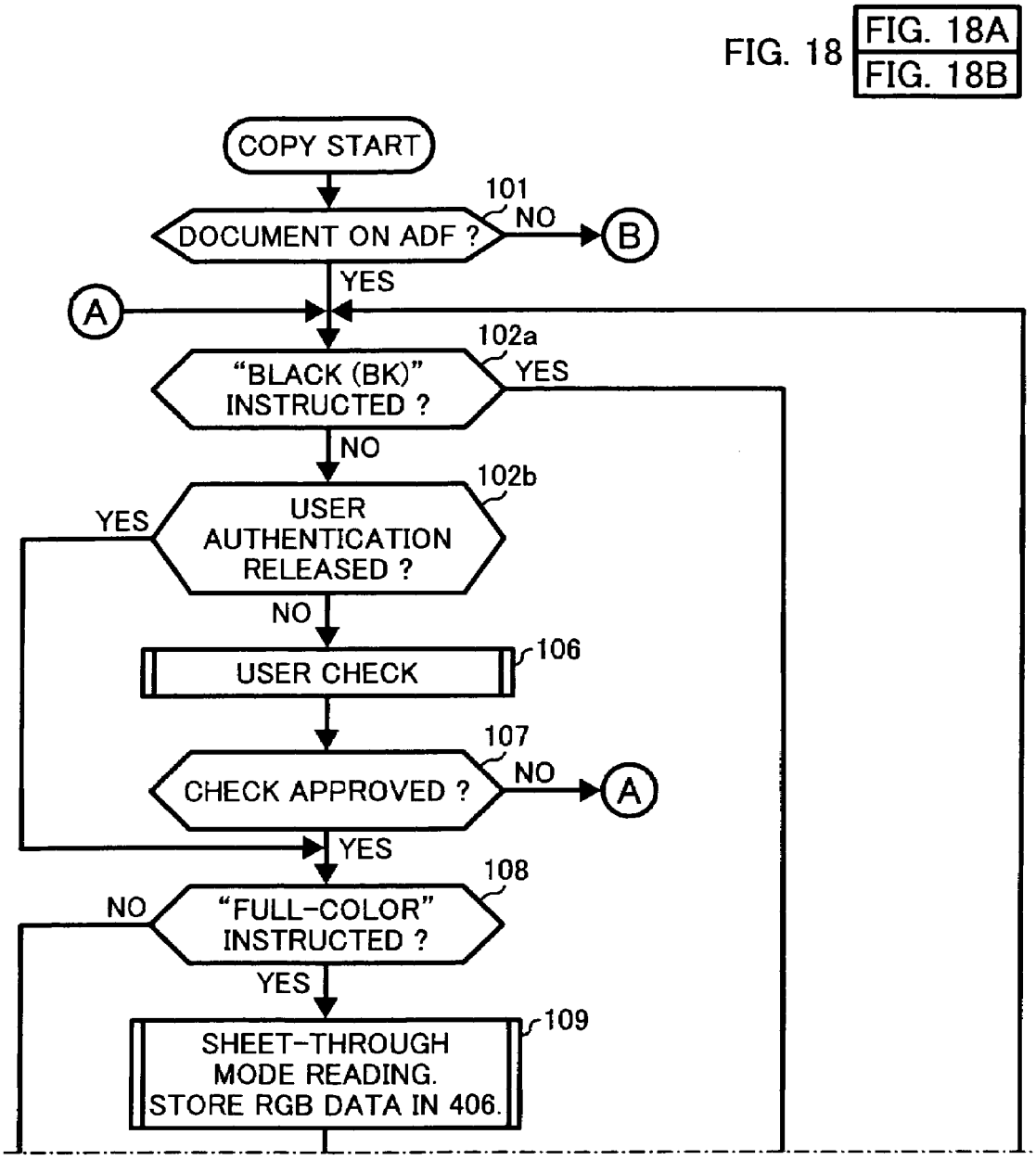
FIGS. 18 and 19 are flow charts illustrating the overall feature of the copy control performed responding to copy commands from CPU 301 of the engine 300.
Figure 18B:
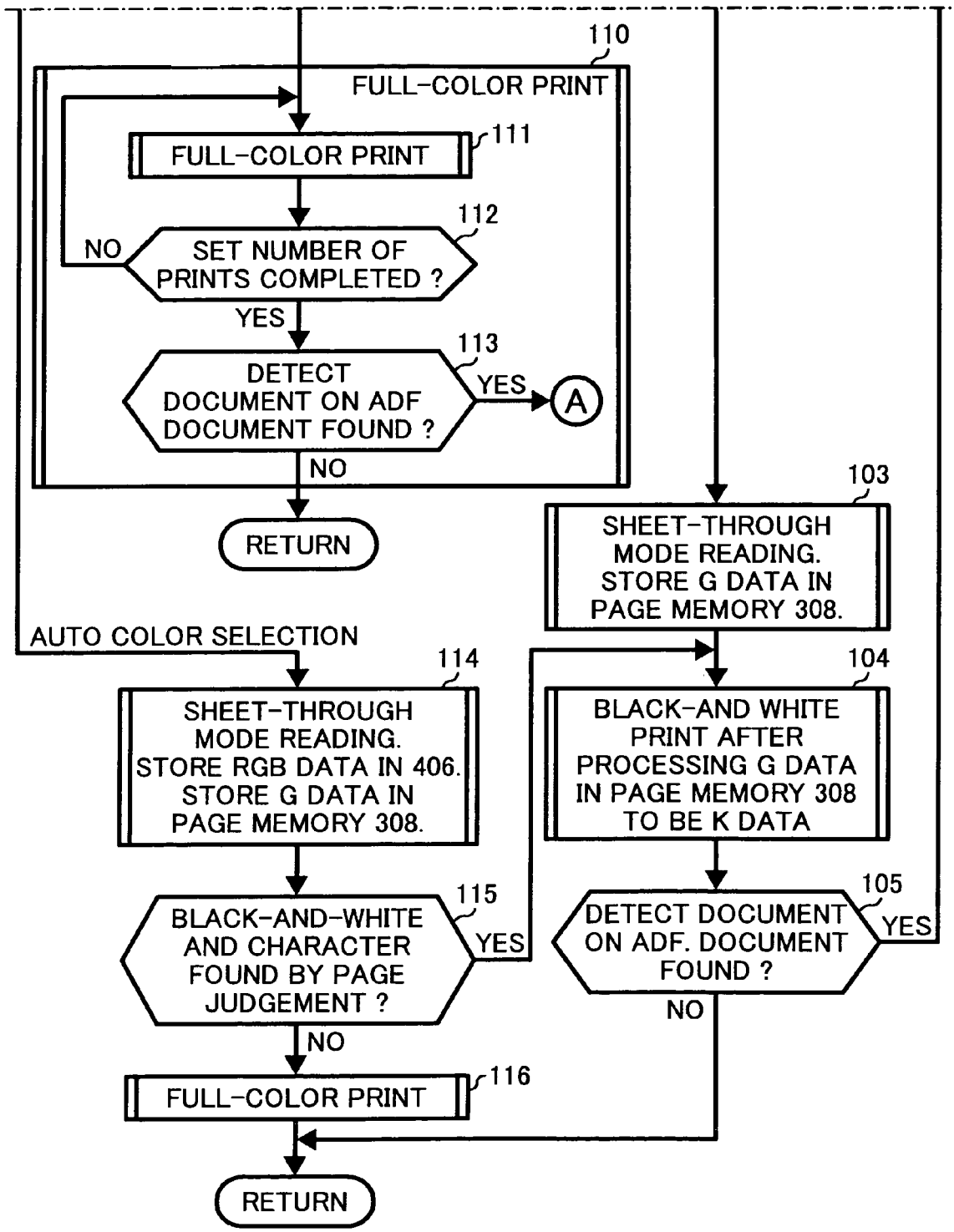
Figures 19, 19A, 19B:
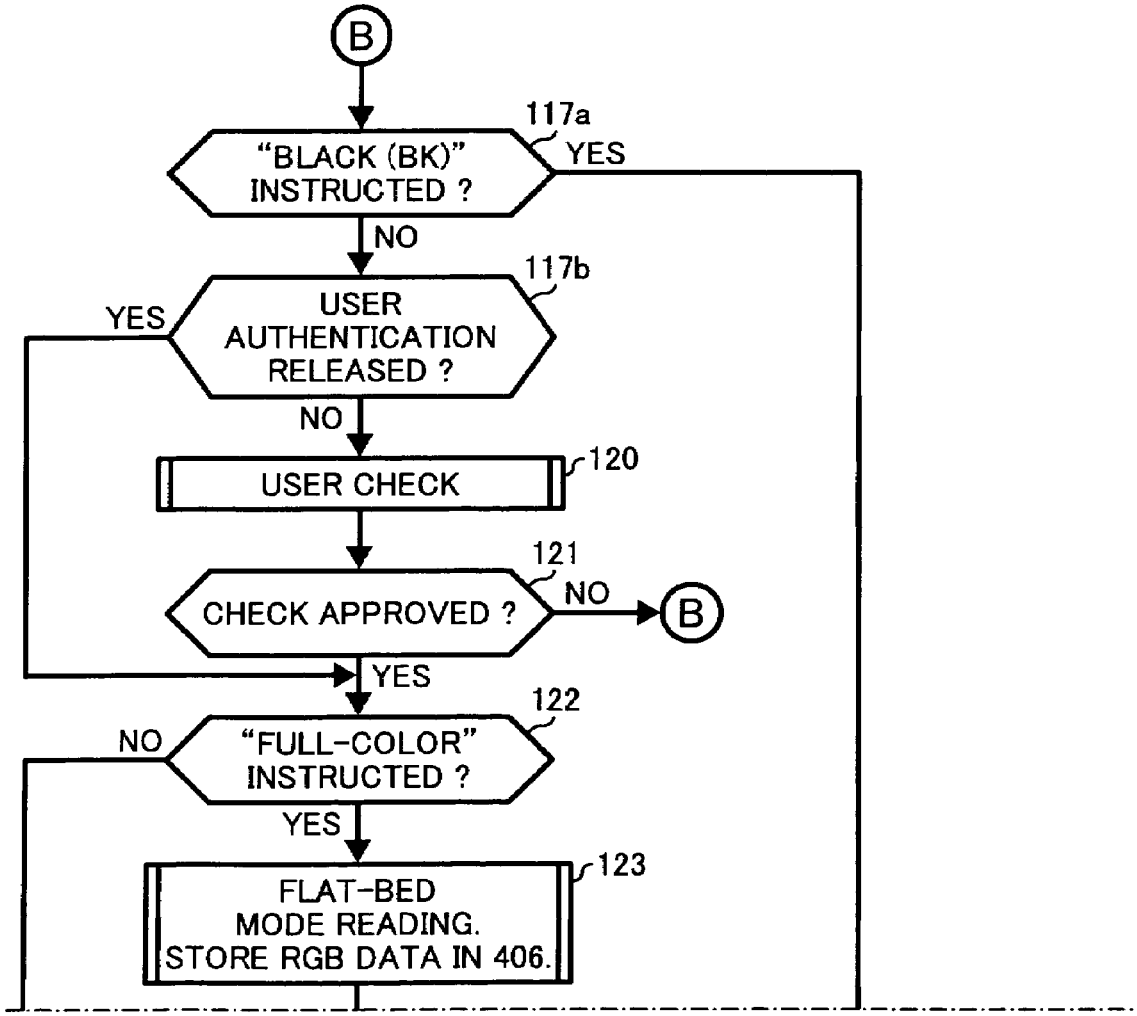
Figure 19B:
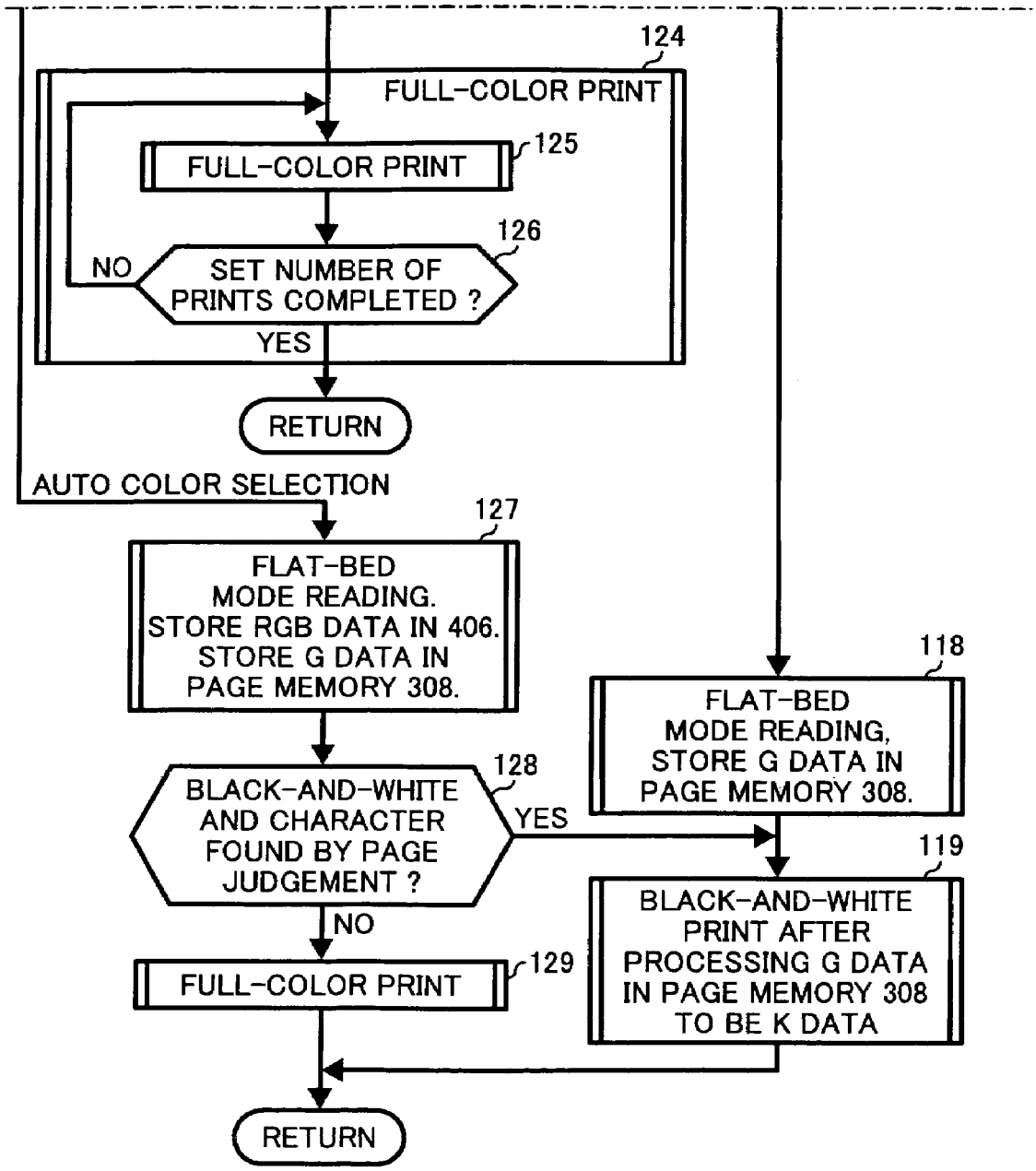

By contrast, if the "user authentication release" information is not found, user authentication is performed (41*b* of FIG. 14, 102*b* of FIG. 18, and 117*b* of FIG. 19).

Figure 15:
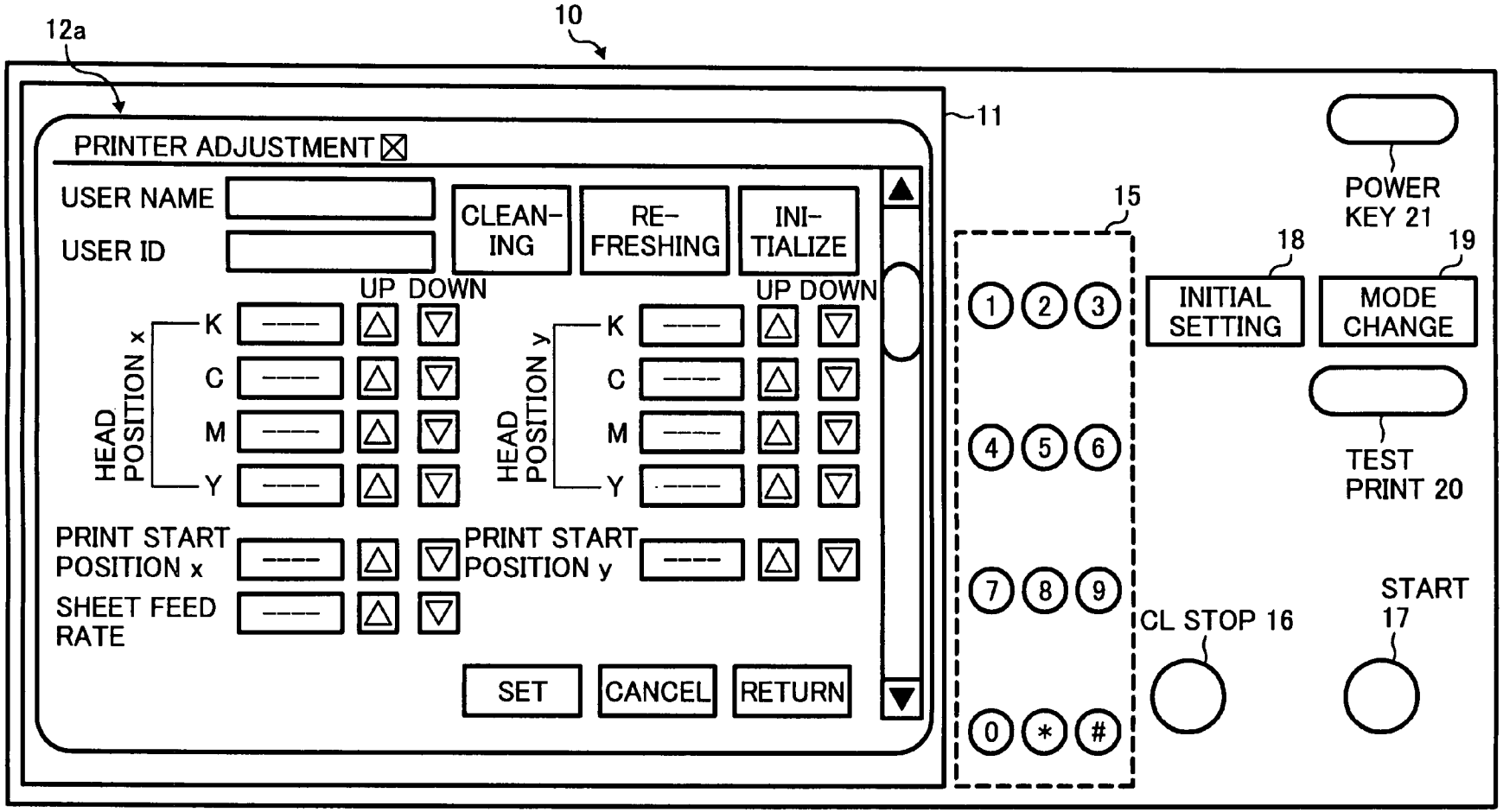
FIG. 15 is still another expansion plane view illustrating the upper surface portion of the operation board 10 during "printer adjustment" INGp.

When the operator specifies the column of printer adjustment on the setting menu screen, the CPU 1 instructs to display the input screen for the printer adjustment of FIG. 15 on the display surface of the liquid crystal touch panel 11, and the CPU 402 performs "printer adjustment" INGp shown in FIG. 14. The contents thereof are detailed later on.

When the column of the time setup is specified, the CPU 1 instructs to display an input screen on the liquid crystal touch panel 11 to urge to input an administrator's name and ID.

If the operator inputs proper the name and ID, a setting screen is displayed on the display surface of the liquid crystal touch panel 11, for setting several items such as energy-saving changeover waiting time Td1, the time interval Td3 for implementing "adjustment of gain AGC", and reference times Tr1 and Tr2, respectively, for deciding the necessity for implementing cleaning and refreshing of the printer 200.

Therefore, the waiting time Td1*a*, the implementing time interval Td3, and reference times Tr1 and Tr2 can be adjusted through the screen.

In the step of "input reading" (3) of FIG. 11, if a printing instruction is received from a personal computer PC or FCU 417 reports a facsimile reception (5), the CPU 402 instructs to switch the power supply circuit 80 in the suspend mode to standby mode (6) and perform "head cleaning" CLG 2.

The contents thereof are the same as those of "head cleaning" CLG 1 which will be described later on. Subsequently, the latch of the state detection circuit ACD is set (6*a*). As a result, the power supply injection mode signal POD is set to "1".

Also in the step of "input reading" (3) of FIG. 11, if an instruction input is received such as, for example, user operations through setting the operation board 10 including touching the image processing mode specification key 14, pressing the deposit key, pressing the start key, changing the size of copy sheet, generating input numerical data and so on, the CPU 402 in the controller board 400 instructs to proceed to the processing corresponding to the direction input (5-7*a*-7*b*-8).

In the step of "input reading" (3) of FIG. 11, if the power supply key 21 turns on when the standby mode has been set already, both CPU 1 of the operation board 10 and CPU 402 of the controller board 400 take the abovementioned turning on of the key 21 as a changeover direction to the suspend mode issued by the user (7*b*, 9), the CPUs instruct for the CPU of the reading unit 110 to instruct a driving operation to the document size reading position (10).

Only after receiving the response from the CPU of the reading unit 110 (11) regarding the completion of the driving operation to the document size reading position, the image-processing mode, which is currently displayed on the liquid crystal touch panel 11, is written into NVRAM 4 as the preceding mode, "preservation measures" PRS are performed, and process proceeds to the suspend mode (12). The "preservation measures" PRS will be detailed later on in reference to FIG. 17.

After the proceeding to the suspend mode, CPU 402 waits for the generation of a change detection signal by the change-of-state detection circuit ACD (13). On the generation of the change detection signal, the power supply circuit 80 is set as the standby mode (6).

In addition, if a printing command is received from PC while waiting for the generation of the change detection signal, the power supply circuit 80 is set to be the standby mode (6).

If the power supply key 21 is turned on when the suspend mode has been set already, the CPU 402 takes the abovementioned turning on of the key 21 as a changeover direction to the standby mode issued by the user, the CPU instructs to set the standby mode, readout the preceding image processing mode previously written into NVRAM 4, and display on the liquid crystal touch panel 11 (7*b*-9-6).

If the power of the document scanner 100 and ADF 120 is turned on, the CPU of the reading unit 110 in the document scanner 100 instructs to perform the power ON initialization.

The reading unit 110 refers to the power supply injection mode signal POD of the change-of-state detection circuit ACD.

If the power supply injection mode signal POD is "0" indicating that the application of operation voltage to document scanner 100 is caused by the switchover from off to on by the main power switch 79, CPU of the reading unit 110 performs "homing".

In this "homing" the first carriage carrying the lamp 102 and the first mirror 103 is driven in the return direction (to the left in FIG. 2), reference position data indicative of the point A (FIG. 2) are set, on detecting the first carriage by the reference point sensor 109, in the sub-scanning position register assigned as the internal memory of CPU of the reading unit 110.

The data "1" indicative of completed homing is written in a homing register. Namely, the information showing the completed homing is now set.

Subsequently, the return drive is further carried out, the pulses of the stepping motor for driving the carriage during the driving are counted down from reference point data, and the position data in the sub-scanning position register are updated to those corresponding to the current position.

When the position data in the sub-scanning position register reach the data indicating the home position HP as the reference point for the sub-scanning drive in the flat bed document reading mode, the drive of the first carriage ceases.

Incidentally, when the reference point sensor 109 does not detect the first carriage after starting the return drive, and the limit switch (not shown) provided on the left of the home position HP is turned to off from on by the first carriage, CPU of the reading unit 110 halts the driving of the stepping motor for the carriage, subsequently starts another reading drive (to the right) in the sub-scanning direction. When the reference point sensor 109 detects the first carriage, the reference point data indicating A (FIG. 2) is set into the sub-scanning position register.

Moreover, the driving is proceeded further to the right, the pulses of the stepping motor for driving the carriage during the driving are counted up from reference point data, and the position data in the sub-scanning position register are updated to those corresponding to the current position.

When the position data in the sub-scanning position register reach the data indicating the document size detection position, A+B+C, the drive of the first carriage in the sub-scanning reading direction is ceased.

In addition, the first carriage is return-driven to the left and the reference point sensor 109 detects the first carriage, the homing register indicating A (FIG. 2) is written with the data "1" indicative of completed homing. That is, the information showing the completed homing is now set.

When return-driven further and the position data in the sub-scanning position register reach the data indicating the home position HP as the reference point for the sub-scanning drive in the flat bed document reading mode, the drive of the first carriage ceases.

If the above-mentioned "homing" is completed, CPU of the reading unit 110 performs "acquisition and setup of reading gain etc."

In the operation "acquisition and setup of a reading gain etc.", CPU 42 of AFE 111 instructs to read various above-mentioned preset values such as the adjustment gain registered into the setting data table, write into RAM 43*b*, and store (set) in the latch (register) of the D/A conversion circuit 37 for correcting image output.

That is, CPU 42 instruct to input the preset value Srefd registered for Vrefd into HDD 401 as nonvolatile memory to the D/A conversion circuit 37, and the D/A conversion output voltage Vrefd of Srefd is input to the A/D conversion circuit 34 as the upper reference voltage by way of the selector 38. Moreover, the preset values Svg and Srefb of Vg and Vrefb, respectively, are input to the D/A conversion circuit 37.

In the next place, CPU 42 performs "control of output correction." The contents thereof are similar to those mentioned earlier regarding the operation "adjustment of a gain etc. AGC." In addition, a renewal registration is performed into the setting data table of addressing of HDD 401 to AFE 111 regarding respective set values updated by the "adjustment AGC of a gain etc." together with the present time. Thereafter, the carriage is driven back to the home position HP.

When the initialization was performed in response to the +5V voltage application and the power-on mode signal POD indicative of power on "1" caused by switchover from the suspend mode to standby (return to energy-saving), CPU 42 of AFE 111 instructs to acquire the present time from the clock IC 5 of the operation board 10, read various set values such as the comparison data Td3, adjustment gain, etc. registered in the setting data table and the preceding time reading, write into RAM 43*b*, and store in the latch of the D/A conversion circuit 37 for correcting image output.

That is, CPU 42 instruct to input the preset value Srefd for Vrefd to the D/A conversion circuit 37, and the D/A conversion output voltage Vrefd of Srefd is input to the A/D conversion circuit 34 as the upper reference voltage by way of the selector 38. Moreover, the preset values Svg and Srefb of Vg and Vrefb, respectively, are input to the D/A conversion circuit 37.

In the next place, if the time elapsed from the preceding time to the present is found equal to, or more than Td3 after referencing the preceding performing time, the present time, and the reference data Td3, the aforementioned "homing", "acquisition and setup of reading gain etc.", "control of output correction", and "registration of updated reading gain etc. and operation time".

However, if the time elapsed from the preceding time to the present is found less than Td3 and a document is loaded on the ADF 120 with platen plate 137 closed, "homing" is performed and the carriage is positioned at the home position HP, since the possibility of subsequent sheet-through reading operation is high. The contents of "homing" are similar to those mentioned earlier.

In the case when the platen plate 137 is open and no document is loaded on the ADF 120, "homing" is not carried out since the carriage is moved to the document width detection position at the time of preceding switchover to the suspend mode and the possibility for the later closure of the platen (document size detection required) is high. That is, the carriage is not driven.

Subsequently, CPU of a unit 110 instructs to monitor the change of ON/OFF signal of the template switch 112, in that, on detecting the change in the angle of platen opening (lifting up) exceeding the preset value of approximately 30 degree, the data of the template open/close register FP are updated to be 1 indicative of the template opened from 0 indicative of closed, and the first carriage is driven to the document width detection position when the carriage is not found at the detection position.

When the platen is closed changing the opening angle to be smaller than about 30 degree, the data are updated to be 0 indicative of the template closed from 1 indicative of opened, and the first carriage is driven to the document width detection position when the carriage is not found at the detection position, and the operation of "document size detection" is performed.

In the operation of "document size detection", the lamp 102 is lighted on, the carriage drive (return drive to the left in FIG. 2) to the home position HP is initiated, and the steps of document size detection are instructed to the document size detection unit 48 by CPU 42 of AFE 111.

The document size detection unit 48 then detects the size of the document on contact glass 101 based on the image signal readout with CCD 107, outputs a document size code to CPU 42, and reports the document size code to CPU 301,402 from CPU 42 and the operation board 10.

The CPU of the reading unit 110 subsequently instructs "homing" be performed. The contents thereof are similar to those above-mentioned.

For example, when a user places a document original on the contact glass 101 and tilts down ADF 120 onto the contact glass 101, the size of the document original is detected the first carriage is driven to the home position HP as a starting point of a sub-scanning drive for document reading.

Thereafter, if a user issues a direction of copy start, the flat-bed document reading is performed.

Over the period of no open/close change of the platen 137, the CPU of the reading unit 110 waits for an instruction of driving to the document width reading position or another instruction of document reading start, issued by CPU 402.

As described earlier, on shifting to the suspend mode, CPU 402 issues a driving direction toward the document width reading position to the reading unit 110 (10 of FIG. 11).

In response to the direction, the reading unit 110 instructs the first carriage to be driven to the document width reading position when the carriage is not found there, and, on completing the drive to the width reading position, reports the completion to the CPU 402. The reading unit 110 then waits for a switchover to the suspend mode (working voltage off to scanner).

On receiving the reply on the completion of the drive to the width reading position, CPU 402 instructs to switch the power supply circuit 80 to the suspend mode (11 and 12 in FIG. 11).

When CPU 301 instructs the start of document reading to the reading unit 110, CPU of the reading unit 110 instructs to perform "document size detection" on referencing information in the homing register and detecting the information being "0" indicative of incomplete homing.

The contents of the "document size detection" are similar to those in the aforementioned operation "document size detection." By performing "homing" the information in the homing register is altered to "1" indicating the homing completed.

After completing the "homing" and detecting a document on the ADF 120 referencing a detection signal in the filler sensor 130, CPU of the reading unit 110 instructs to perform "sheet through document reading". By contrast, "flat bed document reading" is performed, when no document is detected on the ADF 120.

Figure 12:
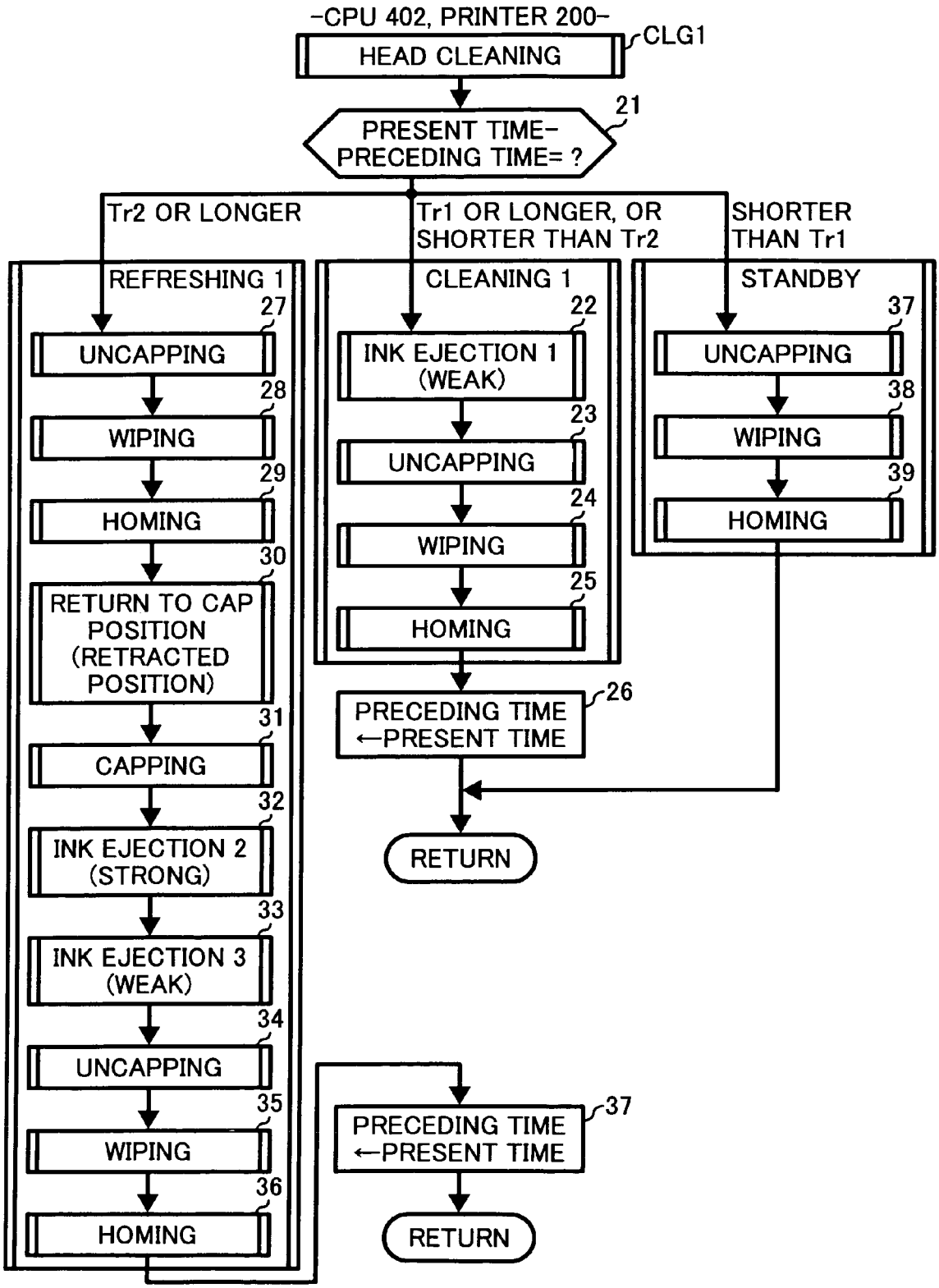
FIG. 12 is another flowchart illustrating the contents of "head cleaning" CLG1 of FIG. 11.

The contents of "head cleaning" CLG1 of FIG. 11 are described in reference to FIG. 12.

When the process proceeds to "head cleaning", CPU 402 instructs to compute a lapse of time, referencing the present time data (the present time) of clock IC and the time data of the last time registered in NVRAM 4, as the difference between the last time and present, or the time elapsed from the last "head cleaning", and then instructs the printer 200 be standby when the lapse of time is found less than a first, relatively short, reference time Tr1.

In response to the instruction the printer 200 carries out several steps such as driving the cap 205 (FIG. 4) downward to a retracted position ("uncapping" 37); starting a forward driving (from left to right in FIG. 4) of the carriage 202; rotationally driving counterclockwise (in FIG. 4) the blade rotor of electric wiping mechanism 206 to wipe the bottom (the side of ink ejection of recording head) of the carriage 202 ("wiping" 38); when a carriage sensor (not shown), which is provided on the way of the carriage 202 from the retracted position to the home position, detects the carriage, overwriting the present data regarding the location of the detection into x positional register located in a memory area in RAM of the printer 200; incrementing by one the positional data in the x positional register for every carriage drive over a predetermined infinitesimal distance of the forward driving of the carriage 202 (or decrementing by one for every drive over a predetermined infinitesimal distance of the reverse, return driving); and ceasing the forward driving of the carriage 202 at the moment when the positional data comes to coincide with a fixed, preset data ("homing" 39). That is, the abovementioned are the standby process steps for the printer 200.

On receiving a report on the completion of standby for the printer 200, CPU 402 returns to the main routine. Namely, the process proceeds to Step 3 of FIG. 11.

When the abovementioned elapsed time (present time−last time) is equal to, or longer than the first reference time Tr1, and simultaneously, shorter than a second reference time Tr2 (Tr2>Tr1), CPU 402 instructs the printer 200 to perform "cleaning 1".

In response to the instruction, the printer 200 performs several steps such as (1) by energizing ink drive elements with such relative low energy as capable of blowing off ink, which has become relatively highly viscous with the lapse of time of about Tr2, pushing out the relatively high viscous ink from a ink ejection nozzle; (2) subsequently performing a continuous ejection of normal, low viscosity ink for such a period of about the first reference time Tr1 long enough for cleaning the inside of the ink ejection nozzle; and (3) stopping the ink ejection after the first reference time Tr1. ("Ink ejection 1 (weak)" 22).

Next, the printer 200 performs standby steps (23-25). The contents of the standby (23-25) are similar to those mentioned earlier (37-39).

On receiving a report on the completion of "cleaning 1" (completion of standby), CPU 402 updates the last data stored in NVRAM 4 to the current data (26), then returns to the main routine.

When the abovementioned lapse of time (present time−last time) is equal to, or longer than the second reference time Tr2, CPU 402 instructs the printer 200 to perform "refreshing 1".

In response to the instruction, the printer 200 performs several steps such as (1) performing "uncapping" (27), "wiping" (28), and "homing" (29); (2) wiping the bottom (the side of ink ejection of recording head) of the carriage 202 with the blades, and (3) stopping the carriage 202 at the home position.

It is intended by the "wiping" (28) to wipe off the ink or ink droplets, when the ink is either solidified or half-solidified on the circumference of ink ejection nozzles on the bottom of the carriage with disuse for relatively long period of time, In the operation of "return to cap position" (30), the carriage 202 is driven to the cap position (retracted position) from the home position. In the meantime, the wiping mechanism 206 is adapted to rotate the blade rotor clockwise in FIG. 4 to wipe the undersurface of the carriage 202, whereby cleaning effects are enhanced.

After retracting the carriage 202, the printer 200 is adapted to drive the cap 205 upward to a working location ("capping" 31), in which the seal material on the upper end opening edge of cap 205 is brought to close contact with the bottom face of the carriage.

Subsequently, the printer 200 operates to energize ink drive elements with such relative high energy as capable of blowing ink off gradually with time, in which the ink has become highly viscous or half-solidified with the lapse of time longer than Tr2, and continue to energize for a second setup time long enough for completing the blowing off the ink. ("Ink ejection 2 (strong)" 32).

After elapsing the second setup time, there continued further is to energize ink drive elements to continue the ejection of normal, low viscosity ink for a third setup time long enough to carry out (1) drawing the ink, which may be floating as minute droplets around the nozzles, as to combine to form larger droplets and fall, and (2) cleaning further the inside of the ink ejection nozzle. And, the ink ejection is ceased on elapsing the third setup time. "Ink ejection 3 (weak)" 33.

Subsequently, the printer 200 performs standby (34-36). The contents of the standby (34-36) are similar to those mentioned earlier (37-39).

On receiving a report on the completion of "refreshing 1" (completion of standby), CPU 402 updates the last data stored in NVRAM 4 to the current data (37), then returns to the main routine.

FIG. 14 is a flow diagram illustrating the overall flow for "printer adjustment" INGp in the "initial setting" ING of FIG. 11.

Referring to FIG. 14, when the operator specifies the column of the "printer adjustment" INGp displayed on a setting menu screen of "initial setting" ING, the CPU 1 instructs an input screen of printer adjustment shown in FIG. 15 on the display screen of the liquid crystal touch panel 11 (41*a*).

Although an input column for user's name and ID for user authentication are shown on the input screen, when "user authentication release" information is found in the user registration table of NVRAM 4, the CPU 1 instructs to readout the general-purpose operable information (allowable registered as for general-purpose in the user registration of FIG. 13) from the user registration table and write into either RAM 3 or allowable information register allocated in the inside RAM of CPU 1 (41*b*, 44*b*).

In the case when the "user authentication release" information is not found in the user registration table, an input into the user name and ID input column is made, and the # key in the ten key block 15 is pressed, the CPU 1 instructs to search whether the user name and ID are previously registered in the user registration table of NVRAM 4.

If it is found that they are previously registered, the CPU 1 instructs to readout the user information (allowable registered in the user registration of FIG. 13) from NVRAM 4, and store in either RAM 3 or allowable information register allocated in the inside RAM of CPU 1 (41*b*, 42, 43, 44*a*). Thereafter, CPU 1 reads the input on operating instruction.

If "cleaning" key on the input screen of printer adjustment has been touched by the user and "cleaning" is found in the permission information register, CPU 1 issues "cleaning" direction to CPU 402 (46-48). In response to the direction, CPU 402 performs "cleaning" CLGk shown in FIG. 16 (46-48).

If "cleaning" is not found in the permission information register, by contrast, it is indicated that the cleaning authority is not granted to the user as the present operator. As a result, the touching of "cleaning" key is not responded. Namely, the key touching is ignored.

The carriage 202 is located, in the present stage (initial setting ING), not in the cap position (retracted position) but at the home position as result of the preceding operation "head cleaning" CLG1 or "head cleaning" CLG2, and the cap is not worn at present.

Figure 16:
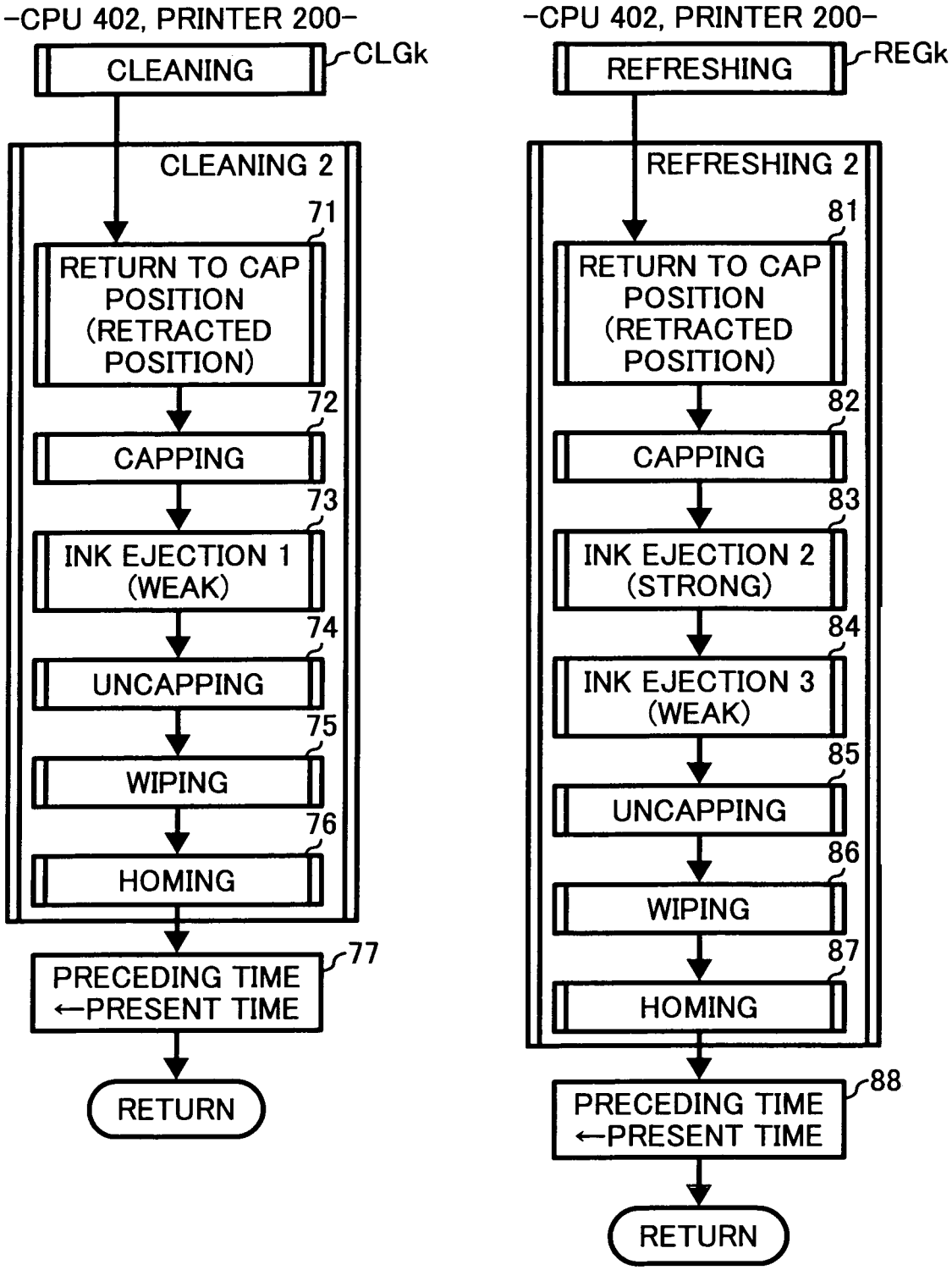
FIG. 16 includes flowcharts illustrating the contents of "cleaning" CLGk and "refreshing" REGk.

On receiving the "cleaning" direction, therefore, CPU 402 proceeds to "cleaning" CLGk shown in FIG. 16 and instructs the printer 200 to perform "cleaning 2".

In response to the instruction, the carriage 202 is driven to the cap position (retracted position) from the home position ("return to cap position" 71). In the meantime, the wiping mechanism 206 is adapted to rotate the blade rotor clockwise in FIG. 4 to wipe the undersurface of the carriage 202.

After retracting the carriage 202, the printer 200 is adapted to drive the cap 205 upward to the working location ("capping" 72), in which the seal material on the upper end opening edge of cap 205 is brought to close contact with the bottom face of the carriage.

Subsequently, the printer 200 performs "ink ejection 1. (weak)" 73. The contents of the "ink ejection 1 (weak)" 73 are similar to those mentioned earlier (22).

The printer 200 performs standby (74-76). The contents of the standby (74-76) are similar to those mentioned earlier (37-39).

On receiving a report on the completion of "cleaning 2" (completion of standby), CPU 1 and CPU 402 instruct to update the last data stored in NVRAM 4 to the current data (77), then returns to read and input "printer adjustment" INGp (45) shown in FIG. 14.

If "refreshing" key on the input screen of printer adjustment has been touched by the user and "refreshing" is found in the permission information register, CPU 1 issues "refreshing" direction to CPU 402 (49-51). In response to the direction, CPU 402 performs "refreshing" REGk shown in FIG. 16 (46-48).

If "refreshing" is not found in the permission information register, by contrast, it is indicated that the refreshing authority is not granted to the user as the present operator. As a result, the touching of "refreshing" key is not responded. Namely, this key touch is ignored.

On receiving the "refreshing" direction, CPU 402 proceeds to "refreshing" REGk shown in FIG. 16 and instructs the printer 200 to perform "refreshing 2".

In response to the instruction, the carriage 202 is driven to the cap position (retracted position) from the home position ("return to cap position" 81). In the meantime, the wiping mechanism 206 is adapted to rotate the blade rotor clockwise in FIG. 4 to wipe the undersurface of the carriage 202.

After retracting the carriage 202, the printer 200 is adapted to drive the cap 205 upward to the working location ("capping" 82), in which the seal material on the upper end opening edge of cap 205 is brought to close contact with the bottom face of the carriage.

Next, the printer 200 performs "ink ejection 2 (strong)" (83) and "ink ejection 3 (weak)" (84). The contents of "ink ejection 2 (strong)" (83) and "ink ejection 3 (weak)" (84) are similar to those mentioned earlier on "ink ejection 2 (strong)" (32) and "ink ejection 3 (weak)" (33), respectively.

Subsequently, the printer 200 performs standby (85-87). The contents of the standby (85-87) are similar to those mentioned earlier (37-39).

On receiving a report on the completion of "refreshing 2" (completion of standby), CPU 402 instructs to update the last data stored in NVRAM 4 to the current data (88), then returns to read and input "printer adjustment" INGp (45) shown in FIG. 14.

Referring again to FIG. 14, if Up-key or Down-key, which is placed in anyone of KCYM columns of the "head position x" or the "head position y" on the input screen of printer adjustment, has been touched by the user and "head position" is found in the permission information register, CPU 1 instructs the data currently displayed (i.e., the values for timing data corresponding to Dk, Dc, Dy and Dm of FIG. 4) be updated by either incrementing, or decrementing by one (52-54).

If "head position" is not found in the permission information register, by contrast, it is indicated that the head position adjustment authority is not granted to the user as the present operator. As a result, the touching of "head position" key is not responded. Namely, this key touch is ignored.

In addition, when the "setting" key has been touched by the user, the head position data stored in NVRAM 4 is updated and rewritten as the updated data, and used for controlling the start timing of data recording in the main scanning direction in subsequent printing and copying operations.

If Up-key or Down-key in the columns of "head position x" or "head position y" on the input screen of printer adjustment has been touched by the user and "print start position" is found in the permission information register, the start position data Dx or Dy are altered.

For example, the data currently displayed in the column of "print start position x" (i.e., the record start position Dx, in the primary scanning direction, as the point entering from the left-side edge as reference, toward the center of the width, of recording sheet PAP of FIG. 4, resulting the values of record start timing for respective color heads as Dk+Dx, Dc+Dx, Dm+Dx, and Dy+Dx) are updated after either incrementing, or decrementing by one (55-57).

If "print start position" is not found in the permission information register, by contrast, it is indicated that the print start position adjustment authority is not granted to the user as the present operator. As a result, the touching of "print start position" key is not responded. Namely, this key touch is ignored.

If Up-key or Down-key in the columns of "sheet feed rate" on the input screen of printer adjustment has been touched by the user and "sheet feed rate" is found in the permission information register, CPU 1 instructs the data currently on display (the value for specifying the distance from the leading edge of a recording sheet to the point of point start in the sub-scanning direction y, which is used for determining the timing of starting the sheet feeding out of the registration roller 208 and temporally halting the feed waiting for the print start) be updated and displayed after either incrementing, or decrementing by one (58-60).

If "sheet feed rate" is not found in the permission information register, by contrast, it is indicated that the sheet feed rate adjustment authority is not granted to the user as the present operator. As a result, the touching of "sheet feed rate" key is not responded. Namely, this key touch is ignored.

If "return to initial value" key on the input screen of printer adjustment has been touched by the user and "return to initial value" is found in the permission information register, CPU 1 instructs the data currently on display such as "head position x" and "head position y" (eight kinds), and "sheet feed rate" be reset to respective initial values (standard values or default) stored in NVRAM 4 (61-63).

If "return to initial value" is not found in the permission information register, it is indicated that the adjustment authority of returning to initial value is not granted to the user as the present operator. As a result, the touching of "return to initial value" key is not responded. Namely, this key touch is ignored.

On detecting "cancel" key touch by the user on the input screen of printer adjustment, CPU 1 instructs the display, which has been updated immediately before this key touch, be returned to that before the update (64, 65).

On detecting "return" key touch, CPU 1 instructs the display of liquid crystal display 11 be returned to the initial-setting menu screen (66, 67).

In addition, on detecting "setting" key touch, CPU 1 instructs the data for "printer adjustment" stored in NVRAM 4 be re-written with updated data according user's input for the change (68, 69), and the display of liquid crystal display 11 be returned to the initial-setting menu screen (67).

Figure 17:
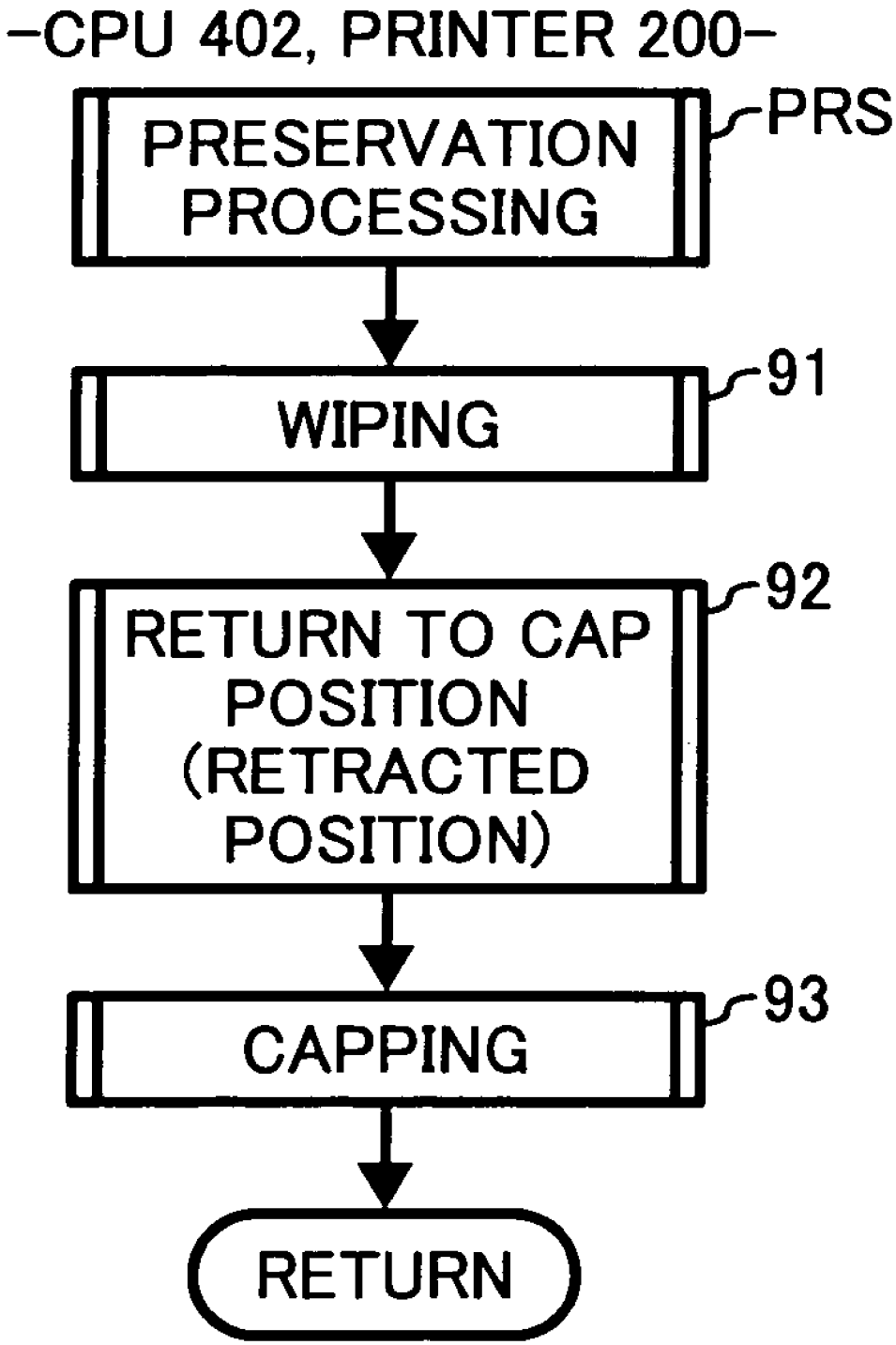
FIG. 17 is another flowchart illustrating the contents of "preservation measures" PRS.

The contents of "preservation measures" PRS of FIG. 11 are shown in FIG. 17.

It is intended with "preservation measures" to suppress undue evaporation of the ink from nozzles by capping the printhead since the period of the SUSPEND mode may continue for a long time once a shift to that mode takes place.

Since the operational power supply (+5V, +24V) is turned off on shifting to the SUSPEND mode, and several steps such as carriage drive, capping, wiping, etc. are then disabled, "preservation measures" is performed immediately before shifting to the suspend mode. Incidentally, the carriage 202 is in the home position immediately before shifting to the suspend mode.

In the "preservation measures" PRS, CPU 402 instructs the printer 200 to perform "preservation cap 205 will be driven in an action position (93)". In response to the instruction, the printer 200 is adapted to rotate the blade rotor of the wiping mechanism 206 clockwise in FIG. 4 (91), and drive the carriage 202 to the cap position (retracted position) (92).

After the carriage 202 passed the wiping mechanism 206, the rotational drive of the blade rotor is stopped. Thereafter, when the carriage 202 is driven to the cap position and registered, the cap 205 is driven to the working position (93).

On completing the driving, the printer 200 reports "preservation measures" to CPU 402, the CPU 402 in turn performs "setting suspend" (12), and the power voltage outputs (+5V, +24V) from the power supply 80 (FIG. 10) are turned off.

FIGS. 18 and 19 are flow charts illustrating the overall feature of the copy control performed responding to copy commands from CPU 301 of the engine 300.

Referring to FIG. 18, when CPU 1 outputs a copy command to CPU 301 in response to the copy start direction made by a user onto the operation board, the CPU 301 initiates the copy control shown in FIG. 18, in that, when a document is placed on ADF 120, the reading unit 110 performs document reading in the sheet-through mode; when "black (BK)" button is pressed ON, the CPU 301 instructs the scanner image processing unit 303 to store G image data, which are subjected to filter processing 307 according to the image region separation results, in the page memory 308 (FIG. 7) (101-103).

After completing the sheet-through mode reading of one document, CPU 301 is adapted to repeat the process of Bk printing including the steps of reading out G image data in the page memory 308, performing necessary processing by the printer image processing unit 304 and binarization processing, outputting to the writing unit 212 of the printer 200, and performing Bk printing, whereby the preset number of copies are delivered from the printer 200 (104).

Subsequently, these steps are repeated for the next document which is fed forwarded from the document tray 121 (105-102).

Thus, the images on each document on the document tray 121 are subjected to the sheet-through mode reading and subsequent printing of the resulting image on the preset number of sheets (104).

When the "black (BK)" button is OFF, CPU 1 instructs to search whether "user authentication release" information is found in the user registration table. If this information is not found in the user registration table, an input screen is shown on the display 11 to request the input of user's name and ID.

In the case when an input into the user name and ID input column is made, and the # key in the ten key block 15 is pressed, the CPU 1 instructs to search whether the user's name and ID are previously registered in the user registration table of NVRAM 4.

If it is found that they are previously registered, the CPU 1 instructs to readout the user information (allowable registered in the user registration of FIG. 13) from NVRAM 4, and store in either RAM 3 or allowable information register allocated in the inside RAM of CPU 1 (102*a*, 102*b*, 106-108).

When the "user authentication release" information is found, the CPU 1 instructs without carrying out user authentication, to store the general-purpose operable information in the allowable information register (102*a*, 102*b*-108). Subsequently, the CPU 1 is adapted to refer copy conditions set on the operation board.

If "full color" button is ON and simultaneously the full color copy is allowed in the allowable information register, the CPU 1 informs a copy permit (copy directions) to CPU 301.

In response to the copy direction, CPU 301 instructs to accumulate RGB image data in the memory 406 (108,109), and performs the full color printing (110).

In the full color printing (110), RGB image data are converted into ymck record color data by the printer image processing unit 304, and record color data are outputted in parallel to the writing unit 212 of FIG. 5 (111).

Subsequently, these steps are repeated for a preset copy number of times (112-113). In addition, the abovementioned operation of full color copy is performed similarly for each document fed forwarded from the document tray 121.

When "black (BK)", "full color", "automatic color selection", "blue (C)", "red (R)", and "yellow (Y)" buttons are all off or alternatively the "automatic color selection" button is ON; CPU 301 instructs the reading unit 110 to perform the sheet-through mode document reading; store G image data, which are subjected to filter processing 307 according to the image region separation results, in the page memory 308; and accumulate RGB image data in the memory 406 (114).

With reference to the decision results by the page judging unit 318 (115), in addition, when the decision indicates that the image data are of black-and-white/character (black-and-white & edge), the steps of the above-mentioned black-and-white copy (104,105) with the "black (BK)" button ON are performed in a similar manner.

By contrast, when the decision results by the page judging unit 318 indicate that the image data are not of black-and-white/character, the full color printing (116) is carried out.

The contents of the full color printing (116) are similar to those mentioned earlier (110).

Referring now to FIG. 19, in the case of no document on ADF 120 when a copy start direction is issued and the "black (BK)" button is pressed ON, the CPU 301 instructs the reading unit 110 to perform a flat-bed mode document reading and black-and-white copying steps (117-119).

When the "black (BK)" button is OFF, CPU 1 instructs to search whether "user authentication release" information is found in the user registration table. If the information is not found, an input screen is shown on the display 11 to request the input of user's name and ID.

When an input is made on the user's name and ID and the # key in the ten key block 15 is pressed, the CPU 1 instructs to search whether the user's name and ID are previously registered in the user registration table of NVRAM 4.

If it is found that they are previously registered, the CPU 1 instructs to readout the user information (allowable registered in the user registration of FIG. 13) from NVRAM 4, and store in either RAM 3 or allowable information register allocated in the inside RAM of CPU 1 (117*a*, 117*b*, 120-122).

When the "user authentication release" information is found, the CPU 1 instructs without carrying out user authentication, to store the general-purpose operable information in the allowable information register (117*a*, 117*b*-122). Subsequently, the CPU 1 is adapted to refer copy conditions set on the operation board.

If "full color" button is ON and simultaneously the full color copy is allowed in the allowable information register, the CPU 1 instructs the reading unit 110 to perform the flat-bed mode reading, accumulate RGB image data in the memory 406 (122,123), and perform the full color printing (124) for a preset copy number of times.

In the full color printing (124), RGB image data are converted into ymck record color data by the printer image processing unit 304, and record color data are outputted in parallel to the writing unit 212 of FIG. 5 (125). These steps are repeated for a preset copy number of times (125, 126).

When "black (BK)", "full color", "automatic color selection", "blue (C)", "red (R)", and "yellow (Y)" buttons are all off or alternatively the "automatic color selection" button is ON; CPU 301 instructs the reading unit 110 to perform the flat-bed mode document reading; store G image data, which are subjected to filter processing 307 according to the image region separation results, in the page memory 308; and accumulate RGB image data in the memory 406 (127).

With reference to the decision results by the page judging unit 318 (128), in addition, when the decision indicates that the image data are of black-and-white/character images, the steps of the above-mentioned black-and-white copy (129) with the "black (BK)" button ON are performed in a similar manner.

The contents of the full color printing (129) are similar to those mentioned earlier (124).

A plurality of printer specification application programs (software) are installed in the personal computer PC to implement input/output capability for enabling the features displayed on the liquid crystal display 11 of FIGS. 8, 13, and 15, and "initial setting" ING of FIG. 11 and "printer adjustment" INGp of FIG. 14.

In a similar manner to inputting from a personal computer PC through the operation board 10, a user is able to input to the printer 200 by way of communication means to perform maintenance and adjustment operations.

Therefore, the personal computer PC is utilized not only for printout by sending the image information to the printer 200, but also for functioning as a remote operation board.

It is apparent from the above description including the examples disclosed that the inkjet printheads and inkjet printer incorporated the printheads disclosed herein have several advantages over similar units and apparatuses previously known.

For example, in the inkjet printer of the invention, it becomes possible to perform a printhead cleaning under the control by a user, in that, while the apparatus like inkjet printer is in use for a number of people, an undue ink consumption caused by unprepared cleaning can be prevented by performing maintenance and adjustment works by a qualified person such as an administrator.

This advantage is effected by the configuration of the present inkjet printer including a user information input unit, a cleaning direction unit, and a control unit, in that the user information input unit is configured to input user information, the cleaning direction unit is configured to issue for a user a first cleaning direction, and the control unit is configured to instruct the cleaning unit to clean the printhead in response to the first cleaning direction issued by the cleaning direction unit on condition that the user information inputted by the user information input unit is permissible to perform the cleaning.

In addition, the inkjet printer further includes a setting unit configured to set a permission for, or a prohibition of, the cleaning corresponding to user identification information, in which the user identification information (such as user's name and ID) is included in the user information, and the control unit instructs the cleaning unit to clean the printhead in response to the cleaning direction by the cleaning direction unit on condition that the permission for the cleaning is already set corresponding to the user information inputted by the user information input unit.

The cleaning is performed in one of a plurality of modes (including cleaning and refreshing) each different in an amount of ink consumption, and the setting unit is configured to set the one of the permission and the prohibition for each of the plurality of modes.

Therefore, a larger amount of ink is consumed in the refreshing mode, which is more extensive than usual cleaning, unnecessary ink consumption can be prevented by performing the maintenance work by an administrator.

Still in addition, a plurality of printhead elements is included in the printhead, and the inkjet printer includes a first adjustment information input unit configured to input printhead position information regarding recording positions by the plurality of printhead elements with respect to a recording sheet such that the recording positions are brought to coincide with each other.

As a result, probable errors in setting the head element position can be prevented by assigning the works to a qualified person, which are otherwise caused by unprepared adjustment works and may adversely affect print qualities.

In addition, the inkjet printer includes first and third adjustment information input units configured to input recording start position information regarding inkjet recording start positions with respect to a recording sheet and to input sheet feed rate information specifying inkjet recording start positions with respect to the leading edge of a recording sheet, respectively, and the control unit instructs these pieces of the information be set, accordingly.

As a result, by assigning the adjustment works to a qualified person, probable errors in setting the head element position can be prevented, which are other wise caused by unprepared adjustment works and may adversely affect print qualities.

In addition, the inkjet printer include a reset instruction unit configured to input an instruction for resetting at least one inkjet recording adjustment value to an initial value thereof, and the control unit instructs at least one of the inkjet recording adjustment values be reset in response to the instruction for resetting by the reset instruction unit on condition that the permission for resetting is already set corresponding to the user information inputted by the user information input unit.

By the reset instruction unit and the control unit and assigning the initialization process steps to a qualified person, probable errors in setting the head element position can be prevented, which are otherwise caused by unprepared adjustment works and may adversely affect print qualities.

Moreover, the inkjet printer include first and second communication units configured to communicate with remote terminals, and the control unit instructs (1) the cleaning unit to clean the printhead in response to the second cleaning direction by the remote terminal by way of the first communication unit, and (2) a variety of adjustment information be properly set in response to the transmission of the variety of adjustment information by way of the second communication unit, respectively.

By means of the first and second communication units, the cleaning and maintenance of the printer can be properly performed by the person, who is familiar with the current printer conditions, even from remote sites. The conditions of the printer can be properly maintained without erroneous steps of the cleaning and maintenance for the printer, thereby preventing the consumption of undue amount of ink, or impairment of print quality.

In addition, the inkjet printer further includes the user authentication release setting unit configured to set the user authentication release and the control unit instructs the setting based on the permission corresponding to the user information be disabled.

Since, in the case when the number of user is presently relatively small, the requirement of setting a user authentication at each occasion of a series of printing process may be cumbersome from the point of efficient use of the printer. It is advantageous, therefore, to provide the inkjet printer with this release setting unit capable of releasing the user authentication, if necessary and permissible.

The process steps set forth in the present description on cleaning and adjusting the inkjet printhead, inkjet printer, and image processing apparatus incorporating the inkjet printer may be implemented using conventional general purpose microprocessors, programmed according to the teachings in the present specification, as will be appreciated to those skilled in the relevant arts. Appropriate software coding can readily be prepared by skilled programmers based on the teachings of the present disclosure, as will also be apparent to those skilled in the relevant arts.

The present specification thus include also a computer-based product which may be hosted on a storage medium, and include instructions which can be used to program a microprocessor to perform a process in accordance with the present disclosure. This storage medium can include, but not limited to, any type of disc including floppy discs, optical discs, CD-ROMs, magneto-optical discs, ROMs, RAMs, EPROMs, EEPROMs, flash memory, magnetic or optical cards, or any type of media suitable for storing electronic instructions.

While the invention has been described in connection with the preferred embodiment, it will be understood that it is not intended to limit the invention to the embodiment. On the contrary, it is intended to cover such modifications or variations as may come within the scope of the following claims.

What is claimed is:

1. An inkjet printer comprising:

at least one printhead configured to eject ink according to print data;

a cleaning unit configured to perform cleaning of said printhead by ejecting ink to produce suitable conditions for an inkjet recording;

a user information input unit configured to input user information;

a cleaning direction unit configured to issue, for a user, a first cleaning direction;

a control unit configured to instruct said first cleaning unit to clean said printhead in response to said first cleaning direction issued by said cleaning direction unit on condition that said user information inputted by said user information input unit permits performing said cleaning, a setting unit configured to set one of a permission for, and a prohibition of, said cleaning corresponding to user identification information, wherein said user identification information is included in said user information, and said control unit instructs said cleaning unit to clean said printhead in response to said first cleaning direction by said cleaning direction unit on condition that the permission for said cleaning is already set corresponding to said user information inputted by said user information input unit.

2. The inkjet printer according to claim 1, wherein said cleaning is performed in one of a plurality of modes, each mode is different in an amount of ink consumption, and said setting unit is configured to set said one of the permission and the prohibition for each of said plurality of modes.

3. The inkjet printer according to claim 2, further comprising:

a plurality of printhead elements included in said printhead; and a first adjustment information input unit configured to input printhead position information regarding recording positions by said plurality of printhead elements with respect to a recording sheet such that the recording positions are brought to coincide with each other, wherein said control unit is configured to instruct said printhead position information inputted by said first adjustment information input unit be set to said printhead position information to bring positions of recording with said plurality of printhead elements in coincidence with each other, on condition that permission for printhead position adjustment is already set corresponding to said user information inputted by said user information input unit.

4. The inkjet printer according to claim 3, further comprising:

a second adjustment information input unit configured to input recording start position information regarding inkjet recording start positions with respect to a recording sheet, wherein said control unit is configured to instruct said recording start position information inputted by said second adjustment information input unit be set to said inkjet recording start positions on condition that permission for recording start position adjustment is already set corresponding to said user information inputted by said user information input unit.

5. The inkjet printer according to claim 4, further comprising:

a third adjustment information input unit configured to input sheet feed rate information specifying inkjet recording start positions with respect to a leading edge of a recording sheet, wherein said control unit is configured to instruct said sheet feed rate information inputted by said third adjustment information input unit be set to inkjet recording start positions with respect to the leading edge of the recording sheet on condition that permission for sheet feed rate adjustment is already set corresponding to said user information inputted by said user information input unit.

6. The inkjet printer according to claim 5, further comprising:

a reset instruction unit configured to input an instruction for resetting at least one inkjet recording adjustment value to an initial value thereof, wherein said control unit is configured to instruct said at least one inkjet recording adjustment value be reset in response to said instruction for resetting by said reset instruction unit, on condition that permission for resetting is already set corresponding to said user information inputted by said user information input unit.

7. The inkjet printer according to claim 3, further comprising:

a second adjustment information input unit configured to input recording start position information regarding inkjet recording start positions with respect to a recording sheet, wherein said control unit is configured to instruct said recording start position information inputted by said second adjustment information input unit to be set to said inkjet recording start positions on condition that permission for recording start position adjustment is already set corresponding to said user information inputted by said user information input unit.

8. The inkjet printer according to claim 3, further comprising:

a third adjustment information input unit configured to input sheet feed rate information specifying inkjet recording start positions with respect to a leading edge of a recording sheet, wherein said control unit is configured to instruct said sheet feed rate information inputted by said third adjustment information input unit to be set to inkjet recording start positions with respect to the leading edge of the recording sheet on condition that permission for sheet feed rate adjustment is already set corresponding to said user information inputted by said user information input unit.

9. The inkjet printer according to claim 3, further comprising:

a reset instruction unit configured to input an instruction for resetting at least one inkjet recording adjustment value to an initial value thereof, wherein said control unit is configured to instruct said at least one inkjet recording adjustment value be reset in response to said instruction for resetting by said reset instruction unit, on condition that permission for resetting is already set corresponding to said user information inputted by said user information input unit.

10. The inkjet printer according to claim 3, further comprising:

a second communication unit configured to communicate with a remote terminal, wherein, in response to a transmission of a variety of adjustment information by way of said second communication unit, including at least one of (1) said printhead position information, (2) said inkjet recording start positions with respect to a recording sheet, and (3) said sheet feed rate information related to said inkjet recording start positions with respect to the leading edge of the recording sheet, said control unit is configured to instruct adjustment information be set to said variety of adjustment information transmitted from said remote terminal on condition that said user information transmitted from said remote terminal by way of said second communication unit permits setting said adjustment information.

11. The inkjet printer according to claim 1, further comprising:

a plurality of printhead elements included in said printhead; and a first adjustment information input unit configured to input printhead position information regarding recording positions by said plurality of printhead elements with respect to a recording sheet such that the recording positions are brought to coincide with each other, wherein said control unit is configured to instruct said printhead position information inputted by said first adjustment information input unit be set to said printhead position information to bring positions of recording with said plurality of printhead elements in coincidence with each other, on condition that permission for printhead position adjustment is already set corresponding to said user information inputted by said user information input unit.

12. The inkjet printer according to claim 1, further comprising:

a second adjustment information input unit configured to input recording start position information regarding inkjet recording start positions with respect to a recording sheet, wherein said control unit is configured to instruct said recording start position information inputted by said second adjustment information input unit be set to said inkjet recording start positions on condition that permission for recording start position adjustment is already set corresponding to said user information inputted by said user information input unit.

13. The inkjet printer according to claim 1, further comprising:

a third adjustment information input unit configured to input sheet feed rate information specifying inkjet recording start positions with respect to a leading edge of a recording sheet, wherein said control unit is configured to instruct said sheet feed rate information inputted by said third adjustment information input unit be set to inkjet recording start positions with respect to the leading edge of the recording sheet on condition that permission for sheet feed rate adjustment is already set corresponding to said user information inputted by said user information input unit.

14. The inkjet printer according to claim 1, further comprising:

a first communication unit configured to communicate with a remote terminal, wherein said control unit is configured to instruct said cleaning unit to clean said printhead in response to a second cleaning direction by said remote terminal by way of said first communication unit on condition that said user information transmitted from said remote terminal by way of said first communication unit permits performing said cleaning.

15. The inkjet printer according to claim 1, further comprising:

a user authentication release setting unit configured to set a user authentication release, wherein, in a case when said user authentication release is already set, said control unit is configured to instruct said setting based on said permission corresponding to said user information be disabled.

16. An image processing apparatus, comprising:

an inkjet printer;

a document scanner configured to read an image of a document and to generate first image data corresponding to said image;

an image data processing unit configured to convert said first image data into second image data suitable for image recording by said inkjet printer and to output to said inkjet printer, said inkjet printer comprising a) user information input means for inputting user information;

b) first cleaning direction means for issuing a cleaning direction for a user;

c) control means for instructing a first cleaning unit to clean said printhead in response to said cleaning direction issued by said cleaning direction means on condition that said user information inputted by said user information input means permits performing said cleaning;

d) setting means for setting one of a permission for, and a prohibition of, said cleaning corresponding to user identification information;

e) first adjustment information input means for inputting printhead position information regarding recording positions by a plurality of printhead elements with respect to a recording sheet such that the recording positions are brought to coincide with each other;

f) second adjustment information input means for inputting recording start position information regarding inkjet recording start positions with respect to a recording sheet;

g) third adjustment information input means for inputting sheet feed rate information specifying inkjet recording start positions with respect to a leading edge of a recording sheet;

h) a reset instruction means for inputting an instruction for resetting at least one inkjet recording adjustment value to an initial value thereof i) first and second communication means for communicating with a remote terminal;

j) user authentication release setting means for setting a user authentication release, wherein said user identification information is included in said user information, and said control means instructs said cleaning unit to clean said printhead in response to said cleaning direction by said cleaning direction means on condition that the permission for said cleaning is already set corresponding to said user information inputted by said user information input means.

17. An inkjet printer comprising:

at least one printhead configured to eject ink according to print data;

a cleaning unit configured to perform a cleaning of said printhead by ejecting ink to produce suitable conditions for an inkjet recording;

user information input means for inputting user information;

first cleaning direction means for issuing a user a cleaning direction;

control means for instructing said first cleaning unit to clean said printhead in response to said cleaning direction issued by said cleaning direction means on condition that said user information inputted by said user information input means permits performing said cleaning, setting means for setting one of a permission for, and a prohibition of, said cleaning corresponding to user identification information, wherein said user identification information is included in said user information, and said control means instruct said cleaning unit to clean said printhead in response to said cleaning direction by said cleaning direction means on condition that permission for said cleaning is already set corresponding to said user information inputted by said user information input means.

18. The inkjet printer according to claim 17, further comprising:

plurality of printhead element means included in said printhead means; and first adjustment information input means for inputting printhead position information regarding recording positions by said plurality of printhead elements with respect to a recording sheet such that the recording positions are brought to coincide with each other, wherein said control means instructs said printhead position information inputted by said first adjustment information input means be set to said printhead position information to bring positions of recording with said plurality of printhead elements in coincidence with each other, on condition that permission for printhead position adjustment is already set corresponding to said user information inputted by said user information input means.

19. The inkjet printer according to claim 18, further comprising:

a reset instruction means for inputting an instruction for resetting at least one inkjet recording adjustment value to an initial value thereof, wherein said control means instructs said at least one inkjet recording adjustment value be reset in response to said instruction for resetting by said reset instruction means, on condition that permission for resetting is already set corresponding to said user information inputted by said user information input means.

20. The inkjet printer according to claim 17, further comprising:

first communication means for communicating with a remote terminal, wherein said control means instructs said cleaning unit to clean said printhead in response to a second cleaning direction by said remote terminal by way of said first communication means on condition that said user information transmitted from said remote terminal permits performing said cleaning.

21. The inkjet printer according to claim 17, further comprising:

user authentication release setting means for setting a user authentication release, wherein, in a case when said user authentication release is already set, said control means instructs said setting based on whether said user information permits performing cleaning to be disabled.

* * * * *